US005578197A

United States Patent [19]

Cyr et al.

[11] Patent Number: 5,578,197

[45] Date of Patent: Nov. 26, 1996

[54] HYDROCRACKING PROCESS INVOLVING COLLOIDAL CATALYST FORMED IN SITU

[75] Inventors: Theodore Cyr; Leszek Lewkowicz; Baki Ozum; Roger K. Lott, all of Edmonton, Canada; Lap-Keung Lee, West Windsor, N.J.

[73] Assignee: Alberta Oil Sands Technology & Research Authority, Edmonton, Canada

[21] Appl. No.: 226,212

[22] Filed: Apr. 11, 1994

Related U.S. Application Data

[63] Continuation-in-part of Ser. No. 349,527, May 9, 1989, abandoned, Ser. No. 375,373, Jul. 3, 1989, abandoned, Ser. No. 448,220, Dec. 11, 1989, abandoned, Ser. No. 577,170, Sep. 4, 1990, abandoned, Ser. No. 580,673, Sep. 11, 1990, abandoned, Ser. No. 617,815, Nov. 26, 1990, abandoned, and Ser. No. 9,000, Jan. 26, 1993, abandoned.

[51] Int. Cl.[6] ..... C10G 47/02

[52] U.S. Cl. ..... 208/112; 208/108

[58] Field of Search ..... 208/108, 112, 208/347

[56] References Cited

U.S. PATENT DOCUMENTS

| | | | |
|---|---|---|---|
| 1,922,491 | 8/1933 | Mittasch et al. | 208/121 |
| 2,271,955 | 2/1942 | Russell | 208/48 R |
| 2,958,643 | 11/1960 | Friedman | 208/60 |
| 3,161,585 | 12/1964 | Gleim et al. | 208/264 |
| 3,193,488 | 7/1965 | Carr | 208/68 |
| 3,224,959 | 12/1965 | Schlinger et al. | 208/107 |
| 3,256,357 | 6/1966 | Baumann et al. | 585/401 |
| 3,560,372 | 2/1971 | Driesen | 208/48 R |
| 3,607,723 | 9/1971 | Peck et al. | 208/59 |
| 3,681,231 | 8/1972 | Alpert et al. | 208/59 |
| 3,694,352 | 9/1972 | Gleim | 208/215 |
| 3,702,818 | 11/1972 | Streed et al. | 208/89 |
| 3,788,973 | 1/1974 | Wolk et al. | 208/59 |
| 3,794,580 | 2/1974 | Ladeur | 208/110 |
| 3,870,623 | 3/1975 | Johnson et al. | 208/108 |
| 3,915,842 | 10/1975 | Gatsis | 208/108 |
| 3,919,074 | 11/1975 | Gatsis | 208/48 R |
| 3,941,681 | 3/1976 | Saegusa et al. | 208/107 |
| 3,963,604 | 6/1976 | Hutchings | 208/211 |
| 3,992,285 | 11/1976 | Hutchings | 208/208 R |
| 4,001,106 | 1/1977 | Plank et al. | 208/75 |
| 4,066,530 | 1/1978 | Aldridge et al. | 208/112 |
| 4,067,799 | 1/1978 | Bearden, Jr. et al. | 208/112 |
| 4,082,648 | 4/1978 | Murphy | 208/97 |
| 4,134,825 | 1/1979 | Bearden, Jr. et al. | 208/112 |
| 4,151,070 | 4/1979 | Allan et al. | 208/59 |
| 4,192,735 | 3/1980 | Aldridge et al. | 208/112 |
| 4,252,634 | 2/1981 | Khulbe et al. | 208/48 R |
| 4,294,686 | 10/1981 | Fisher et al. | 208/56 |
| 4,298,457 | 11/1981 | Oblad et al. | 208/107 |
| 4,313,818 | 2/1982 | Aldridge et al. | 208/108 |
| 4,325,802 | 4/1982 | Porter et al. | 585/242 |
| 4,411,768 | 10/1983 | Unger et al. | 208/59 |
| 4,422,927 | 12/1983 | Kowalczyk et al. | 208/211 |
| 4,443,328 | 4/1984 | Sakurai et al. | 208/106 |
| 4,455,218 | 6/1984 | Dymock et al. | 208/50 |
| 4,467,049 | 8/1984 | Yoshii et al. | 502/317 |
| 4,485,004 | 11/1984 | Fisher et al. | 208/112 |
| 4,551,235 | 11/1985 | Carson | 208/100 |
| 4,561,964 | 12/1985 | Singhal et al. | 208/112 |
| 4,592,827 | 6/1986 | Galiasso et al. | 208/59 |
| 4,592,830 | 6/1986 | Howell et al. | 208/94 |
| 4,606,809 | 8/1986 | Garg | 208/59 |
| 4,661,242 | 4/1987 | Scott et al. | 208/347 |
| 4,695,369 | 9/1987 | Garg et al. | 208/112 |
| 4,698,147 | 10/1987 | McConaghy, Jr. | 208/107 |
| 4,707,245 | 11/1987 | Baldasarri et al. | 208/57 |
| 4,713,167 | 12/1987 | Reno et al. | 208/59 |
| 4,716,142 | 12/1987 | Laine et al. | 502/220 |
| 4,762,607 | 8/1988 | Aldridge et al. | 208/59 |
| 4,765,882 | 8/1988 | Aldridge et al. | 208/59 |
| 4,770,764 | 9/1988 | Ohtake et al. | 208/73 |
| 4,772,378 | 9/1988 | Miyauchi et al. | 208/107 |
| 4,832,819 | 5/1989 | Hamner | 208/27 |
| 4,834,865 | 5/1989 | Kukes et al. | 208/59 |
| 4,897,179 | 1/1990 | Mori et al. | 208/127 |

FOREIGN PATENT DOCUMENTS

| | | |
|---|---|---|
| 0396384 | 11/1990 | European Pat. Off. . |
| 696083 | 9/1940 | Germany . |
| 1034302 | 7/1958 | Germany . |
| 2150150 | 6/1985 | United Kingdom . |
| 91/12297 | 8/1991 | WIPO . |

OTHER PUBLICATIONS

Elements of Chemical Reaction Engineering, pp. 702–704, H. S. Folger, ed. Prentice–Hall, Englewood Cliffs, NJ (1986) (no month).

*Primary Examiner*—Glenn Caldarola
*Assistant Examiner*—Walter D. Griffin
*Attorney, Agent, or Firm*—Millen, White, Zelano & Branigan, P.C.

[57] ABSTRACT

In a hydrocracking process a feed mixture comprising: heavy oil containing asphaltenes and sulfur moieties; an oil-soluble, metal-containing compound additive (such as iron pentacarbonyl or molybdenum 2-ethyl hexanoate), which additive is operative to impede coalescence of coke precursors and which forms hydrocracking catalytic particles in situ; and, optionally, a hydrocarbon diluent which is a solvent for asphaltenes and which will assist with dispersion of the additive; is mixed for a prolonged period at low temperature (e.g., 80° C.–190° C.) in a first vessel or vessels to disperse the additive without significantly decomposing the additive. Preferably, the product mixture is then digested in a second vessel or vessels by mixing it at an elevated temperature (e.g., 250° C.), to decompose the additive. The resulting mixture is then heated to hydrocracking temperature (e.g., 450° C.) and introduced into a reactor. A hydrogen flow, sufficient to maintain mixing in the reactor and efficient (e.g., greater than 98%) stripping of light ends (e.g., end point boiling 20° C.), is provided. the steps of low temperature mixing to achieve dispersion without additive decomposition, preferably digesting to decompose the additive under mixing conditions, and mixing in the reactor with stripping, combine to yield well dispersed, colloidal catalytic particles which function to impede coke evolution and provide high conversion of the high boiling (504° C.) fraction of the feedstock.

43 Claims, 38 Drawing Sheets

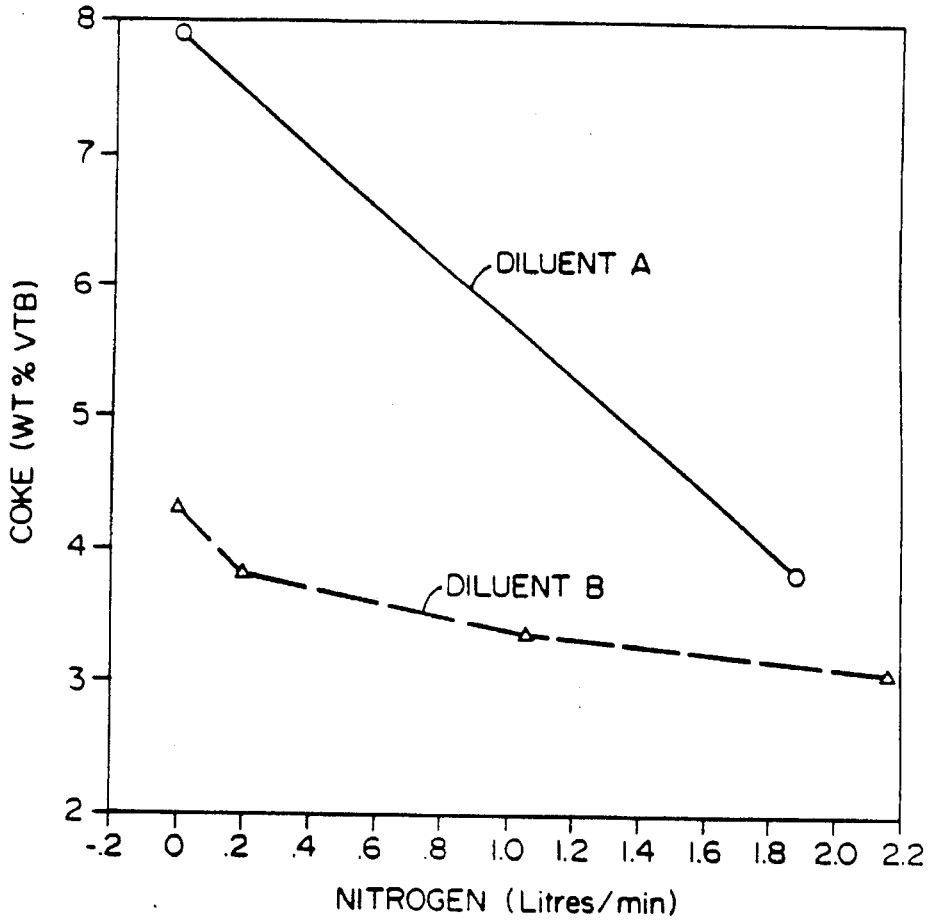
FIG. 17
FIG. 18
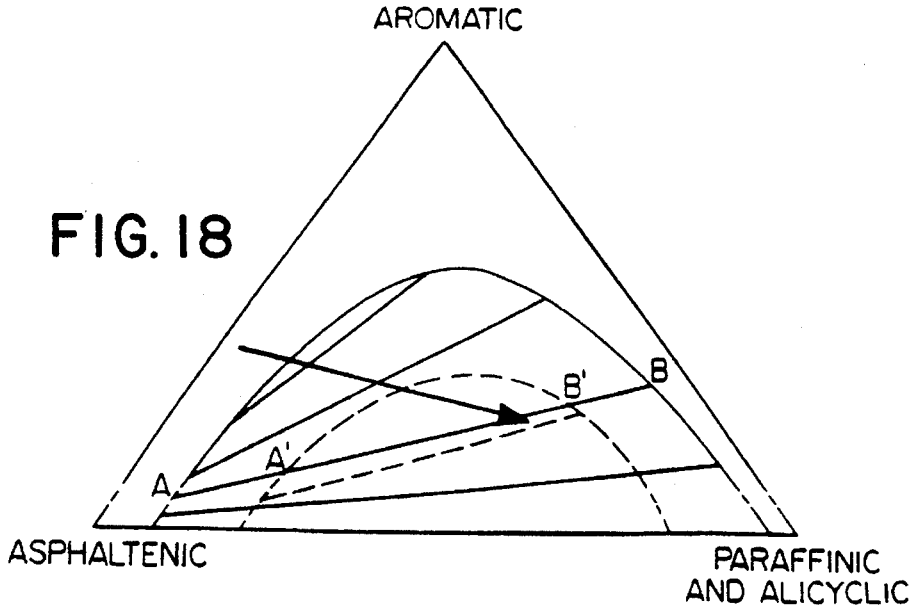

1 ANISOTROPIC AGGLOMERATES

2 ANISOTROPIC SPHERES

3 ANISOTROPIC COARSE MOSIAC

4 ANISOTROPIC FINE MOSAIC

5 BASIC ANISTROPY

6 ISOTROPIC AGGLOMERATES

7 ISOTROPIC SPHERES

8 BASIC ISOTROPY

| Symbol | Catalyst (Mo) | Pressure (MPa) | LHSV (per hr.) | $H_2$ (slpm) | Temperature (°C) |
|---|---|---|---|---|---|
| ● | None | 23.8 | 1.2 | 40 | 455 |
| ■ | None | 17.0 | 4.0 | 28 | 455 |
| □ | 300 ppm | 17.0 | 4.0 | 28 | 455 |
| ○ | 300 ppm | 17.0 | 1.2 - 4 | 13 - 28 | 440 - 485 |

HYDROCRACKING PROCESS INVOLVING COLLOIDAL CATALYST FORMED IN SITU

CROSS-REFERENCE TO RELATED APPLICATIONS

This application is a continuation-in-part of the following applications for U.S. Letters Patent:

Ser. No. 07/349,527, filed May 9, 1989;

Ser. No. 07/375,373, filed Jul. 3, 1989;

Ser. No. 07/448,220, filed Dec. 11, 1989;

Ser. No. 07/577,170, filed Sep. 4, 1990;

Ser. No. 07/580,673, filed Sep. 11, 1990; and

Ser. No. 07/617,815, filed Nov. 26, 1990;

all now abandoned, as well as:

Ser. No. 08/009,000, filed Jan. 26, 1993, now abandoned.

FIELD OF THE INVENTION

This invention relates to an improved process for reducing coke formation in hydrocracking of heavy oil, wherein a mixture of the oil, a solvent for asphaltenes, and an oil-soluble metal compound, which inhibits coalescence of coke precursors and forms catalytic particles in situ, is heated and mixed at moderate temperature in a pre-treatment and is then introduced into the reactor, wherein hydrocracking is conducted with a prolific hydrogen flow to ensure mixing and efficient light end stripping.

BACKGROUND OF THE INVENTION

The present invention was originally developed in connection with hydrocracking of a heavy hydrocarbon feedstock high in content of asphaltenes and sulfur moieties. More particularly, the feedstock tested was vacuum tower bottoms ("VTB") produced from distillation of bitumen. The invention is not limited in application to such a feedstock; however, it will be described below with specific respect to it, to highlight the problems that required solution.

Bitumen contains a relatively high proportion of asphaltenes. When the bitumen or its vacuum tower bottoms are hydrocracked, the asphaltenes produce coke precursors, from which adherent solid coke evolves. The coke deposits on and adheres to the surfaces of the reactor and downstream equipment. In addition, since part of the feedstock is consumed in the production of coke, the conversion of the feedstock to useful products is reduced.

The present assignee is an Alberta government research agency which was given a mandate to foster improvements in the upgrading of bitumen and other heavy oils. Realizing the conversion limitation and operating problems that coke deposition inflicts, it initiated a research project to investigate the mechanisms of coke formation and to look for improvements that might be applied commercially.

The present processes were generated as a result of this work. The research involved a progression of concepts and experimental discoveries that came together to yield a process characterized by a high order of conversion coupled with reduced deposition of adhesive coke and reduced production of coke.

Searches and prosecution of the parents of this application have identified the following relevant prior art:

U.S. Pat. No. 4,294,686 (Fisher et al) teaches that, when liquid hydrogen donor oil is used along with hydrogenation in connection with hydrocracking of bitumen vacuum tower residua, coke deposition is allegedly eliminated.

However the present assignee and the assignee of the above cited patent jointly conducted a large scale hydrocracking test on bitumen residue using a liquid hydrogen donor process. This test encountered serious coke production problems. It appears that hydrocracking high asphaltene content feed such as bitumen residue requires more than the presence of liquid hydrogen donor oil alone.

U.S. Pat. No. 4,455,218 (Dymock et al) teaches use of $Fe(CO)_5$ as a source of catalyst formed in situ for hydrocracking heavy oil in the presence of $H_2$. The reaction is allegedly characterized by elimination of coking.

U.S. Pat. No. 4,485,004 (Fisher et al) teaches hydrocracking heavy oil in the presence of hydrogen, hydrogen donor material, and catalyst comprising particulate Ni or Co on alumina.

U.S. Pat. No. 4,134,825 (Bearden et al) teaches forming solid, non-colloidal catalyst in situ in heavy oil using trace amounts of Fe added in the form of an oil-soluble compound such as iron carbonyl. The metal compound is added to the oil and heated to 325°–415° C. in contact with hydrogen to convert it to a solid, non-colloidal, catalytic form. This catalyst is then used in hydrocracking the oil and it is stated that coke formation is inhibited.

U.S. Pat. No. 4,592,827 (Galliasso et al) teaches injecting an oil-soluble, catalyst precursor Mo compound and water into a heavy oil stream moving to a heater, wherein the mixture is heated to a temperature of 230° C.–420° C. to effect decomposition of the Mo compound. The heater product is then introduced into a hydrocracking reactor.

SUMMARY OF THE INVENTION

In one aspect of the research work underlying the present invention, coke was produced by hydrocracking a mixture of diluent and bitumen vacuum tower bottoms ("VTB") and the coke composition was studied microscopically. It was found that at progressive stages of the evolution of the coke precursors into adherent solid coke, there were present different species of isotropic and anisotropic submicron and micron-sized spheroids. Some of the figures forming part of this specification illustrate these various species, which we have identified with the following labels:

isotropic sphere; (FIGS. 1 and 6)

basic isotropic particle; (FIG. 1)

isotropic agglomerates; (FIG. 3)

anisotropic spheres; (FIGS. 2 and 5)

basic anisotropic particles; (FIG. 2)

anisotropic fine mosaic particles; (FIG. 4)

anisotropic coarse mosaic particles; (FIG. 4) and anisotropic agglomerates (FIG. 4).

It was further experimentally discovered:

That the evolution of the coke precursors into coke involved a coalescence process from the minute isotropic species to the larger species (FIGS. 5 and 6); and That if the coalescence process was inhibited with the major portion of the precursors remaining in the isotropic and anisotropic agglomerate states, then the deposition of adherent and solid coke was significantly reduced and even virtually eliminated.

These observations led to seeking out and identifying compatible additives that would interfere with the coalescence process and assist in reaching an end where, if any coke was present, it would be present predominantly in the form of agglomerate species, preferably in the isotropic state. It was postulated that a well-dispersed, oil-soluble, metal compound might be used to react in situ with sulfur moieties of the bitumen VTB to produce colloidal, catalytic particles having wetting characteristics that would enable the colloidal particles to collect at the surfaces of the precursor spheroids and inhibit the spheroids from coalescing. Furthermore, it was postulated that an appropriate diluent might advantageously be used to assist in dispersing this additive and in solubilizing the processor spheroids.

It was experimentally discovered that:

if an oil-soluble Mo, Fe, Ni or Co compound additive, for example iron pentacarbonyl or molybdenum 2-ethyl hexanoate, which was decomposable at hydrocracking temperature and which was capable of forming particles in situ that were catalytic with respect to hydrocracking, was mixed with heavy oil (and preferably with a diluent) at a moderate elevated temperature, that was in the range 50°–300° C., preferably 80°–190° C. and which was less than the decomposition temperature of the additive, for a period of time sufficient to ensure substantially uniform dispersion of the additive throughout the oil and association of the additive with the asphaltenes; and if the resultant mixture was heated to hydrocracking temperature and reacted in a reactor;

then the postulated mechanism appeared to take place.

Stated otherwise, inclusion of the additive in the reaction mixture undergoing hydrocracking did have the desired effect of reducing the deposition of adherent solid coke provided that the additive was well dispersed in the manner described. Examination of cooled solid samples after hydrocracking showed that the major portion of coke produced under these conditions was in the form of isotropic agglomerates. It is believed that at reactor temperature this coke would have taken the form of minute spheroids of coke precursor. Chemical analysis of the sample coke indicated that additive metal sulfide was associated therewith in a significant amount and that most of the metal sulphides were colloidal, typically being less than 0.1 nanometers in dimension.

In summary, in accordance with the invention an oil-soluble, decomposable metal compound of the type described is firstly well dispersed by mixing, preferably with the aid of a diluent, at moderate elevated temperature (e.g. 100° C.) in the heavy oil and becomes associated with the asphaltenes. When the mixture is then subjected to hydrocracking temperature, colloidal metal sulfide particles are produced which are thought to accumulate at the surfaces of or inside spheroids rich in coke precursors and interfere with their coalescence. Upon completion of hydrocracking the coke precursors are found to be largely transformed into isotropic agglomerates. It is further found that the deposition of adhesive solid coke is significantly reduced.

Subsequent experimental work has shown:

That if the additive is added to the oil at reactor inlet or at the pre-heater immediately upstream of the reactor, so that prolonged mixing at a proper moderate temperature is not carried out, then hydrocracking is characterized by coke fouling;

That if prolonged mixing is done, but at a temperature that is greater than the decomposition temperature of the additive, then the catalytic particles produced are relatively large (e.g. 5 microns to 4 mm) and non-colloidal—in this case, coke fouling occurs;

That if bitumen is the oil used, it usually contains sufficient solvent for asphaltenes, so as not to require the addition of diluent or solvent; and That a preferred procedure involves:

mixing the oil, additive, and preferably an asphaltene solvent, at a temperature in the range 80°–190° C., which temperature is less than the decomposition temperature of the additive, for sufficient time to uniformly disperse the additive, then digesting the product with mixing at an increased temperature which is greater than the additive decomposition temperature but less than hydrocracking temperature, to decompose the additive while maintaining it in a well dispersed state; and then heating the mixture to hydrocracking temperature and introducing it into the reactor.

The test as to whether the dispersion and digestion steps have been properly conducted for sufficient time, with sufficient agitation and at an appropriate temperature is affirmatively answered if the additive is converted into catalytic metal sulphide particles of colloidal size.

When the phrase "decomposition temperature" is used in this specification, it is intended to mean that temperature at which less than about 10% by weight of the additive decomposes during the course of the dispersion step.

Turning now to a second approach that was explored, it was well known that asphaltenes precipitate when pentane is added. Upon considering this known fact, applicants conceived the notion of emphasizing the removal of light ends during hydrocracking to determine the effect on coke formation. Experimental work was therefore initiated to determine the effect of stripping light ends (Boiling point ("B.P.") <220° C.) from the hydrocracking zone. Experimentation showed that coke formation was reduced when light ends were consistently removed during hydrocracking. To improve this, it appeared desirable to apply mixing to the mixture during hydrocracking. Mixing would have the further attribute of maintaining dispersion of the additive metallic component.

To further elaborate on the foregoing, it had been noted that coke formation is associated with phase separation. It was postulated that, if the coke precursors became richly concentrated in a distinct phase, then the coke formation process would proceed rapidly and quantitatively. To impede this, it appeared desirable to strip light ends and reduce phase separation.

Therefore, as a second preferred aspect of the invention, a tube reactor is used, preferably substantially free of internals, and the hydrogen flow through the reactor is prolific and is arranged to achieve mixing throughout the length and breadth of the reaction zone. The prolific hydrogen flow functions to strip light ends from the zone. Preferably, mixing and stripping is accomplished by ensuring that the hydrogen flow is in the range of 8,000–20,000 SCF/BBL and is sufficient to provide the following Peclet Number ("P.N.") regime in the reactor chamber:

Liquid:

axial P. N.=less than 2.0, preferably less than 1.0, most preferably less than about 0.01

Gas:

axial P.N.=more than 3.0, preferably greater than 5.0.

In another thrust at reducing phase separation, a diluent for solubilizing the asphaltenes was added to the reaction mixture. The diluent (or solvent) was a hydrocarbon fraction having a B.P. of about 220°–504° C., preferably 220°–360° C. The solvents used successfully had a high cot Θ value, as defined in the paper "Oil Sands Composition and Behaviour" by Jean Bichard, (1987) page 2–30 published by Alberta Oil Sands Technology and Research Authority, Edmonton, Alberta, Canada.

The preferred diluent contained cyclic moieties that are either aromatic or alicyclic but not aliphatic. For example, n-hexane was not a good diluent but cyclohexane, decalin and benzene were good diluents, the last being preferred. However, in the hydrocracker, less expensive than these diluents are the 220° C. to 360° C. heavy aromatic fraction of the hydrocracker gas-oil or the same fraction of coker gas-oil that has not been stabilized.

It was hoped that the diluent would in addition function usefully as a liquid hydrogen donor and, in combination with the produced colloidal metal sulfide (which is catalytic in nature) and the plentiful hydrogen, would create a regime that would be favourable to high conversion of the high boiling (e.g. greater than 504° C.$^+$) fraction and low coke deposition. Experimental runs indicated that when the combination of diluent addition, well dispersed additive addition, and light ends stripping with hydrogen was practised in the context of hydrocracking of heavy oil containing asphaltenes and sulfur moieties, exceptionally high conversion of the high boiling hydrocarbons could be achieved, together with virtually no adhesive coke deposition. When the diluent was omitted from the combination, or the diluent was not a good solvent of asphaltenes or when stripping of light ends was not sufficient, experimental runs showed significant coke deposition. It is to be understood however that diluent addition is only a preferred feature.

In summary then, dispersion is therefore preferably achieved in a distinct step prior to heating to additive decomposition or hydrocracking temperature, by mixing the heavy oil plus additive plus diluent mixture in means such as continuous flow, stirred tank mixer, the mixture being maintained at a temperature that is in the range 50°–300° C., preferably 80°–190° C., but less than the temperature at which the additive decomposes significantly, the residence time being sufficient to ensure that the additive is substantially uniformly dispersed throughout the mixture. It is preferable also that two or more continuous flow, stirred tank reactors in series be employed for this mixing.

Broadly stated, in one aspect the invention comprises a process for preparing a heavy hydrocarbon feedstock for hydrocracking, said feedstock containing asphaltenes and sulfur moieties, comprising: combining the feedstock and an oil-soluble metal compound additive and temporarily retaining the product in a mixer and mixing it at a temperature that is in the range 50° C. to 300° C. and less than the decomposition temperature of the additive, to produce a product mixture; said additive being selected from the group consisting of molybdenum, iron, nickel and cobalt compound additives, said additives being operative to decompose and react, when heated to hydrocracking temperature, with sulfur moieties in the feedstock to form metal sulfide particles that are catalytic for hydrocracking; said mixing being conducted for sufficient time to cause the additive to be sufficiently dispersed so that the metal sulfide particles formed upon hydrocracking are colloidal in size.

In another broad aspect, the invention comprises a process for hydrocracking a heavy hydrocarbon feedstock containing asphaltenes and sulfur moieties, comprising: combining the feedstock and an oil-soluble metal compound additive and temporarily retaining the product in a mixer and mixing it at a temperature that is in the range 50° C. to 300° C. and less than the decomposition temperature of the additive, to produce a product mixture; said additive being selected from the group consisting of molybdenum, iron, nickel and cobalt compound additives, said additives being operative to decompose and react, when heated to hydrocracking temperature, with sulfur moieties in the feedstock to form metal sulfide particles that are catalytic for hydrocracking; said mixing being conducted for sufficient time to cause the additive to be sufficiently dispersed so that the metal sulfide particles formed upon hydrocracking are colloidal in size; then further heating the product mixture to hydrocracking temperature; introducing the heated product mixture into the chamber of a hydrocracking reactor; temporarily retaining the heated product mixture in the chamber, continuously passing sufficient hydrogen through substantially the breadth and length of the chamber contents to maintain mixing of the chamber contents and stripping of light ends, and removing unreacted hydrogen and entrained light ends from the chamber and producing pitch containing colloidal metal sulfide.

In still another preferred aspect of the invention, pitch is recycled from the downstream hot separator to the reactor, to improve the conversion. In a more preferred aspect, the separator product, containing heavy distillates and pitch, is distilled to separately recover pitch; in conjunction with this, fresh feed is added to the separator product stream entering the distillation vessel, to reduce the separation of asphaltenes from the pitch. The addition of fresh oil is operative to reduce or prevent the production of adhesive asphaltene lumps, which would otherwise appear in the distillation vessel.

In a preferred embodiment, the invention involves the following units and conditions in the hydrocracking operation, having reference to FIG. 44:

Thermal hydrocracker:
- operating temperature—430°–460° C., preferably 450°–455° C.;
- operating pressure—1500–3000 psig, preferably about 2000 psig;

High pressure hot separator:
- operating temperature—greater than about 350° C.;
- operating pressure—reactor pressure;

Adding 5–15% fresh feed (heavy oil) to the underflow from the hot separator;

Low pressure hot separator:
- operating temperature—less than temperature of hot separator;
- operating pressure—100 to 500 psig;

Recycling 0 to 95% pitch from the low pressure hot separator to the reactor.

DESCRIPTION OF THE DRAWINGS

FIG. 17 is a plot showing nitrogen flowrate versus coke production for Example V;

FIG. 18 is a phase diagram for Example V;

FIG. 31 showing process conditions used to prepare concentrate of iron in bitumen by decomposing $Fe(CO)_5$ in bitumen and FIG. 32 showing the arrangement of equipment used to test the effect of concentrate of iron;

FIG. 41 is a simplified schematic of a further modified form of the pilot circuit of FIG. 40, indicating the recycle of pitch and addition of feed, which was practised in the third stage of run R 2-1; note that the feed and catalyst precursor (molybdenum ethyl hexanoate solution) were mixed and circulated at temperature <110° C. for 24 hours before the start of any test;

DESCRIPTION OF THE PREFERRED EMBODIMENT

Figure 1:
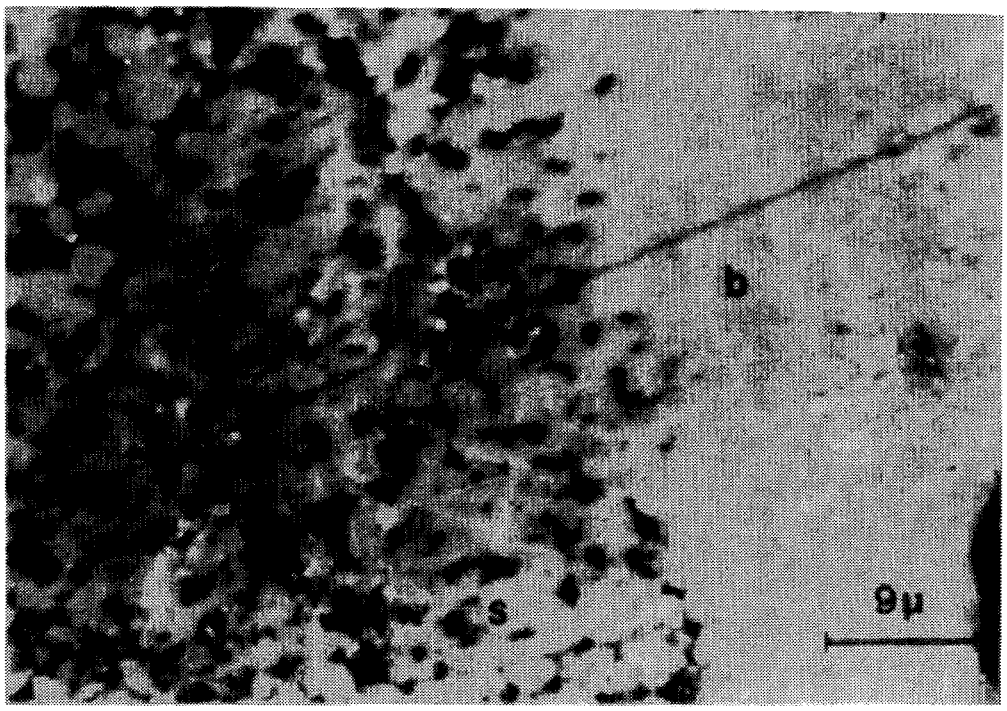
FIG. 1 is a photographic representation showing the nature of isotropic sphere(s) and basic isotropic particles (b), magnified 1650×.
Figure 2:
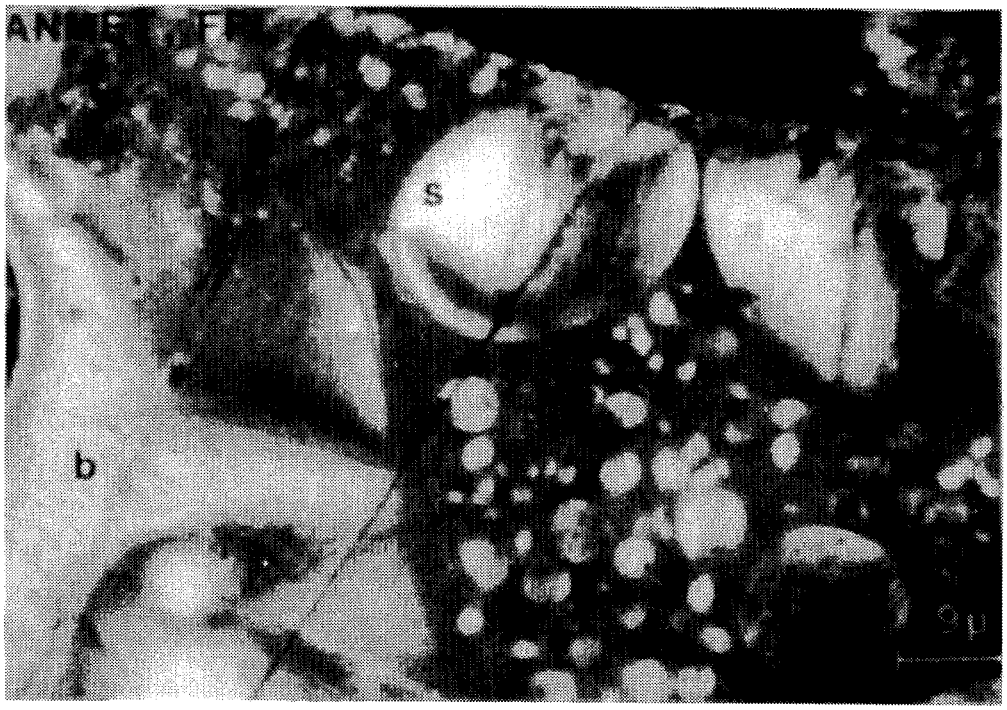
FIG. 2 is a photographic representation showing the nature of anisotropic spheres (s) and basic anisotropic particles (b), magnified 1650×.
Figure 3:
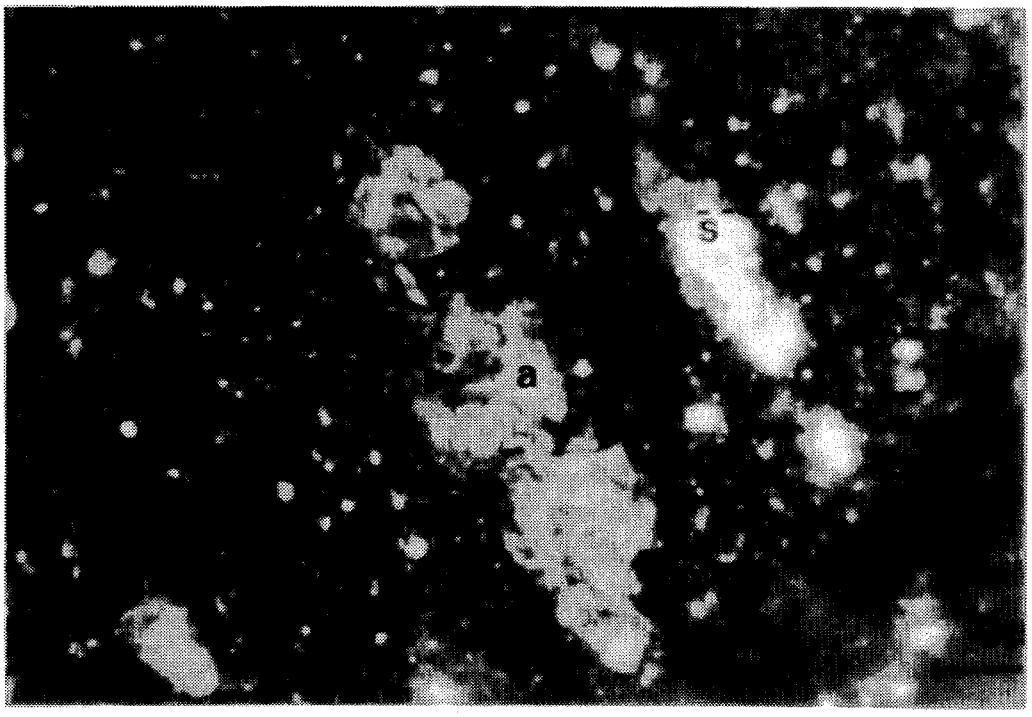
FIG. 3 is a photographic representation showing the nature of isotropic agglomerates (g) along with anisotropic solids (a) and iron sulfide particles (S), magnified 1650×. Here, the iron sulfide particles originated from the feedstock. The coke sample studied by the microscope was generated from thermal test without any iron additive (see FIG. 17)
Figure 4:
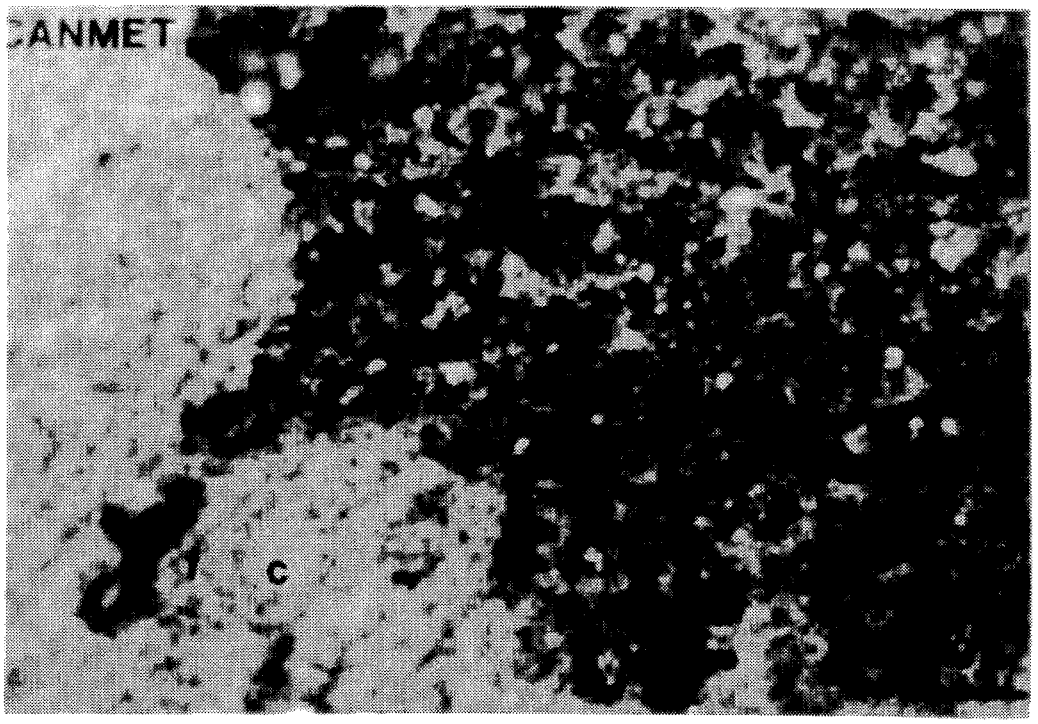
FIG. 4 is a photographic representation showing the nature of anisotropic agglomerates (a), anisotropic fine mosaic (f), and anisotropic coarse mosaic (c), magnified 1650×.
Figure 5:
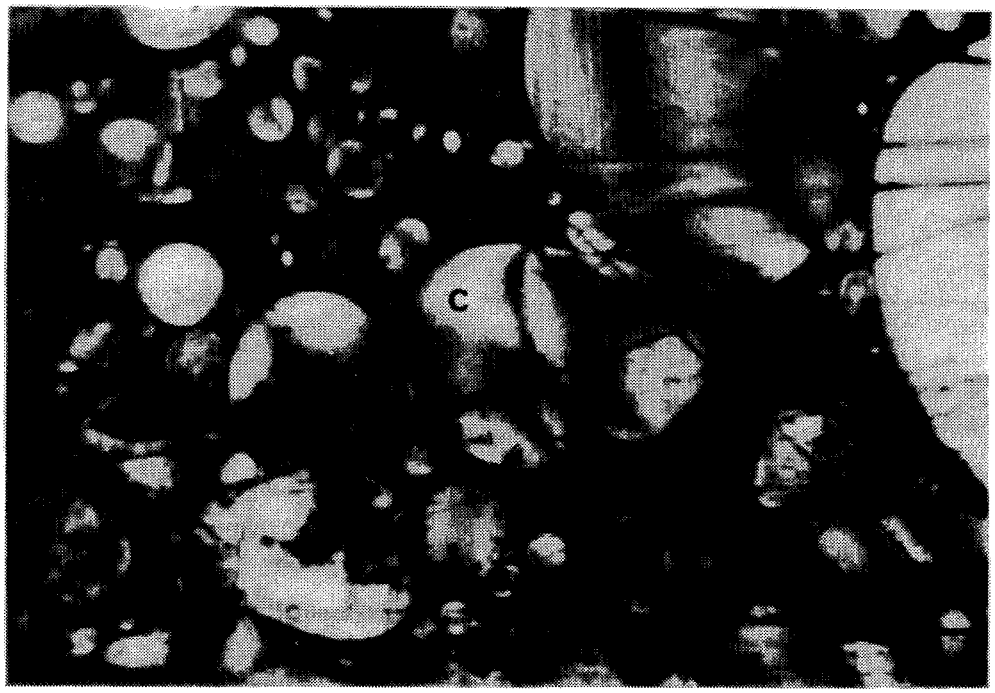
FIG. 5 is a photographic representation showing anisotropic coke particles having grown via the coalescence of smaller anisotropic spheres (c), magnified 1650×.
Figure 6:
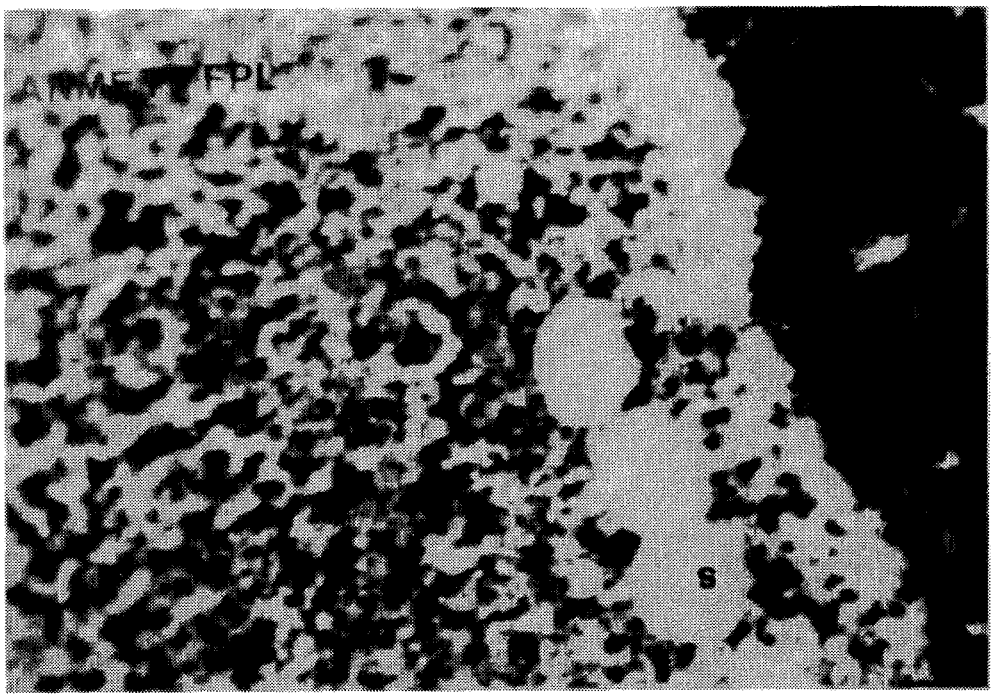
FIG. 6 is a photographic representation showing isotropic coke particles having grown via the coalescence of smaller isotropic spheres (s), magnified 1650×.

The feedstock to the process is heavy oil. This term is intended to include bitumen, crude oil residues and oils derived from coal-oil co-processing that contain asphaltenes and sulfur moieties. A typical feedstock could be vacuum tower residues derived from Athabasca bitumen.

The feedstock is mixed with a catalyst precursor additive and, preferably, a hydrocarbon solvent for asphaltenes.

The additive is an oil-soluble metal compound adapted to decompose at hydrocracking temperature and to react with sulphur moieties in the oil to form, in situ, metal sulphide particles that are catalytic for hydrocracking and which function to impede coalescence of coke precursors. The metal can be selected from the group consisting of Fe, Ni, Co and Mo. Preferred compounds are iron pentacarbonyl and molybdenum 2-ethyl hexanoate.

The hydrocarbon solvent for asphaltenes is preferably a recycled stream having a boiling point in the range 220° C.–504° C., preferably 220°–360° C., and preferably having a high cot O value, as defined in the paper previously mentioned "Oil Sands Composition and Behaviour" by Jean Bichard.

The amount of additive added is in the range 0.0001–5 wt. %, based on the weight of the feedstock. Preferably, we use about 0.002–0.5 wt. %. Typically, for the specific preferred compounds we use:

molybdenum 2-ethyl hexanoate—0.01 wt. % molybdenum naphthahate—0.007 wt. % iron pentacarbonyl—0.05 wt. %.

With respect to the solvent for asphaltenes, some feedstock (e.g. crude Athabasca bitumen) may already contain sufficient solvent so as to not require discrete solvent addition. But in the cases where solvent addition is desirable, the preferred weight ratio of solvent to feedstock is in the range 1:10 to 3:1, preferably 1:4 to 1:1.

Mixing can be accomplished in a continuous flow, heated, stirred tank mixer or by pumping the mixture from a tank, through a preheater, and back to the tank. In any event, mixing is conducted in accordance with the following conditions:

mixture temperature: within the range 50°14 300° C., preferably 80°–190° C., and less than that temperature at which more than about 10 wt. % of the additive is decomposed during the mixing step;

retention time: sufficient to ensure that the additive is substantially uniformly dispersed throughout the oil and is associated substantially at the molecular level with asphaltene.

The process has become focused on use of iron pentacarbonyl and molybdenum 2-ethyl hexanoate as the preferred additives.

In the case of the iron pentacarbonyl, a relatively large amount of it needs to be used to achieve satisfactory conversions. However, if too much is used, it tends to form iron products that build up in the piping and result in blockages and pressure surges. To properly use iron pentacarbonyl, we have found it desirable to first well disperse it in the oil at moderate temperature by mixing and then decompose the additive in a higher temperature digestion step, again under mixing conditions to keep the catalyst precursor dispersed.

By way of a typical example, for the case of using iron pentacarbonyl as the additive and 504° C.$^+$ bitumen vacuum tower residuum as the oil, we use the following conditions:

additive amount: 250 ppm (based on oil)

solvent: 200°–504° C. bitumen fraction solvent/oil ratio: 1:1.2 dispersion time: 20 minutes dispersion temperature: 110° C.

dispersion vessel: 1 liter tank with impellor operating at 800 rpm digestion time: 60 minutes digestion temperature: 250° C.

digestion vessel: 3.8 liter tank with impellor operating at 1000 rpm.

By way of a typical example for the case of using molybdenum 2-ethyl hexanoate as the additive with 430° C.$^+$ bitumen vacuum tower residuum as the oil, we use the following conditions:

additive amount: 150 ppm solvent: 430°–524° C. fraction solvent/oil ratio: 1:2 dispersion time: 24 hours dispersion temperature: 100° C.

dispersion vessel: 75 liters digestion time: 60 seconds no digestion

The mixture is then rapidly heated to about 450° C.–455° C. and introduced into the hydrocracking reactor. In the reactor, hydrogen is supplied at a rate sufficient to satisfy the Peclet No. regime previously described, to ensure that mixing of the reactor charge occurs and that light ends or volatiles are stripped from the charge.

By way of an example, we have typically used the following conditions in hydrocracking the mixture produced by the pilot plant when using the mixing treatments previously described:

reactor size: 87" long×1.77" diameter reactor pressure: 1500 psig reactor temperature: 455° C.

$H_2$ rate: 68 l/min.

mixture rate: 2405 g/hr.

distillate flow rate: 1082 g/hr.

pitch flow rate: 1322 g/hr.

["Conversion" is determined by calculating:

$$100\% \frac{(524° \text{ C.}^+ \text{ fraction in } 524° \text{ C.}^+ \text{ fraction out})}{(524° \text{ C.}^+ \text{ fraction in})}$$

where the 524° C.$^+$ fraction includes coke but is mineral free.]

In the case of the $Fe(CO)_5$ additive run, pilot plant results based on the typical conditions described showed a typical conversion of 90% of the 524° C.$^+$ fraction. The pitch was analyzed and found to contain colloidal iron sulfide. Coke production was about 1%.

In the case of the molybdenum 2-ethyl hexanoate run, pilot plant results based on the typical conditions described showed a typical conversion of 90% of the 524° C.$^+$ fraction. The pitch contained colloidal molybdenum sulfide. Coke production was about 0.3%.

The invention as described will now be supported by examples and data developed experimentally.

EXAMPLES I–V

The following examples I–V are included to illustrate some of the features investigated in the early work underlying the present process.

All the tests in examples I–V were performed in a 1 liter, baffled, stirred autoclave. The charge, comprising Athabasca vacuum tower bottoms (504° C.$^+$) as feedstock, solvent (otherwise referred to as "diluent") and additive (if used), was introduced into the autoclave. The autoclave was sealed, purged free of air, pressurized with nitrogen or hydrogen and heated to 430° C. The reactor was stirred at 800 rpm, with a reaction temperature of 430° C. and a reaction time of 105 minutes.

Properties of the Athabasca vacuum tower bottoms (VTB) are given below.

| | wt. % |
|---|---|
| C | 81.76 |
| H | 9.51 |
| S | 6.23 |
| N | 0.78 |
| API @ 16° C.: | 2.43 |
| IBP 504° C. | |

Table 1 herebelow provides the composition (wt. %) of diluents used during the experimental procedures.

It is noteworthy that according to the relative content of condensed dicycloparaffins and benzocycloparaffins, diluent B has the most hydrogen donor capability and diluent C has the least.

TABLE 1

| Hydrocarbon Type | Diluents A | B | C |
|---|---|---|---|
| Paraffins | 13.02 | 16.38 | 13.10 |
| Uncondensed Cycloparaffins | 7.32 | 6.29 | 5.51 |
| Condensed Dicycloparaffins | 5.20 | 13.03 | 3.80 |
| Condensed Polycycloparaffins | 0.49 | 1.27 | 0.15 |
| Alkylbenzenes | 18.07 | 15.25 | 11.25 |
| Benzocycloparaffins | 32.29 | 37.54 | 20.36 |
| Benzodicycloparaffins | 4.77 | 3.80 | 5.53 |
| Naphthalenes | 15.86 | 6.11 | 19.49 |
| Naphthacycloparaffins | 1.61 | 0.26 | 7.73 |
| Fluorenes | 0.82 | 0.00 | 6.21 |
| Phenathrenes/Anthracene | 0.61 | 0.00 | 6.18 |

EXAMPLE I

This example illustrates the effect of different diluents. The autoclave was charged with 109 grams of bitumen and 220 grams of diluent A, B or C. A nitrogen overpressure of 0.55 MPa was applied and the contents were thermally cracked at 430° C. for 105 minutes.

Figure 8:
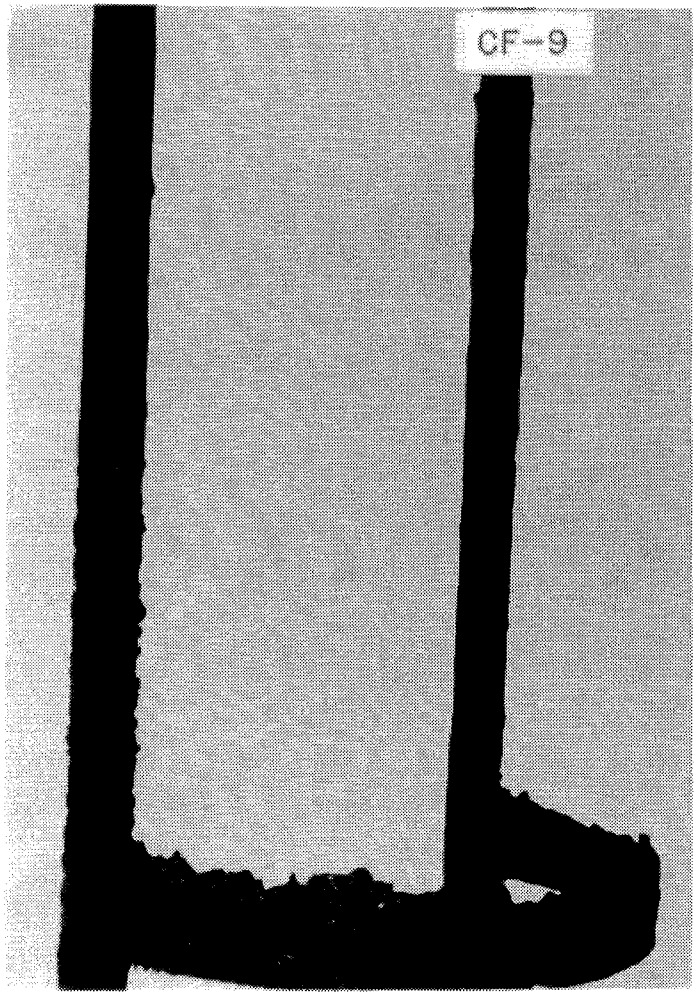
FIG. 8 is a photographic representation of the reactor baffle after run CF-9 set forth in Example I (Table 2)
Figure 7:
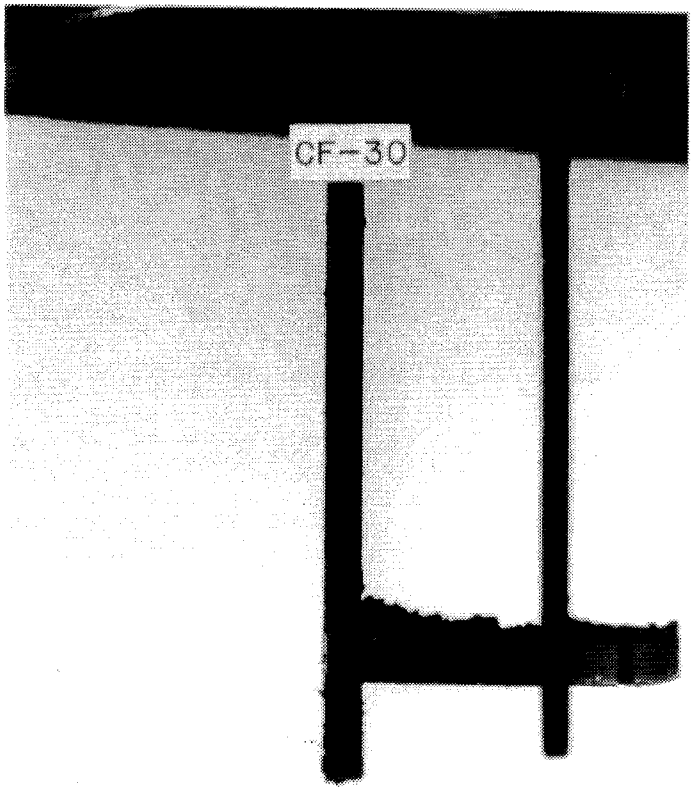
FIG. 7 is a photographic representation of the reactor baffle after run CF-30 set forth in Example I (Table 2)
Figure 9:
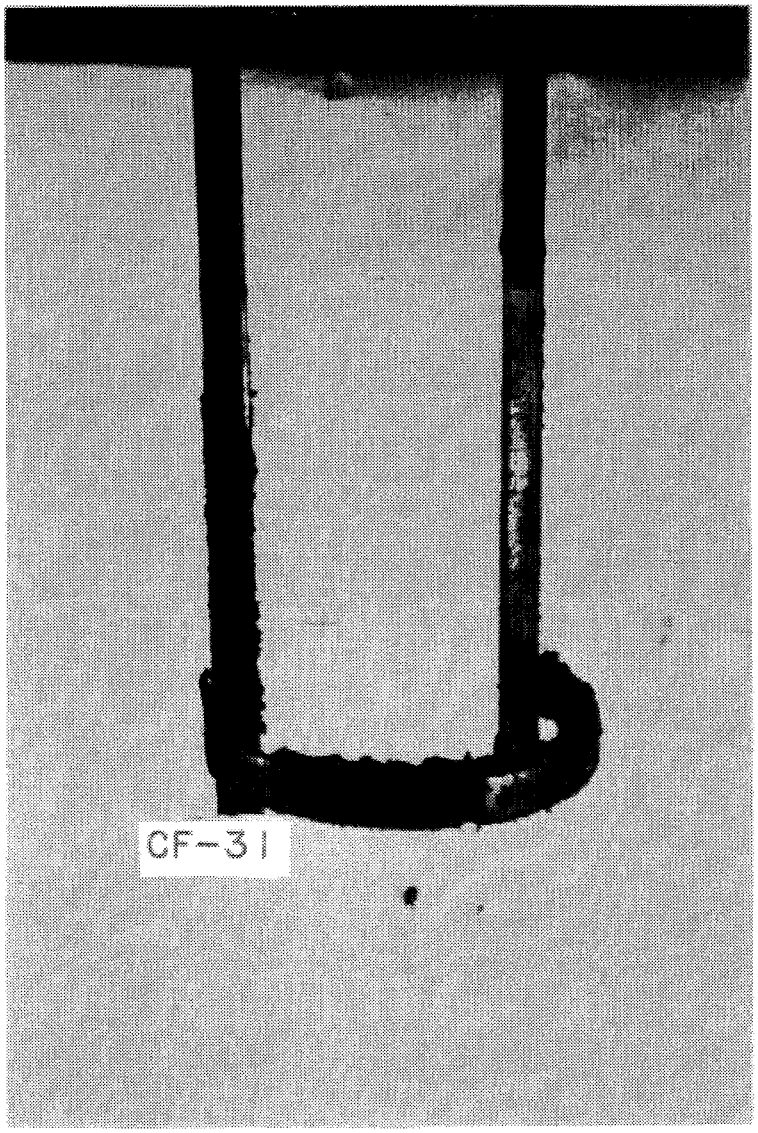
FIG. 9 is a photographic representation of the reactor baffle after run CF-31 set forth in Example I (Table 2)

The results of the tests are shown in Table 2. The reactor was opened and FIGS. 7, 8 and 9 show the coke deposited on the baffles for experiments CF-30, CF-9 and CF-31, respectively.

It is noteworthy that experiment CF-31 produced as much coke as experiment CF-9 but that the coke was most easily dislodged from the baffles and reactor surfaces. Moreover, although experiment CF-31 produced nearly twice as much coke as experiment CF-30, the coke was most easily dislodged. The surfaces of the reactor and baffles of experiment CF-31 were least fouled.

Figure 10:
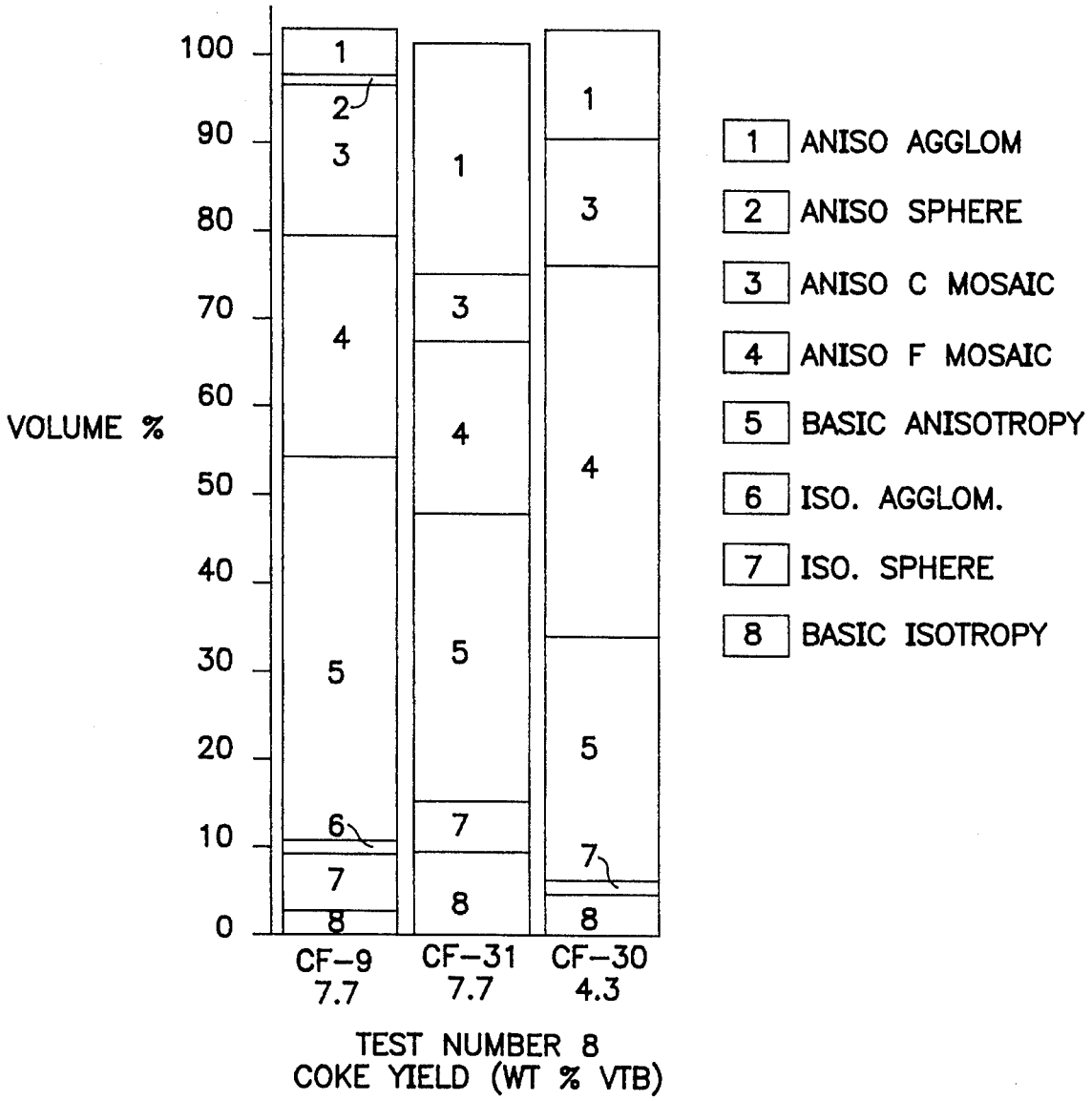
FIG. 10 is a bar chart setting forth coke composition for runs CF-9, CF-31 and CF-30.

The coke from the three experiments was examined microscopically and the results are shown in FIG. 10. It was noted that when the agglomerate content (which was anisotropic) was relatively high (Experiment CF-31), the coke deposition and adhesion was least intense in spite of the fact that diluent C had the least hydrogen donor capability.

TABLE 2

Test conditions: 430° C., 105 min., 800 rpm, 0.55 MPa initial $N_2$ pressure
Diluent to Vacuum Tower Bottoms ratio is 2:1

| Experiment No. | CF-30 | CF-9 | CF-31 |
|---|---|---|---|
| Diluent type | B | A | C |
| Yield (wt. % vacuum tower bottom corrected for diluent) | | | |
| $H_2$ | 0.21 | 0.07 | 0.08 |
| $C_1$–$C_4$ | 10.3 | 10.8 | 14.8 |
| $C_5$–200° C. | 42.3 | 57.1 | 55.2 |
| 200–360° C. | −8.6 | −37.2 | −43.5 |
| 360–504° C. | 22.8 | 26.5 | 30.6 |
| 504° C.$^+$ (coke free) | 26.3 | 33.8 | 34.6 |
| Coke | 4.3 | 7.7 | 7.7 |
| Conversion to 504° C. & coke | 73.7 | 66.2 | 65.4 |
| Mass Balance | 98.2 | 97.3 | 96.9 |

EXAMPLE II

This example illustrates the effect of hydrogen overpressure.

The experimental conditions and results are shown in Table 3. Experiment CF-A3 is compared with experiment CF-9.

Figure 11:
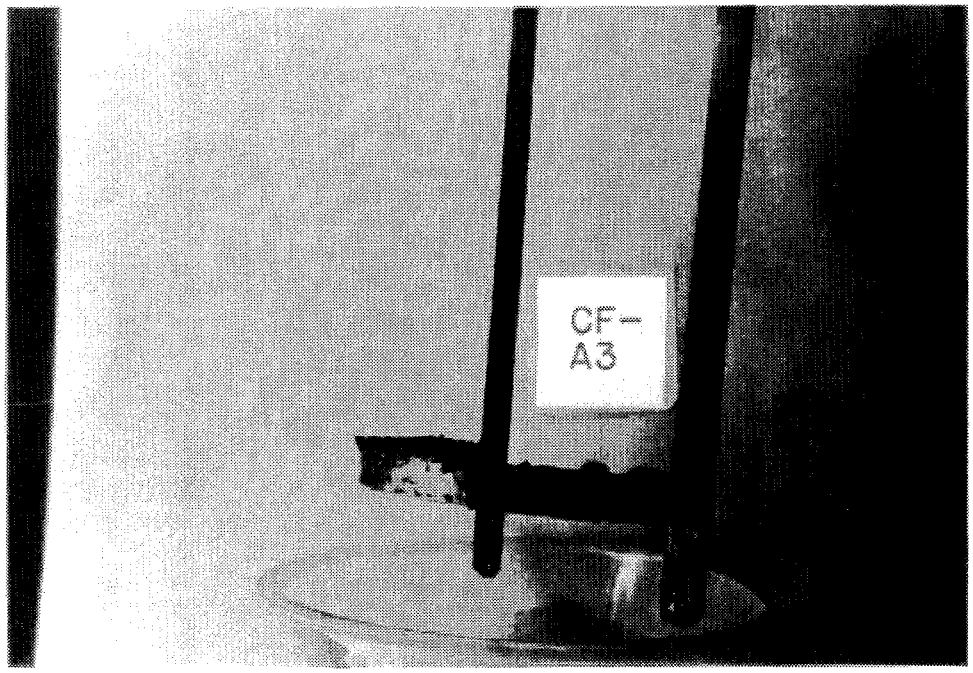
FIG. 11 is a photographic representation of the reactor baffle after run CF-A3 set forth in Example II (Table 3)

FIG. 11 shows coke deposition on the baffles for experiment CF-A3. Compared to Experiment CF-9 (FIG. 8), the coke yield and deposition of experiment CF-A3 was least.

Figure 12:
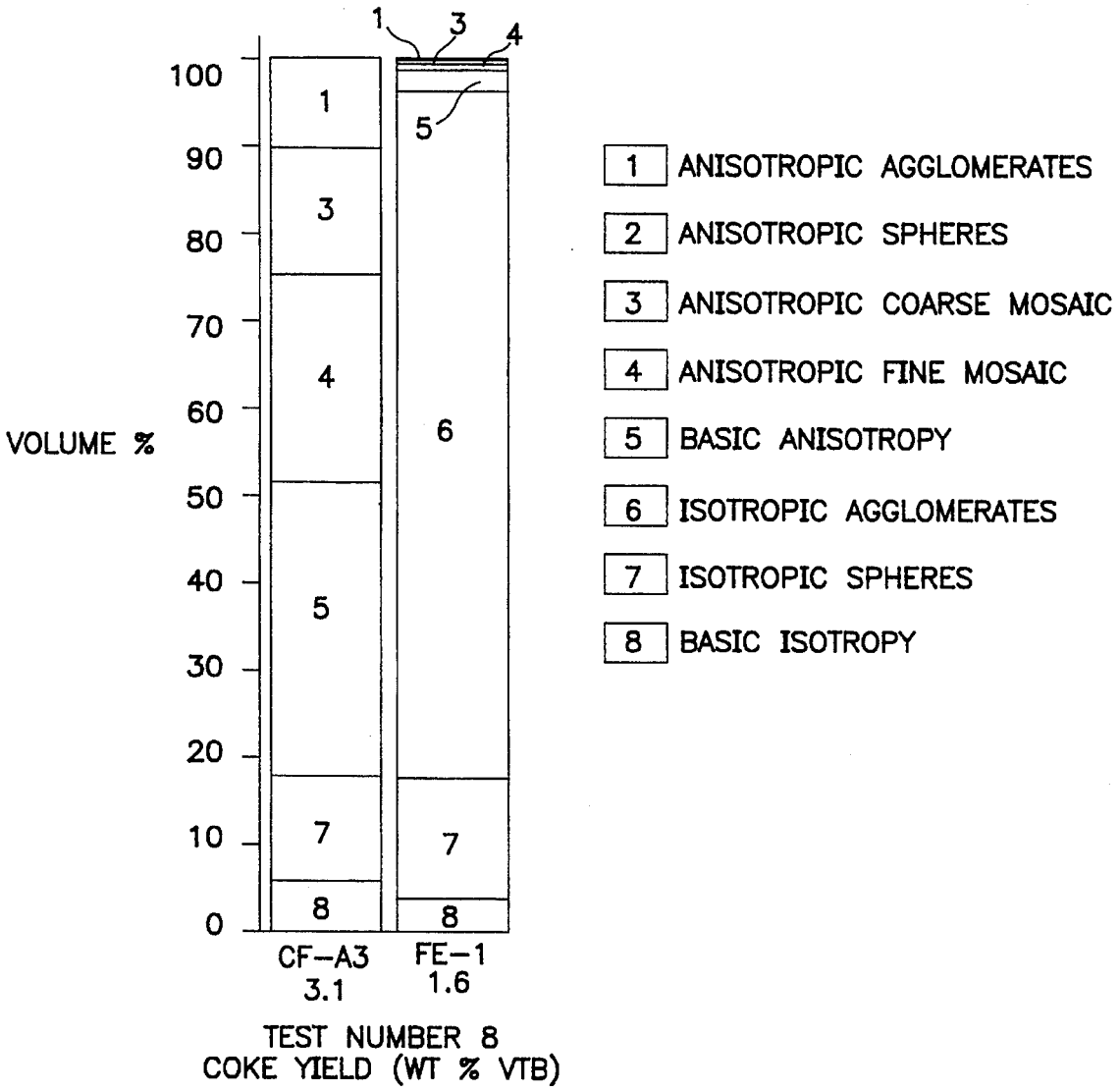
FIG. 12 is a bar chart setting forth coke composition for runs CF-A3 and FE-1 set forth in Example III (Table 4)

FIG. 12 shows results from a microscopic examination of the coke obtained from experiment CF-A3. It is to be compared with those results shown in FIG. 10 for experiment CF-9. The results are similar.

In both experiments, over 80% of the coke components were of the anisotropic type. The agglomerate concentration for experiment CF-A3 was not significantly more than that of experiment CF-9.

This example teaches that abundance of hydrogen alone does not neutralize the adhesiveness of the coke precursors nor does it selectively modify the coke composition.

TABLE 3

| | CF-9 | CF-A3 |
|---|---|---|
| Diluent | A | A |
| Yield (wt. % VTB), corrected for diluent | | |
| $H_2S$ | 0.07 | 2.2 |
| $C_1$–$C_4$ | 10.8 | 11.6 |
| $C_5$–200° C. | 57.1 | 44.0 |
| 200–360° C. | −37.2 | −18.0 |
| 360–504° C. | 26.5 | 30.1 |
| 504° C.$^+$ (coke free) | 33.8 | 27.7 |
| Coke | 7.7 | 3.1 |
| Conversion to 504° C. & coke | 66.2 | 72.3 |
| Mass Balance | 97.3 | 98.5 |
| Selectivity to $C_5$–504° C. | | 77.6 |

Conditions: CF-9:
430° C., 105 min., 800 rpm, 0.55 MPa $N_2$ initial pressure, diluent: VTB ratio 2:1
Conditions: CF-A3
430° C., 105 min., 800 rpm, 6.8 MPa $H_2$ initial pressure diluent: VTB ratio 2:1

EXAMPLE III

This example illustrates that coke containing much agglomerate is not adhesive.

The results and conditions of experiments CF-A3 and FE-1 are shown in Table 4.

Figure 13:
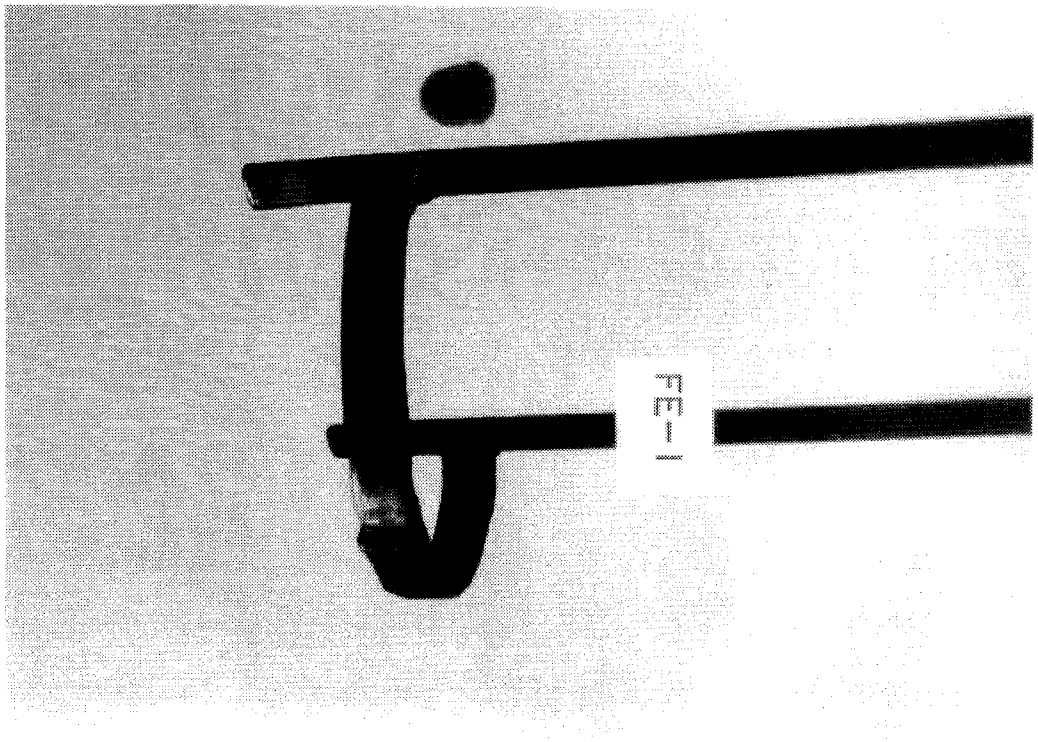
FIG. 13 is a photographic representation of the reactor baffle after run FE-1.

FIG. 13 shows no coke deposited on the baffles for experiment FE-1. Compared to Experiment CF-A3 (FIG. 11), the coke yield and deposition of Experiment FE-1 was least.

The coke from Experiment FE-1 was observed to be minute particles loosely settled in the bottom of the reactor.

TABLE 4

Test conditions: 430° C., 105 min., diluent/vtb — 2:1, 800 rpm

| Experiment No. | CF-A3 | FE-1 |
|---|---|---|
| Diluent | A | A |
| Gas/Pressure (MPa) | $H_2$/6.8 | $H_2$/6.8 |
| Additive (metal, wt. % VTB) | — | Fe/0.5 |
| Yields on VTB, wt. %, corrected for diluent | | |
| $H_2S$ | | 1.2 |
| $C_1$–$C_4$ | 11.6 | 6.6 |
| $C_5$–200° C. | 44.0 | 37.7 |
| 200–360° C. | −18.0 | −9.1 |
| 360–504° C. | 30.1 | 31.2 |
| 504° C.$^+$ (coke free) | 27.7 | 31.4 |
| Coke | 3.1 | 1.6 |

FIG. 12 shows results from a microscopic examination of coke obtained from experiments CF-A3 and FE-1. The results are very different. The coke from experiment FE-1 is over 80% isotropic agglomerate.

Figure 14:
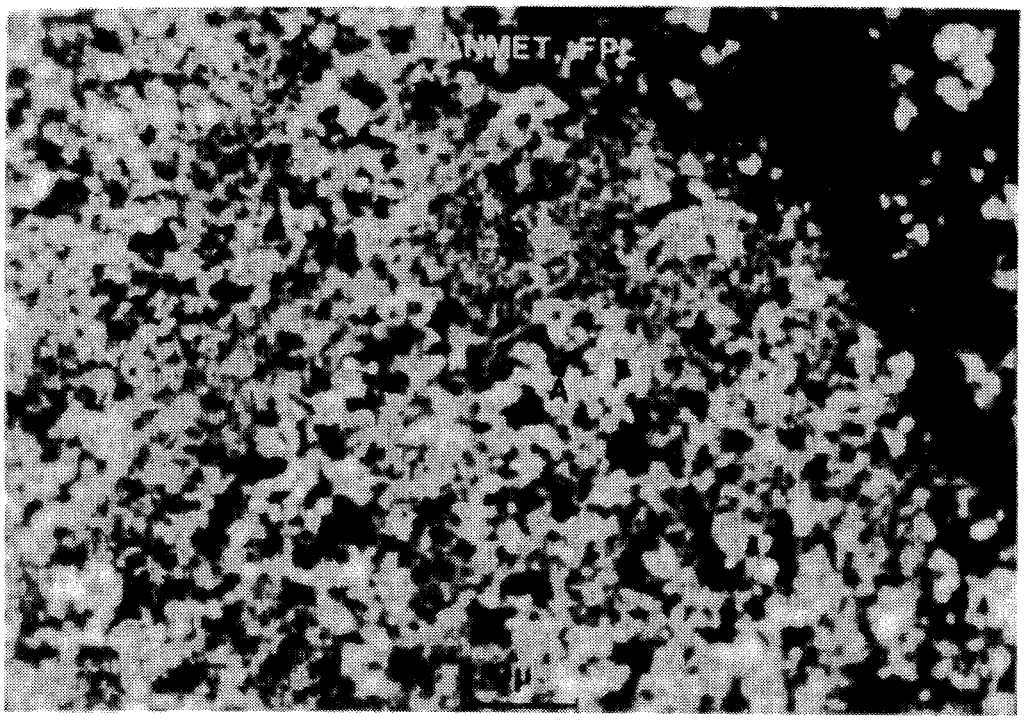
FIG. 14 is a photographic representation of the coke particles from run FE-1, which were mostly isotropic agglomerates (A) associated with iron sulfides. Isotropic spheres (S) were trapped among the agglomerates.
Figure 15:
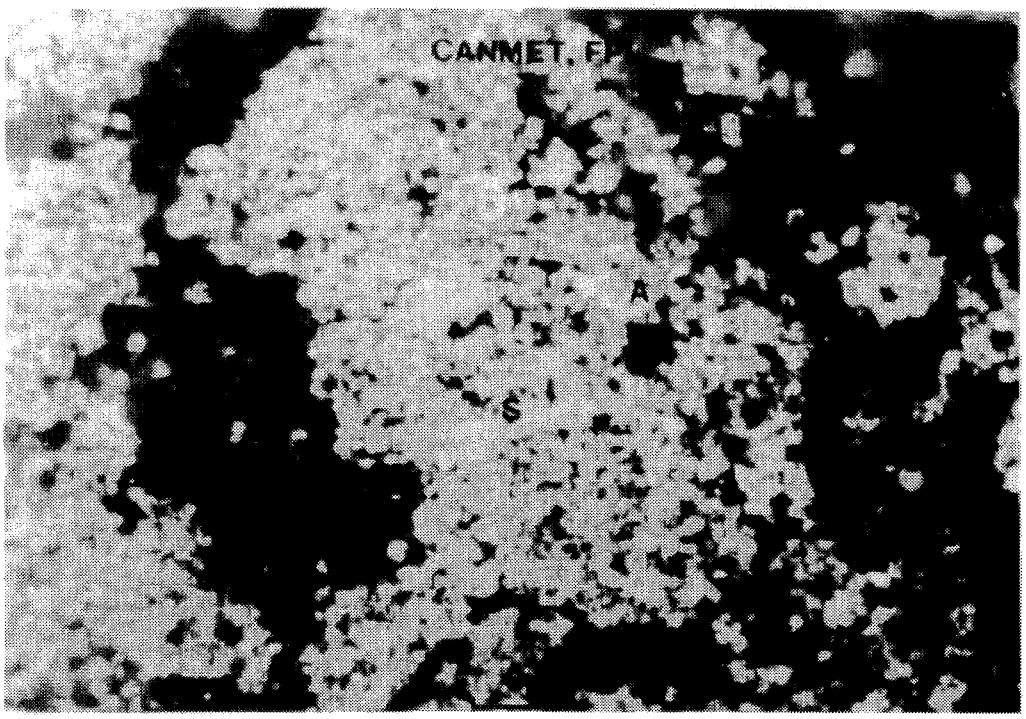
FIG. 15 is a photographic representation of the coke particles from run FE-1 showing isotropic spheres (S) which were effectively prevented from growing into basic isotropic particles by the iron derivative.

FIGS. 14 and 15 for Experiment FE-1 showed that solid particles were all loosely associated with one another. Coke composition showed that over 97% of the components were of the isotropic type—see FIG. 12. Isotropic agglomerates accounted for 80% of the coke composition.

This data for experiment FE-1 indicated that the adhesiveness of the coke precursors was effectively neutralized by the highly dispersed iron compound. Where isotropic spheres were concentrated (see FIG. 15), the isotropic agglomerates effectively prevented the spheres from coalescing into basic isotropic particles.

It is noteworthy also, that additive present as iron sulphide amounts to approximately ⅓ the weight of the coke but is not so evident.

EXAMPLE IV

This example further illustrates that the choice of diluent is desirable.

The experiment CF-38 was done according to the teaching of U.S. Pat. No. 4,455,218 (Dymock et al). The experimental conditions were identical to those shown in Table 4 for experiment FE-1. Whole Athabasca bitumen was used instead of Athabasca VTB and no diluent was added. The whole bitumen contained about 60 wt. % hydrocarbon boiling at temperatures greater than 504° C. 0.5% (metal) of iron pentacarbonyl was added on the basis of equivalent 504° C.$^+$ content in the bitumen.

Figure 16:
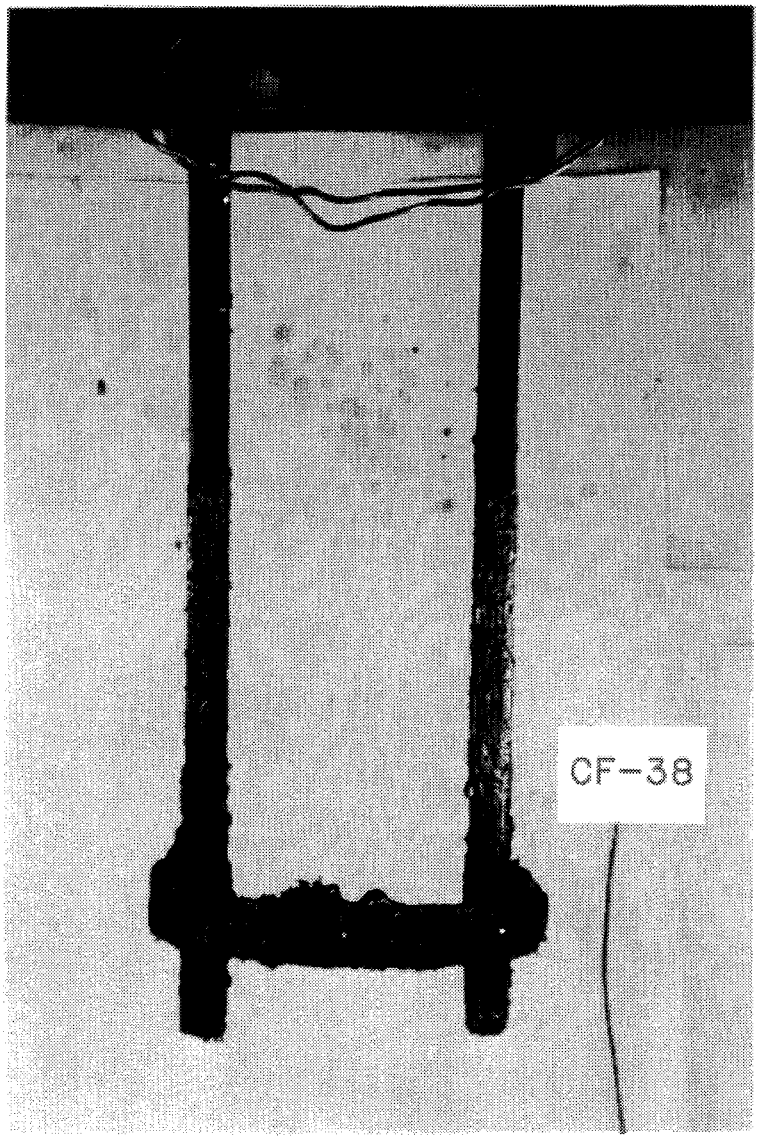
FIG. 16 is a photographic representation of the reactor baffle after run CF-38 set forth in Example IV.

The coke yield was 7.9% (504° C.$^+$ basis) and this coke adhered very strongly to surfaces of the reactor and baffles. FIG. 16 shows the coke deposited on the baffles.

EXAMPLE V

This example illustrates the effect of the rates of continuously removing highly volatile components from the reacting fluids.

The one liter autoclave was fitted with a dip tube for sparging $N_2$ or $H_2$ into the reacting liquid, an outlet permitting continuous flow of product gas, and cold trap condensers to remove volatile products from the gas stream before collecting the latter in a sample bag for analysis. Experiments were conducted in the above described reactor at 430° C. for 105 minutes under 550 kPa pressure both without gas flow and with gas flowing continuously into and out of the reactor. In each experiment, 110 g of Athabasca 504° C.$^+$ vacuum tower bottoms (VTB) and 220 g of a diluent were used. Table 5 presented herebelow gives the reaction conditions and experimental results.

TABLE 5

| | Autoclave Test Results | | | | | |
|---|---|---|---|---|---|---|
| Experiment No. | 1 | 2 | 3 | 4 | 5 | 6 |
| Diluent Type | A | A | B | B | B | B |
| Nitrogen Flow Rate (1/min) | 0.0 | 1.89 | 0.0 | 0.2 | 1.05 | 2.16 |
| Yield (wt. % VTB): | | | | | | |
| $C_1$–$C_4$ | 15.5 | 16.5 | 10.3 | 10.0 | 8.2 | 13.8 |
| $C_5$–504° C. | 42.3 | 38.1 | 56.5 | 56.5 | 56.6 | 51.4 |
| 504° C.$^+$ pitch (coke free) | 34.6 | 38.8 | 26.3 | 27.0 | 30.0 | 29.7 |
| Coke | 7.9 | 3.8 | 4.3 | 3.8 | 3.4 | 3.1 |
| Condensate recovered from purge gas (wt. % VTB) | — | 47.5 | — | 3.1 | 23.9 | 39.7 |

TABLE 6

Simulated Distillation Results of Condensate from Experiment No. 5

| % Off | Temp. °C. |
|---|---|
| IBP | 34 |
| 5 | 57 |
| 10 | 70 |
| 15 | 84 |
| 20 | 94 |
| 25 | 98 |
| 30 | 111 |
| 35 | 116 |
| 40 | 123 |
| 45 | 131 |
| 50 | 139 |
| 55 | 146 |
| 60 | 156 |
| 65 | 164 |
| 70 | 176 |
| 75 | 190 |
| 80 | 201 |
| 85 | 210 |
| 90 | 219 |
| 95 | 229 |
| FBP | 262 |
| — | — |

FIG. 17 shows the amount of coke produced as a function of the rate of flow of nitrogen. As shown for diluents A and B, the amount of coke produced decreased as the rate of flow of nitrogen was increased. At high rates of flow of nitrogen, the amount of coke produced for the experiment using diluent B (the best hydrogen donor solvent) was not very different from that for the experiment using diluent A (the worst hydrogen donor solvent).

It is noteworthy in Table 5, that for those conditions providing the least amount of coke, the amount of condensate recovered from the purge gas was highest. This was true for both diluents A and B.

Table 6 shows results of simulated distillation of the condensate from experiment 5. About 90% of this condensate boils at temperatures less than 220° C.

This example teaches that coke production is reduced if the low boiling products are removed continuously (stripped) from the reacting fluids. Moreover, it teaches that coke production is reduced if the low boiling products are removed from the diluent.

These observations are consistent with the model that has asphaltenes separate as another liquid phase from the reacting fluids. In analogy with the common experiment that has pentane added to bitumen to yield solid asphaltene as a precipitate at room temperature, such an experiment done at high temperature is expected to yield asphaltene as a separate liquid phase. Moreover, it is expected that this separate liquid phase will be rich in the asphaltenes that thermally crack to form coke.

This phase separation is shown schematically in FIG. 18. The three components of this Figure are respectively labelled asphaltenic, aromatic and paraffinic and alicyclic to represent those fractions having boiling points 504° C.$^+$, 220°–504° C. and 220° C., respectively. The arrow indicates the evolution of the composition of whole bitumen as might occur for example IV.

EXAMPLE VI

This example illustrates the effect of using hydrogen for continuously removing highly volatile components from the reacting fluids.

A continuous flow system consisting of a preheater, a 2-liter stirred reactor and a product collection system was used. The baffles and stirrer were similar to those of the previous examples. A mixture of Athabasca VTB, diluent A and preheated hydrogen were pumped through the preheater into the bottom of the stirred reactor. Products were removed though a dip tube with its entrance set at 60% of the reactor's height.

The experimental conditions and results are shown in Table 7 for experiments 7, 8 and 9. In each experiment the hydrogen flow rate was 12 slpm. In experiment 7, the liquid hourly space velocity is twice that of experiment 8 and of experiment 9. The temperature of the reacting fluids is 20° C. higher than that of experiment 8.

Noteworthy is that the amount of coke produced in experiment 8 was less than that of experiment 7 and that almost no coke at all was produced in experiment 9, in spite of the increased severity of hydrocracking from experiment 7 to 8 to 9. Such a result is expected if one considers that the highly volatile fractions of the reacting fluids are removed with increasing efficiency as conditions are changed from experiment 7 to 8 to 9. In experiment 9 the pipe connecting the reactor to the product collection vessel became plugged at the completion of the experiment.

In experiment 10, two one-liter reactors were placed in series with the entrances to the dip tubes adjusted at 50% and 70% of reactor height. The conditions and results are shown in Table 7.

TABLE 7

Continuous Bench Unit Test Results
Diluent Type: A
Pressure: 10 MPa

| Experiment No. | 7 | 8 | 9 | 10 |
|---|---|---|---|---|
| Reactor 1 (1) | 1.2 | 1.2 | 1.2 | 0.5 |
| Reactor 2 (1) | — | — | — | 0.7 |
| Reaction Temperature (°C.) | 440 | 440 | 460 | 440 |
| Liquid Hourly Space Velocity ($hr^{-1}$) | 1 | 0.5 | 0.5 | 1 |
| Hydrogen FLow rate (slpm) | 12 | 12 | 12 | 16 |
| VTB Concentration in feed (wt. %) | 63.10 | 65.02 | 45.53 | 47.3 |
| Conversion (Wt. % VTB to coke and 504° C.) | 69.0 | 78.3 | 98.1 | 79.8 |
| Yield, Wt. % VTB | | | | |
| $C_1$–$C_4$ | 5.2 | 7.9 | 17.3 | 7.2 |
| $C_5$–200° C. | 16.3 | 19.1 | 31.4 | 15.1 |
| 200° C.–360° C. | 23.4 | 31.1 | 43.1 | 24.2 |
| 360° C.–504° C. | 20.3 | 18.4 | 9.3 | 24.8 |
| Coke | 4.6 | 3.1 | 0.1 | 4.6 |
| 504° C.$^+$ Pitch (coke free) | 31.0 | 21.7 | 1.9 | 24.8 |
| Total distillate $C_5$–504° C. | 60.0 | 68.6 | 83.8 | 64.7 |

It is noteworthy that the conversion was similar to that of experiment 8. This was expected given the different liquid hourly space velocities and different number of reactors. However, the amount of coke produced in experiment 10 was higher than that produced in experiment 8 in spite of the higher rate of flow of hydrogen of experiment 10.

This example teaches that hydrogen flow and reactor temperature may be used skilfully to remove (strip) low boiling products from the reacting fluids to reduce the amount of coke that is produced. Moreover it teaches that for one or more hydrocracking reactors in series, a configuration having one reactor only produces the least amount of coke. Moreover, it teaches that if several hydrocracking reactors are placed in series, then least coke is produced if volatile hydrocarbons are removed from the fluids as they pass from one reactor to the next.

EXAMPLE VII

This example illustrates that by skilful use of reactor configuration, severity of reaction, stripping of volatile components and additive, high conversions of VTB to distillate products can be obtained with acceptable production of coke and minimal fouling of the reactor.

The continuous flow system of experiments 7, 8 and 9 of Example VI was used. The additive was iron pentacarbonyl The conditions and results of experiments 11 and 12 are shown in Table 8.

The conditions for experiment 12 were much more severe than those of experiment 11. Nevertheless, all surfaces in the reactor, pipes and collection vessel remained free of fouling by coke and the coke that was produced was a fine friable matter that settled in the product collection vessel.

The results of a microscopic examination of the coke produced in experiment 12 are shown in Table 9. 74% of the coke was in the form of agglomerates. 23% of the coke was in the form of isotropic spheres but these spheres were isolated and trapped in a matrix of agglomerates.

This example teaches that high conversions with minimal fouling of the reactor may be obtained when the coke that is produced is mostly agglomerates.

TABLE 8

| Experiment No. | 11 | 12 |
|---|---|---|
| Reactor 1 (1) | 1.2 | 1.2 |
| Reactor 2 (1) | — | — |
| Reaction Temperature (°C.) | 450 | 450 |
| Liquid Hourly Space Velocity ($hr_{-1}$) | 1.05 | 0.73 |
| Hydrogen Flow rate (slpm) | 8 | 12 |
| VTB Concentration in Feed (wt. %) | 47.5 | 47.8 |
| Catalyst (wt. % of Fe based on VTB) | 0.5 | 0.5 |
| Conversion (wt. % VTB to coke and 504° C.) | 67.8 | 82.1 |
| Yield (wt. % VTB) | | |
| $C_1$–$C_4$ | 19.1 | 22.9 |
| 200–350° C. | 19.9 | 27.6 |
| 350–504° C. | 21.9 | 21.1 |
| Coke | 2.4 | 2.8 |
| 504° C.$^+$ Pitch Coke Free | 32.2 | 17.9 |
| Total distillate $C_5$–504° C. | 60.9 | 71.6 |

Note that if $H_2$ flow was not increased in experiment 12, one would expect that a 14% increase in conversion should be accompanied by much higher coke yield than the amount recorded.

TABLE 9

| Coke Composition of Run No. 12 | Vol % |
|---|---|
| Basic Isotropy | 3 |
| Isotropic Spheres | 23 |
| Isotropic Agglomerates | 42 |
| Basic Anisotropy | 0 |
| Anisotropic Fine-Mosaic | 0 |
| Anisotropic Coarse-Mosaic | 0 |
| Anisotropic Spheres | 0 |
| Anisotropic Agglomerates | 32 |

EXAMPLE VIII

This example also compares various additives and various metal compounds.

A series of tests using the following additives:

fine, Alberta coal char, oil soluble nickel naphthanate, oil soluble cobalt naphthanate, and oil soluble molybdenum naphthanate were carried out to compare their relative effectiveness in preventing coke formation and deposition. Iron pentacarbonyl was used as the bench mark for comparison.

All tests were performed under common reaction conditions:

0.5 wt. % (metal on vacuum tower bottoms) additive, Athabasca vacuum tower bottoms (33.3%), diluent (66.7%), 6.8 MPa initial hydrogen pressure, 800 rpm stirrer speed, 430° C., and 105 minutes reaction time.

In the case of Alberta coal char, the amount added was equivalent to 4% of the vacuum tower bottoms.

Figure 19:
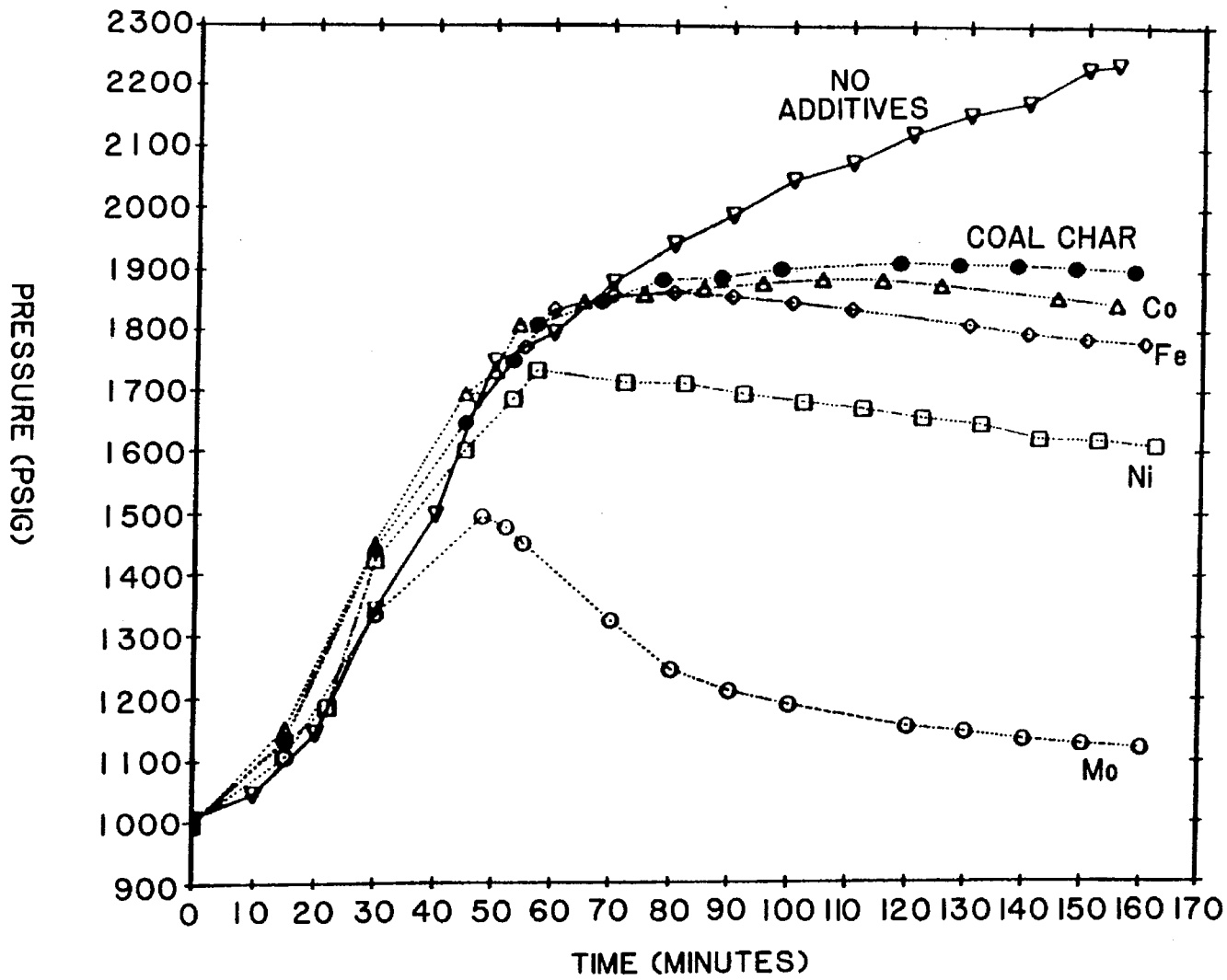
FIG. 19 is a plot showing pressure profiles for runs involving different additives set forth in Example VIII.
Figure 20:
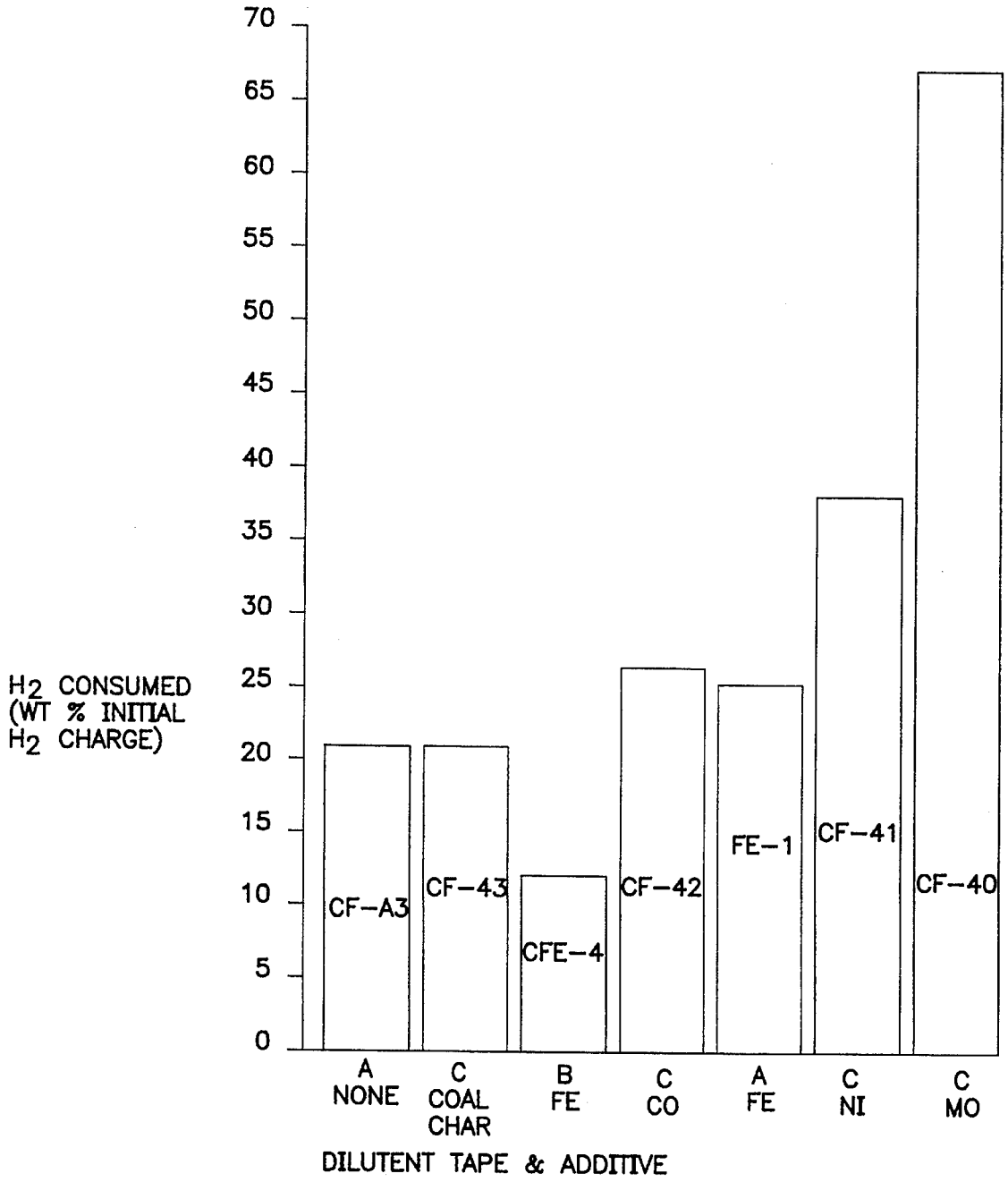
FIG. 20 is a bar plot showing hydrogen consumed for various runs set forth in Example VIII.

Pressure profiles presented in FIG. 19 and the hydrogen consumption results presented in FIG. 20, showed the following observed order for hydrogen consumption:

molybdenum additive (CF-40) 68% nickel additive (CF-41) 39% cobalt additive (CF-41) 27% iron additive (FE-1) 26% and coal char (CF-43) 21%.

Product distributions presented in Table 10 showed the following order of additive for:

vacuum tower bottoms conversion molybdenum>iron>coal>nickel>cobalt selectivity to $C_5$–504° C. nickel>iron>cobalt>molybdenum>coal char coke formation nickel<cobalt<coal char<iron<molybdenum.

Figure 21:
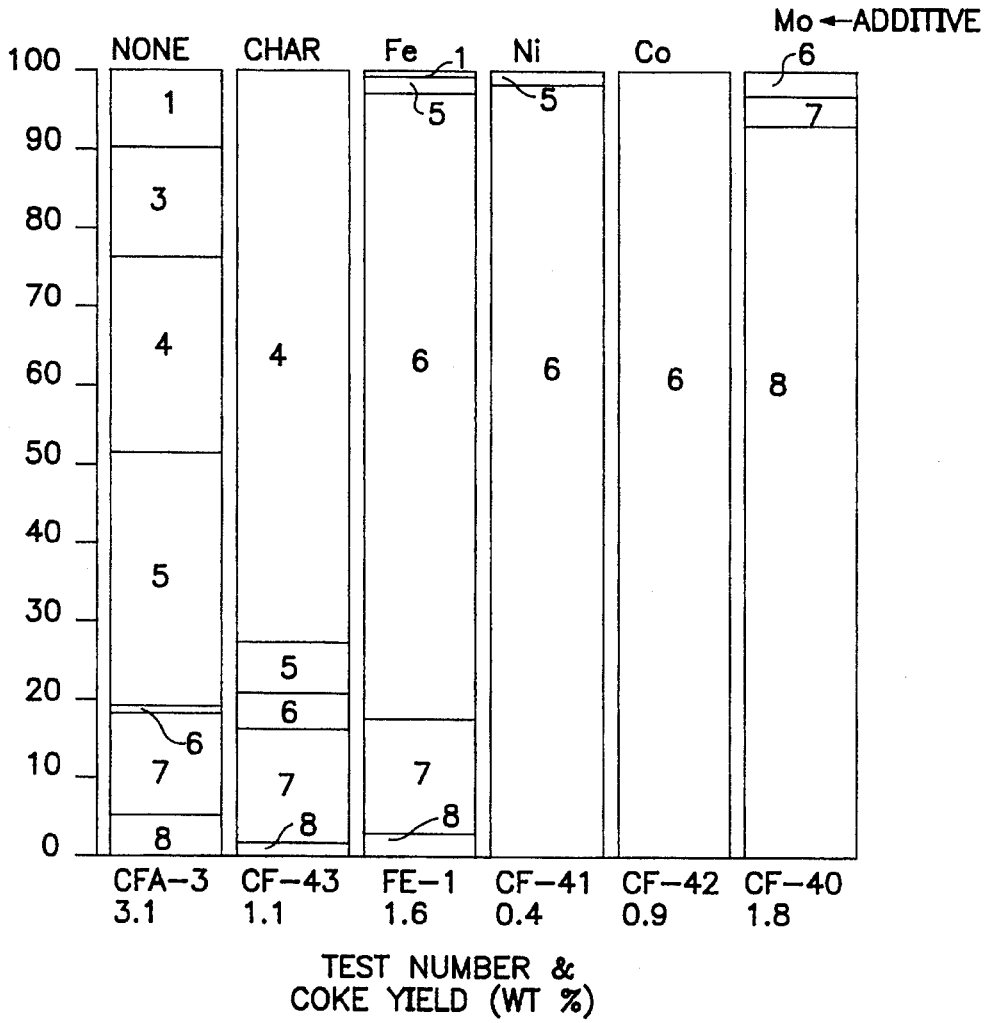
FIG. 21 is a bar chart setting forth coke composition for a number of the runs set forth in Example VIII.
Figure 22:
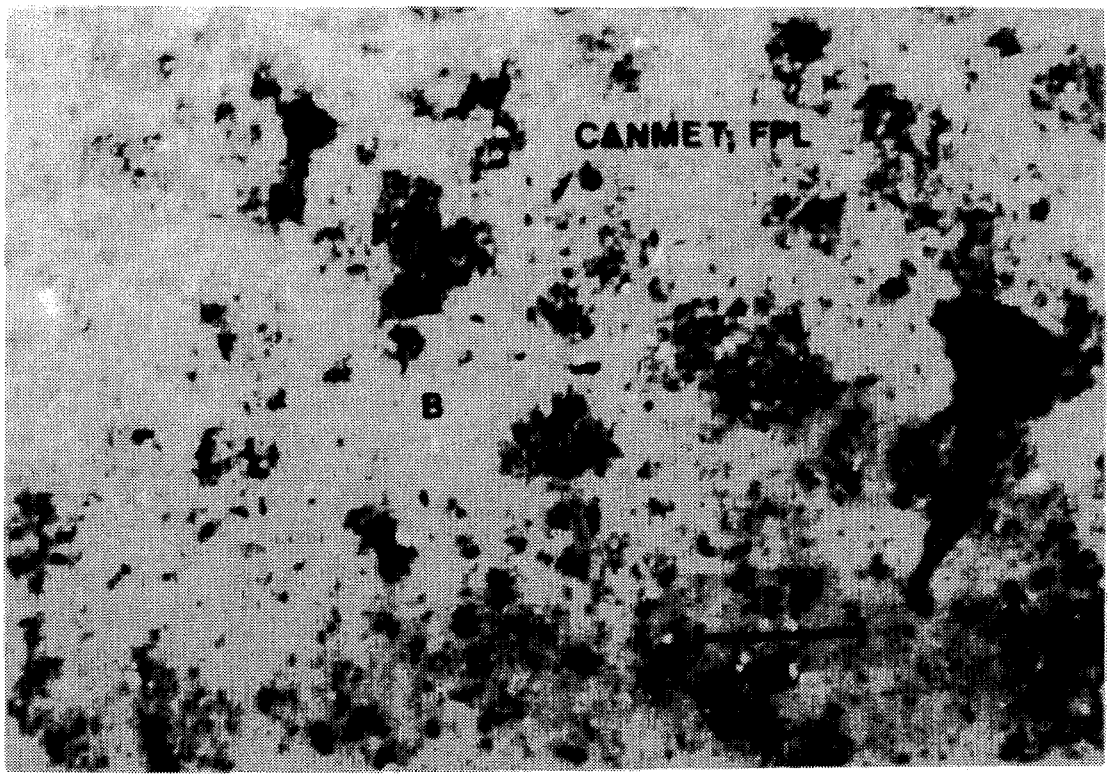
FIG. 22 is a photographic representation of coke from run CF-40, showing mostly a continuous sheet of basic isotropic particles (B), magnified 1850×—see Example VIII.

FIG. 21 shows the effectiveness of the various additives in converting the coke precursors to form the non-depositing isotropic agglomerate coke particles. Although experiments using additives containing molybdenum consumed the highest amount of hydrogen, over 90% of the coke was basic isotropic particles. In FIG. 22, coke from CF-40 appeared as a continuous sheet of basic isotropic particles. The coke from CF-40 was evidently more densely packed than the coke from FE-1 using the iron additive (FIGS. 14–15).

Figure 23A:
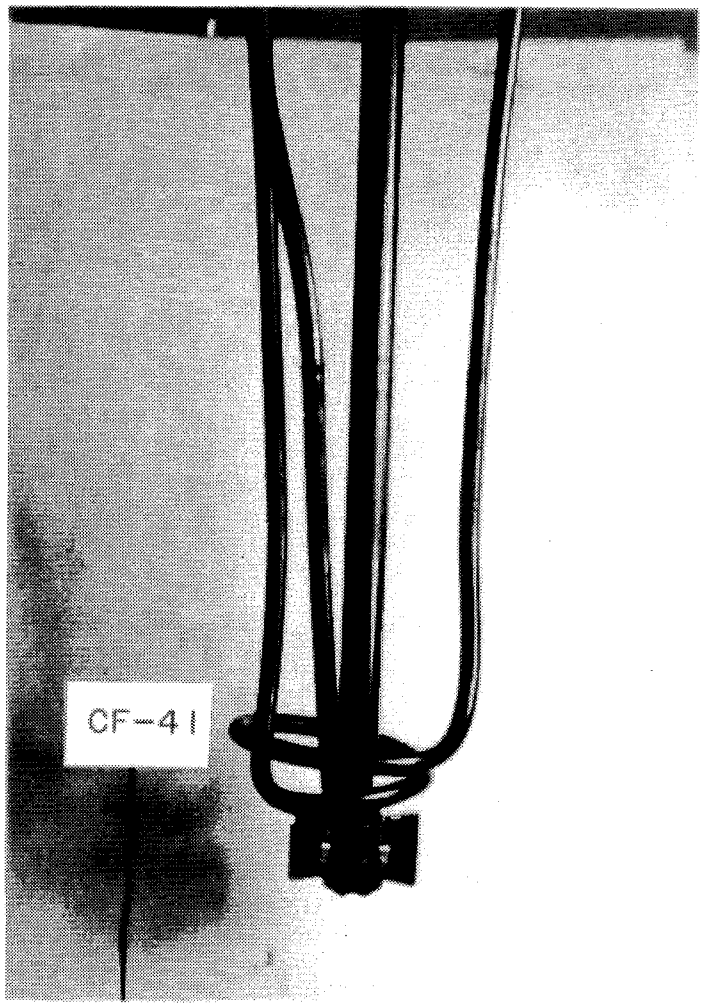
FIG. 23 is a photographic representation of the reactor baffle after run CF-40.
Figure 23:
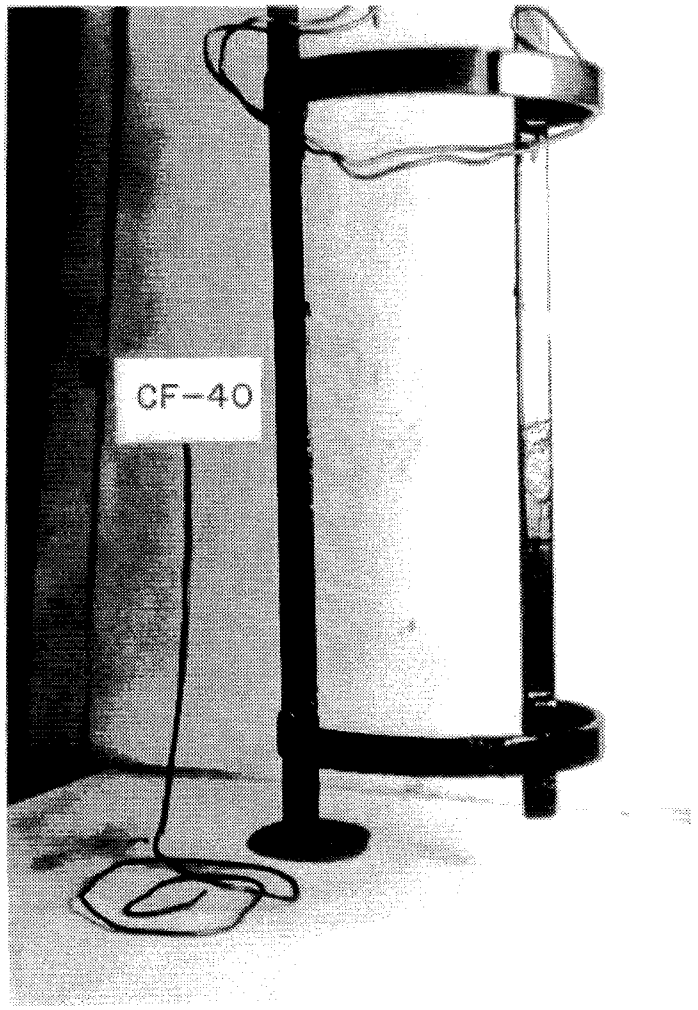

As pointed out earlier, it was discovered that, to prevent the coke from depositing on the reactor walls, the additive must selectively transform the coke precursor spheres into isotropic agglomerates. The lack of isotropic agglomerates in coke from experiment CF-40 suggested an explanation for the deposition of adherent coke on the reactor baffles (FIG. 23). In contrast, the reactor baffles in experiments with iron pentacarbonyl (FIG. 13) did not have any adherent coke.

This example teaches that appropriate selection of additive may inhibit coke production and may inhibit deposition of adherent coke when an appropriate diluent is used. Such an additive will maximize the fraction of coke that is in the form, isotropic agglomerate. Oil soluble additives containing iron or cobalt or nickel or combinations of these are preferred.

TABLE 10

Test Conditions:
430° C., 6.8 MPa $H_2$ initial pressure, 105 min, 800 rpm
additive added = metal concentration of 0.5 wt. % VTB
Diluent/VTB = 2:1

| Experiment No. | CF-A3 | CF-43 | FE-1 |
|---|---|---|---|
| Additive | — | Coal char (4%) | Fe |
| Diluent type | A | C | A |
| $H_2$ consumed (wt. % initial $H_2$) | 21 | 21 | 26 |
| Yield, wt. % vacuum tower bottom | | | |
| $H_2S$ | 2.2 | 2.3 | 1.2 |
| $C_1$–$C_4$ | 11.6 | 9.8 | 6.6 |
| $C_5$–200° C. | 44.0 | 36.6 | 37.7 |
| 200–360° C. | −18.0 | −7.7 | −9.1 |
| 360–504° C. | 30.1 | 24.4 | 31.2 |
| 504° C.$^+$ (coke free) | 27.7 | 33.0 | 31.4 |
| Coke | 3.1 | 1.1 | 1.6 |
| Conversion to 504° C. & coke | 72.3 | 66.2 | 68.6 |
| Selectivity to $C_5$–504° C. | 77.6 | 80.5 | 87.0 |
| Mass Balance | 98.5 | 99.0 | 98.1 |
| **Experiment No.** | **CF-41** | **CF-42** | **CF-40** |
| Additive | Ni | Co | Mo |
| Diluent type | C | C | C |
| $H_2$ consumed (wt. % initial $H_2$) | 39 | 27 | 68 |

TABLE 10-continued

| Test Conditions: 430° C., 6.8 MPa $H_2$ initial pressure, 105 min, 800 rpm additive added = metal concentration of 0.5 wt. % VTB Diluent/VTB = 2:1 | | | |
|---|---|---|---|
| Yield, wt. % vacuum tower bottom | | | |
| $H_2S$ | 2.0 | 1.9 | 3.3 |
| $C_1$–$C_4$ | 6.1 | 8.0 | 8.5 |
| $C_5$–200° C. | 34.6 | 36.4 | 42.4 |
| 200–360° C. | −2.3 | −8.9 | −11.8 |
| 360–504° C. | 24.9 | 27.3 | 29.6 |
| 504° C.$^+$ (coke free) | 34.8 | 35.3 | 28.2 |
| Coke | 0.4 | 0.9 | 1.8 |
| Conversion to 504° C. & coke | 65.6 | 64.7 | 71.8 |
| Selectivity to $C_5$–504° C. | 87.2 | 84.7 | 83.8 |
| Mass Balance | 99.6 | 99.5 | 98.9 |

EXAMPLES IX–XII

These examples as a group support the assertions that:

1. Additive dispersion needs to be accomplished at less than decomposition temperature and requires prolonged mixing at moderate elevated temperature to achieve uniform dispersion of the additive through the asphaltenes;
2. Digestion leading to additive decomposition needs to be accomplished under mixing conditions; and
3. The combination of the described additive selection, preferred use of solvent, dispersion and digestion steps, and stripping and mixing during hydrocracking, come together to create colloidal catalyst particles which enable high 525° C.$^+$ conversion associated with little adhesive coke formation.

Stated otherwise, if the additive is not well distributed at the molecular scale before significant decomposition occurs, then there is a likelihood that relatively large, non-colloidal, micron or larger sized catalyst particles will be produced, accompanied by adherent coke formation and low conversion. In the same vein, if decomposition of the additive takes place without mixing to maintain dispersion, again non-colloidal catalyst can be produced and coke formation and low conversion follow.

EXAMPLE IX

This example (relating to runs TRU 101 and B 3-1) shows the desirability of properly dispersing the additive by mixing it for a prolonged period at an elevated temperature that is well below the decomposition temperature of the additive; otherwise, when the mixture is subsequently rapidly heated to hydrocracking temperature, severe fouling will occur in the heater or at the reactor inlet and cause plugging, which is characterized by pressure surges in the circuit.

Figure 25:
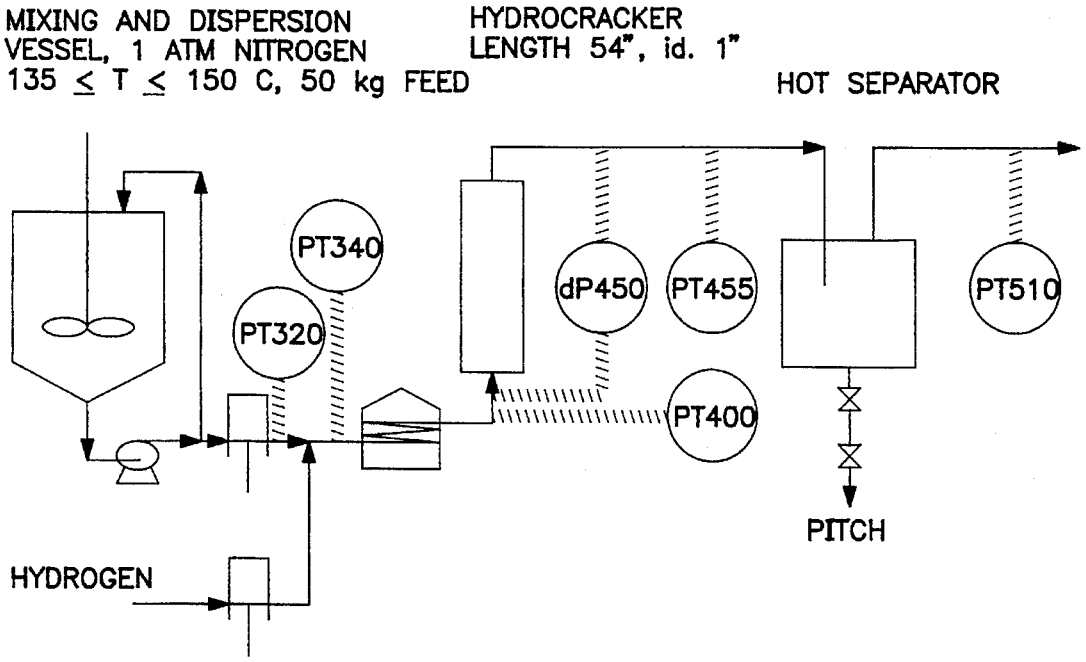
FIG. 25 is a simplified schematic of a pilot circuit used to carry out the experimental runs reported on in Example IX, with conditions shown therein; note that the feed and catalyst precursor (molybdenum ethyl hexanoate solution) were mixed and circulated at a temperature, $135° \leqq T \leqq 150°$ C., for more than 24 hours before the start of any test.
Figure 26:
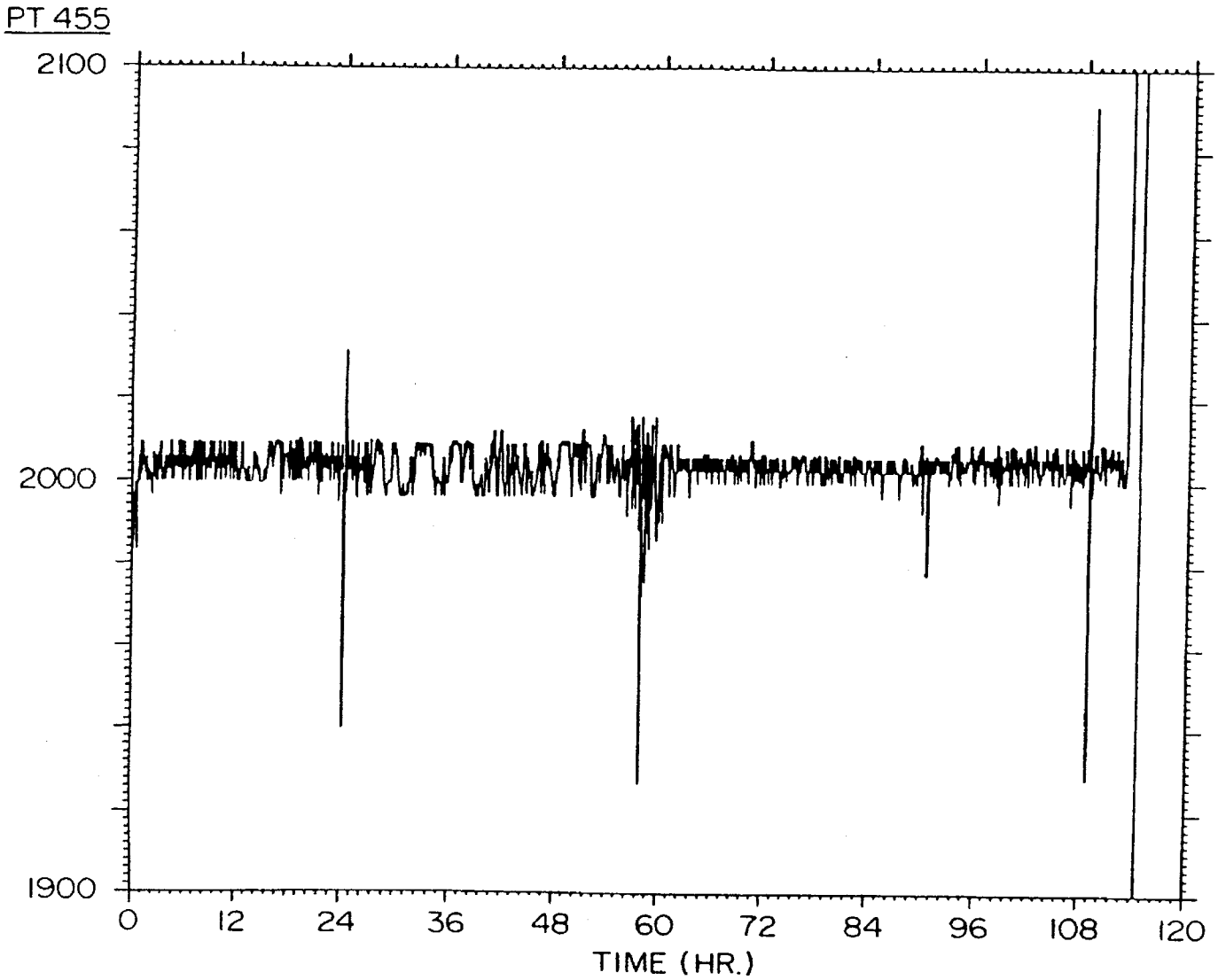
FIG. 26 is a plot of pressure recorded between the reactor and separator during run TRU 101 reported on in Example IX.
Figure 27:
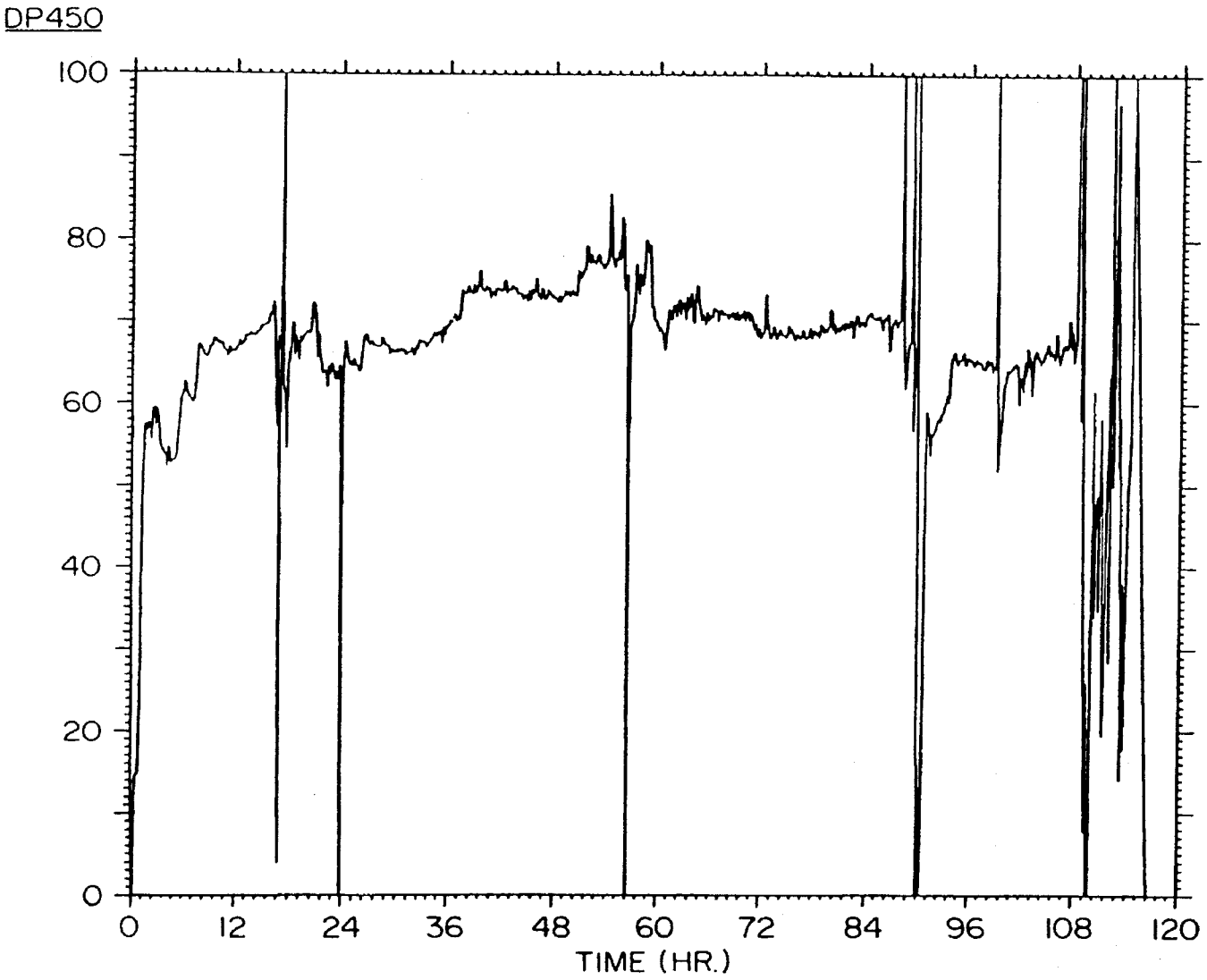
FIG. 27 is a plot of pressure differentials taken across the reactor during run TRU 101 reported on in Example IX.
Figure 28:
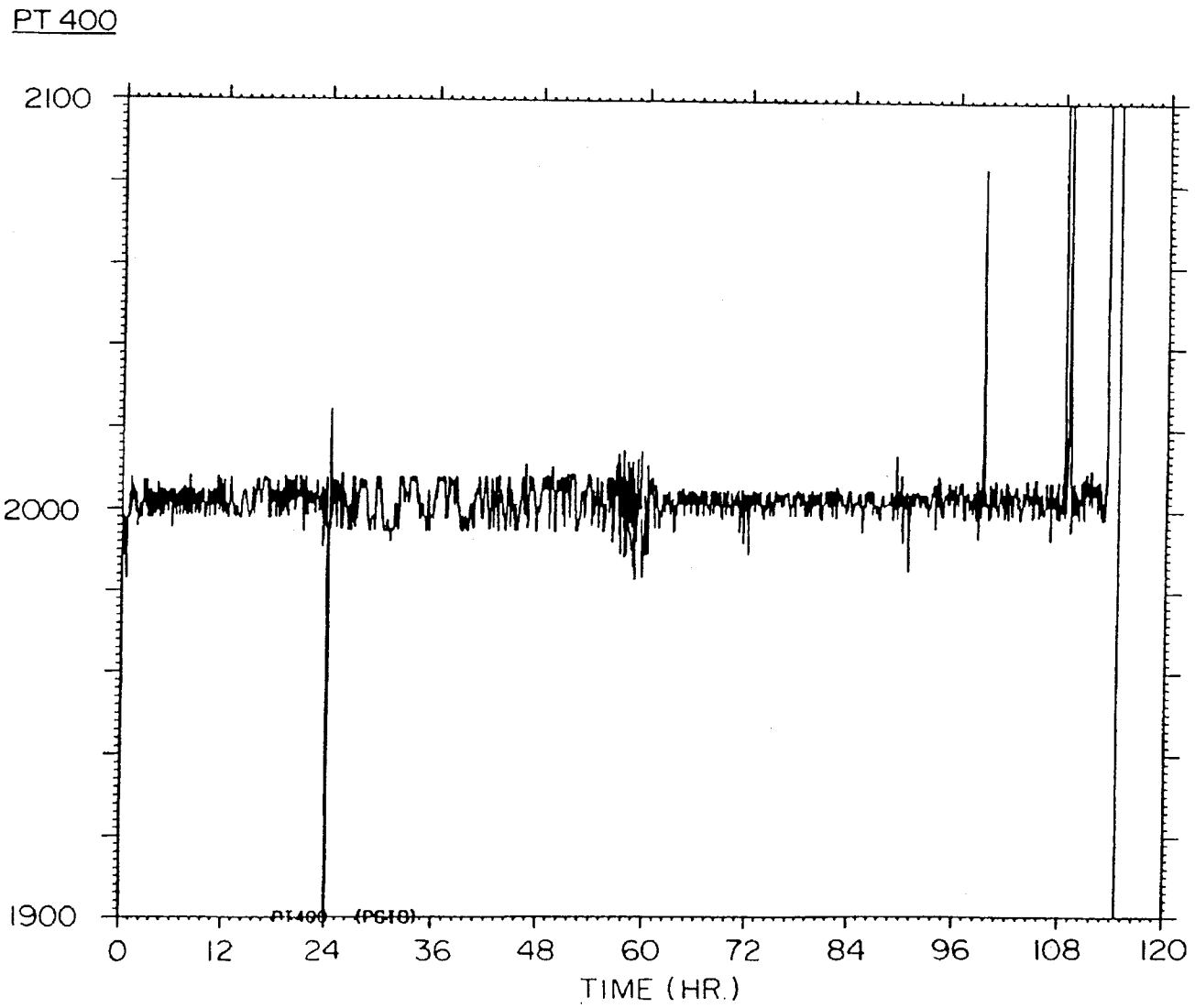
FIG. 28 is a plot of pressures recorded at the entrance to the reactor during run TRU 101 of Example IX.

FIG. 25 shows the circuit used for these tests. FIGS. 26–28 show the pressure logs taken during run TRU 101 at points indicated on FIG. 25.

A mixing and dispersion vessel ("mixer") was provided with a pump and return line, so that the feed could be circulated and mixed. Hydrogen from a source was added to the line taking the product from the mixer. The mixture passed through a heater to raise its temperature to hydrocracking temperature. The heater product was then introduced into a hydrocracking reactor. The reactor product was passed through a hot separator to produce pitch.

Following were the conditions relating to the first run (TRU 101):

(a) Feedstock: Cold Lake crude vacuum bottoms (430° C.) containing 70% by wt. 525° C.$^+$ residuum and 300 ppm wt. molybdenum as molybdenum ethyl hexanoate;

(b) Dispersion: 24 hours at 135° C., later raised to 150° C., with mixing and circulation;

(c) Hydrogen flow: 14,000 SCF/barrel;

(d) Reactor conditions:
pressure—13.6 MPa
temperature—455° C.

The mixer was initially operated at 135° C. for 17.1 hours from start. The mixer temperature was then raised to 150° C. (which was less than the decomposition temperature of the additive). After 25.9 hours from start, a first pressure pulse was observed at PT455, suggesting that minor plugging occurred downstream at the entrance to the hot separator. After 85.3 hours from start, a pressure pulse to 16.3 MPa was observed at PT 320, suggesting that minor plugging occurred between PT 320 and PT 340. As the plug freed itself, pressure pulses were observed at DP 450, suggesting that the plug was being pushed through the reactor and downstream to the hot separator. After 99 hours from start, the pressure at PT 400 pulsed to 15.2 MPa, suggesting that a plug had formed at the inlet to the reactor. After 108.9 hours from start, the pressure at PT 400 and upstream jumped to 21.6 MPa because a strong plug had formed at the reactor inlet.

These results bring up the following observations:

That plugging was not a problem when dispersion was conducted at 135° C.—but it did become a problem at 150° C.; and That decomposition of the additive was taking place in and adjacent to the heater under non-mixing conditions. This led to the formation of large iron particles that plugged the piping.

The same circuit was later used for run B 3-1. Following were the conditions relating to this run:

(a) Feedstock: Cold Lake crude vacuum bottoms containing 100 ppm wt. molybdenum as molybdenum ethyl hexanoate dispersed in 200°–360° C. gas-oil;

(b) Dispersion: 24 hours at about 105° C. with mixing and circulation;

(c) Hydrogen flow: 14,000 scf/barrel;

(d) Reactor conditions:
pressure—13.6 MPa
temperature—450° C.

The B 3-1 run was continued for 225 hours. It involved the following changes relative to run TRU 101:

the dispersion temperature was lower;

the concentration of additive was considerably reduced; and the reactor temperature was slightly lower.

Figure 29:
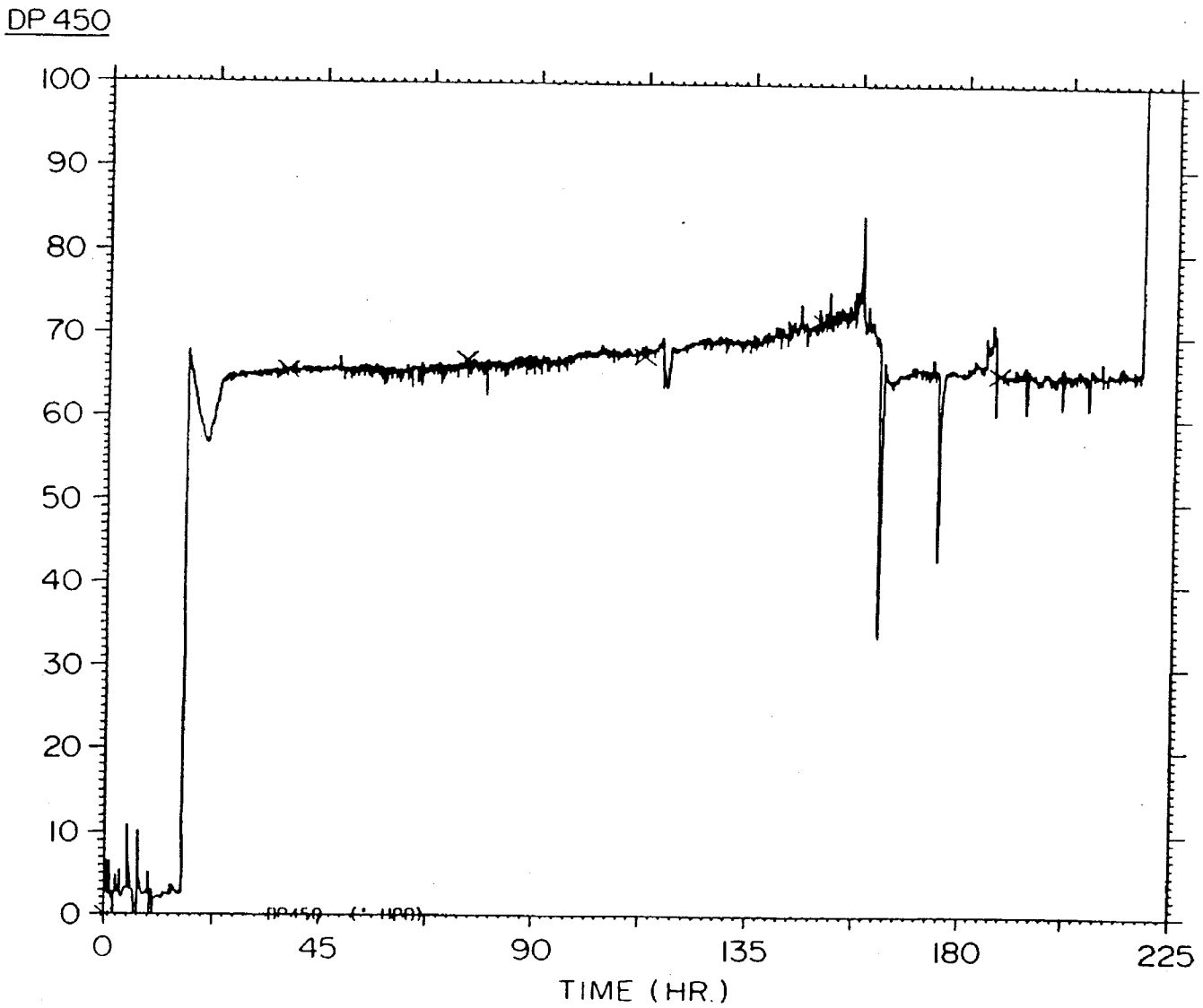
FIG. 29 is a plot of pressure differentials taken across the reactor during run B3-1 of Example IX.
Figure 30:
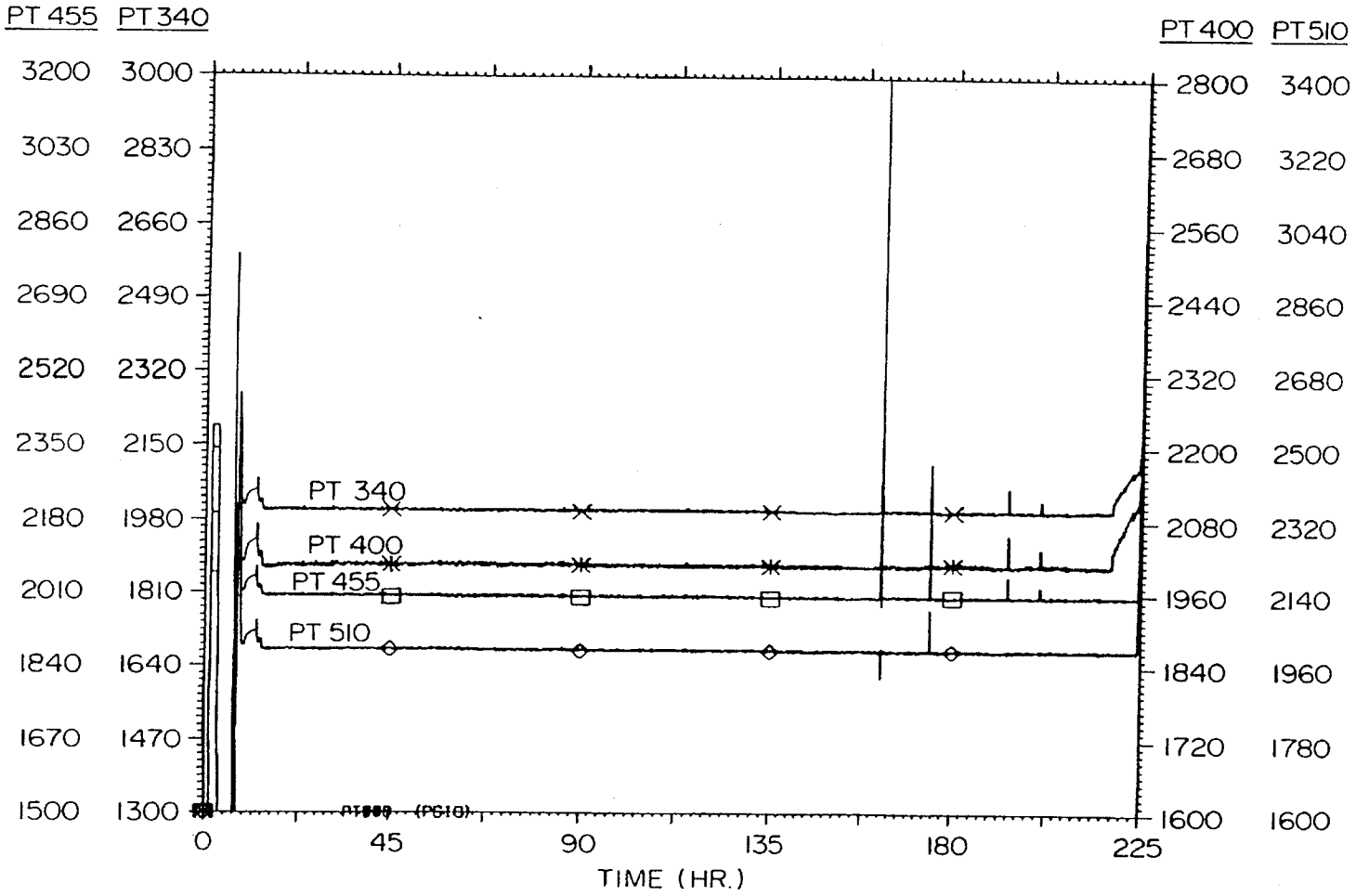
FIG. 30 is a plot of various pressures taken at different points along the circuit during run B3-1 of Example IX.

The pressure logs from run B 3-1 are shown in FIGS. 29–30.

Smooth, plug-free operation was observed, substantially throughout the test. After about 160 hours the pressure upstream of the separator pulsed briefly to about 19.0 MPa as a plug formed and then broke down. Plugging and fouling of unit surfaces were significantly less severe in run B 3-1 than in run TRU 101.

The runs indicate the desirability of dispersing at a temperature that is significantly less than the decomposition temperature and then heating rapidly to hydrocracking temperature.

EXAMPLE X

This example shows that if the additive is provided in high concentration in oil and if dispersion is practised at a high temperature that exceeds decomposition temperature, then poor results follow.

Figure 31:
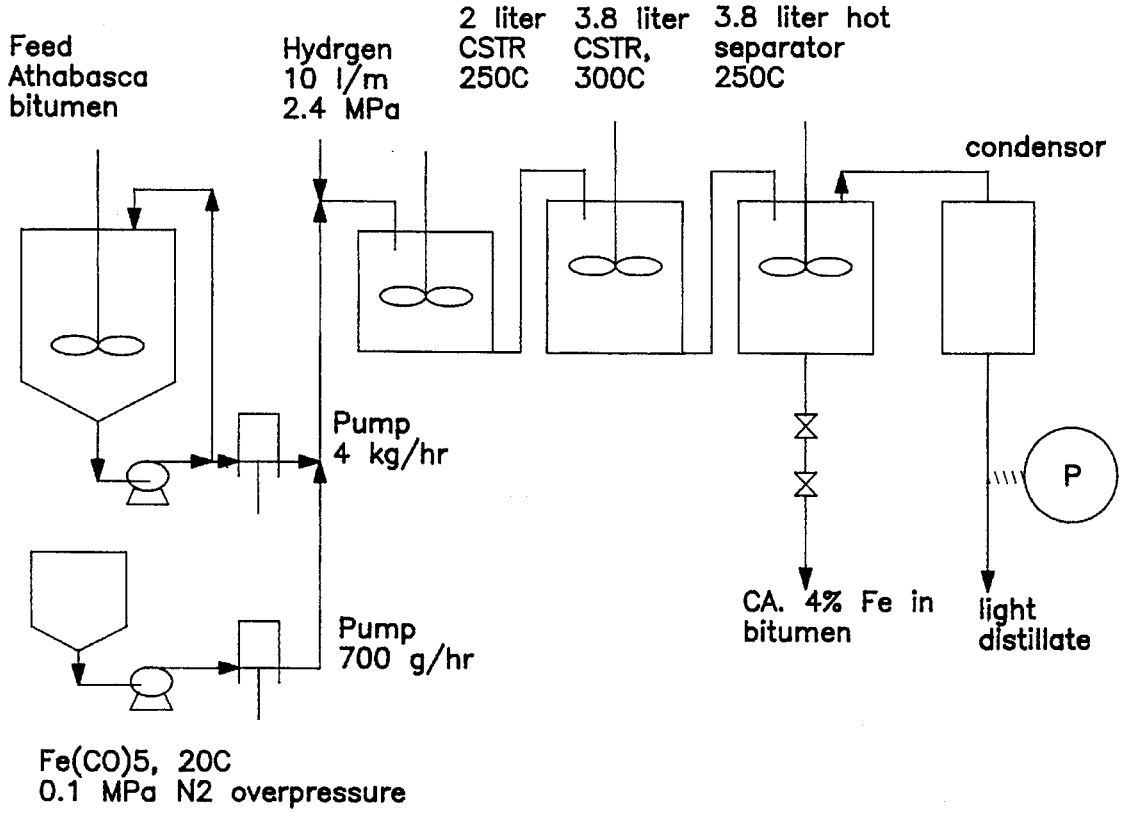
FIGS. 31 and 32 are simplified schematics of the segments of the pilot circuit used to carry out the experimental runs reported on in Example X, with conditions shown thereon.
Figure 32:
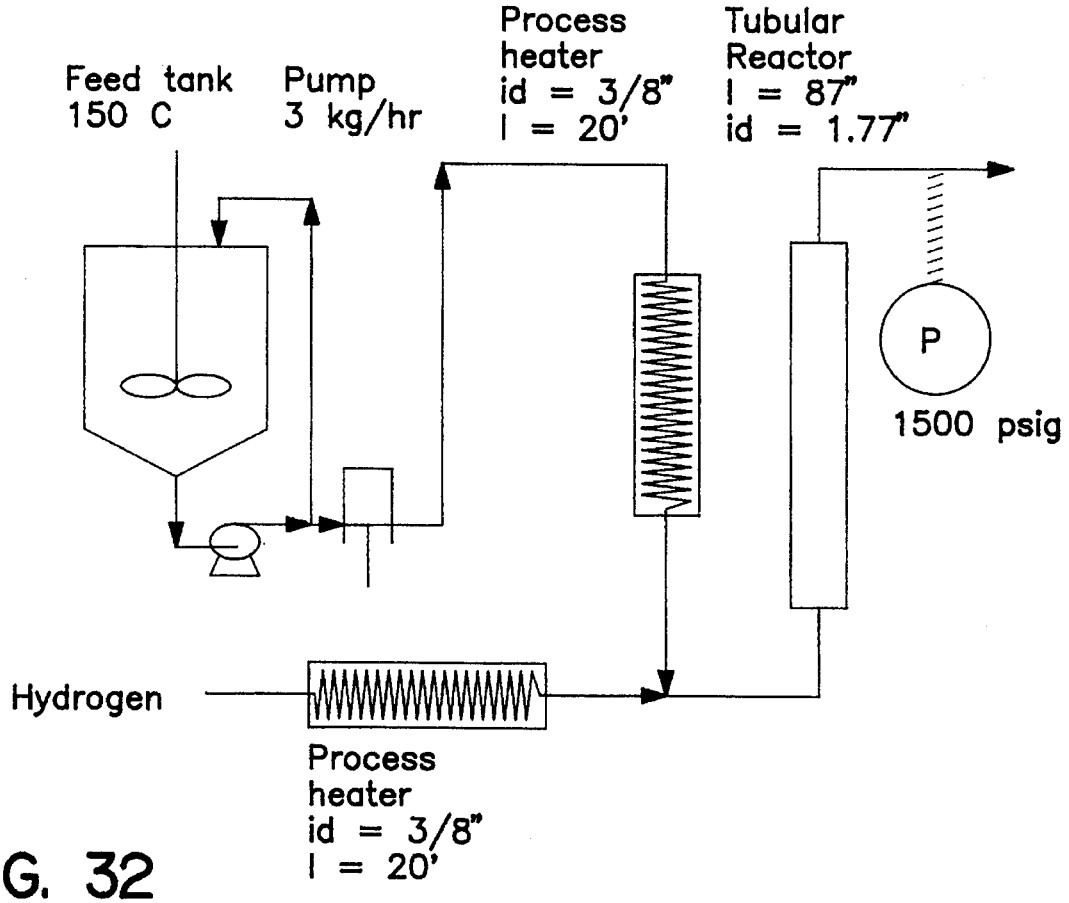

In this test, dispersion and decomposition were carried out in one step at a first site and the mixture product moved to another site for hydrocracking. A concentrate (4% Fe by wt.) was formed at the first site, to facilitate transportation. The two circuits used are shown in FIGS. 31 and 32.

The conditions of the runs are shown in conjunction with the Figures.

The results of making several runs with this system were as follows:

TABLE 11

| | MB 1–4 | MB 5–8,10 | MB 11–14 | MB 15–18 |
|---|---|---|---|---|
| CONDITIONS | | | | |
| feed rate, kg/hr | 3.420 | 3.272 | 2.966 | 3.121 |
| LHSV | 0.97 | 0.93 | 0.85 | 0.89 |
| reactor temperature, °C. | 439 | 439 | 451 | 450 |
| $H_2$ treat gas rate, l/min | 40 | 40 | 40 | 60 |
| additive concentration, wt % Fe on 524° C.$^+$ residuum | 0.49 | 0.16 | 0.095 | 0.12 |
| RESULTS | | | | |
| 525° C.$^+$ pitch conversion, volume % | 57.2 | 58.1 | 68.4 | 67.7 |
| CCR removal, wt % | 24.9 | 27.4 | 31.7 | 33.7 |
| desulfurization, wt % | 20.9 | 28.7 | 37.3 | 35.1 |

Electron microscope analysis of solids from the produced pitch indicated FeSx particles typically having a diameter of 5 μm.

The pitch conversion (57 to 68%) was relatively poor and coke was produced in the reactor circuit.

EXAMPLE XI

This example is additive to Example X and shows that if a bitumen/additive is only digested at decomposition temperature, without preliminary low temperature mixing, then poor results follow even if digestion involves mixing.

Figure 33:
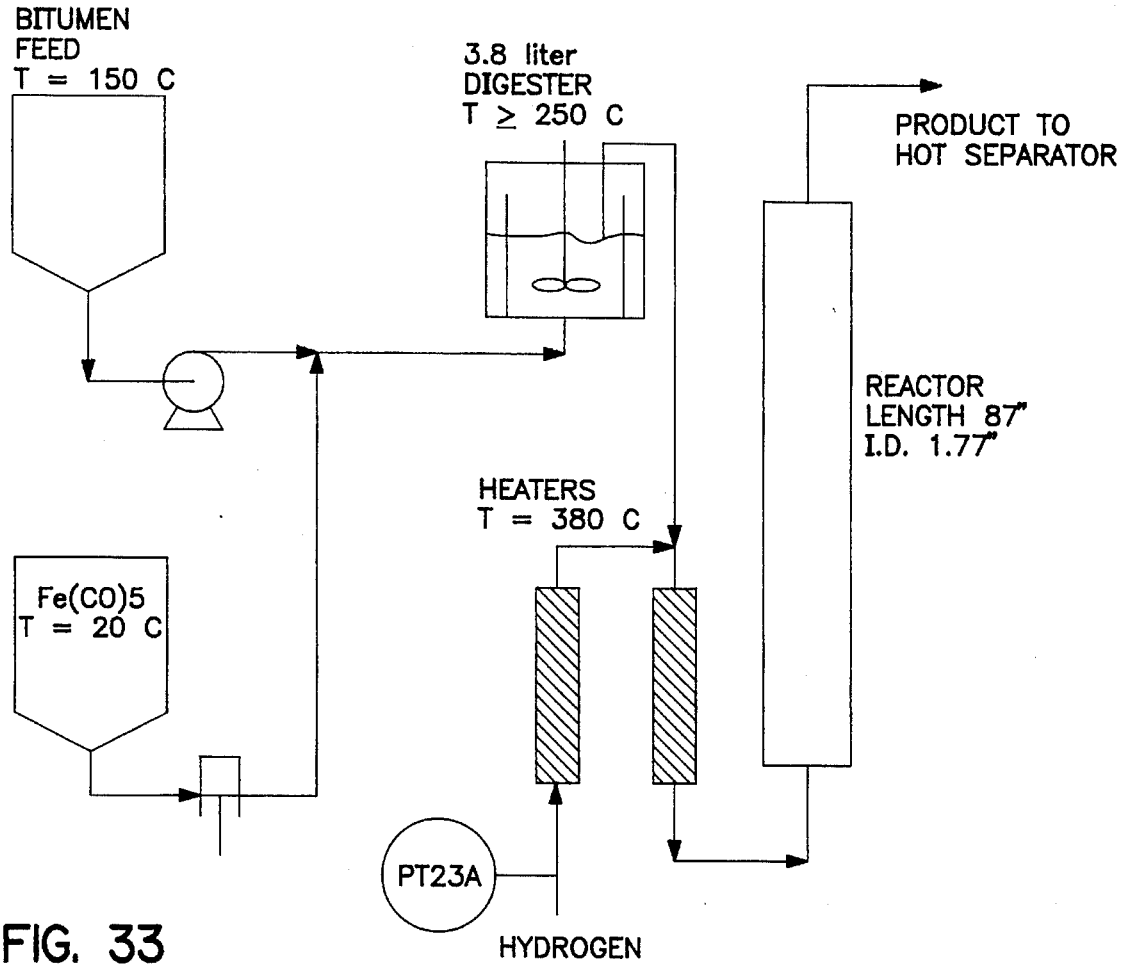
FIG. 33 is a simplified schematic of the pilot circuit used to carry out the experimental run carried out in Example XI.
Figure 34:
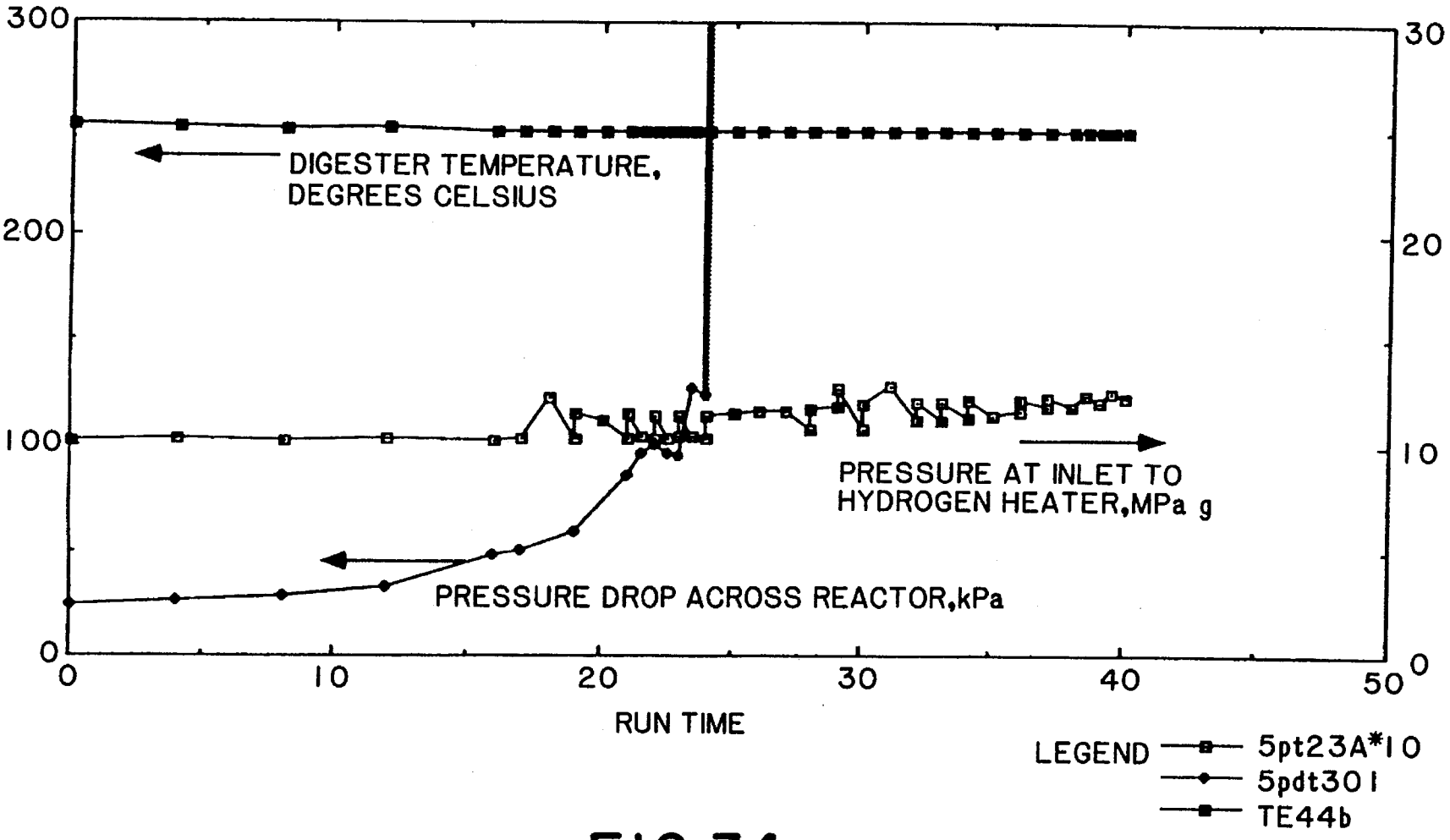
FIG. 34 is a plot of pressure logs for the run of Example XI.

FIG. 33 shows the pilot circuit and some conditions used in this experiment. FIG. 34 shows the pressure logs from the run.

In this test, the following pertained:

feed: Athabasca bitumen, composition: 45% 220°–524° C., 55% 525° C.$^+$;

feed rate: 2.815 kg/hr.;

additive: iron pentacarbonyl—33% wt. in light gas oil;

additive rate: 32.9 ml/hr.;

additive concentration: 5000 ppm with respect to 525° C.$^+$ fraction;

hydrogen: 34 standard liters/minute (4000 SCF/BBL);

digester temperature: 250° C.;

reactor conditions: 450° C. 10.2 MPa.

The estimated pitch conversion was 75%.

The pressure drop across the reactor increased slowly during the run and then precipitously after 33 hours. The circuit became inoperable after 36 hours as the pressure recorded at PT23A increased.

Examination of material filtered from the product pitch contained iron sulfide particles sized 1–2μ.

EXAMPLE XII

This example shows that if appropriate dispersion is conducted at a mild or moderate temperature that is well below additive decomposition temperature and decomposition is conducted with mixing, then good conversion and coke reduction results follow.

Figure 35:
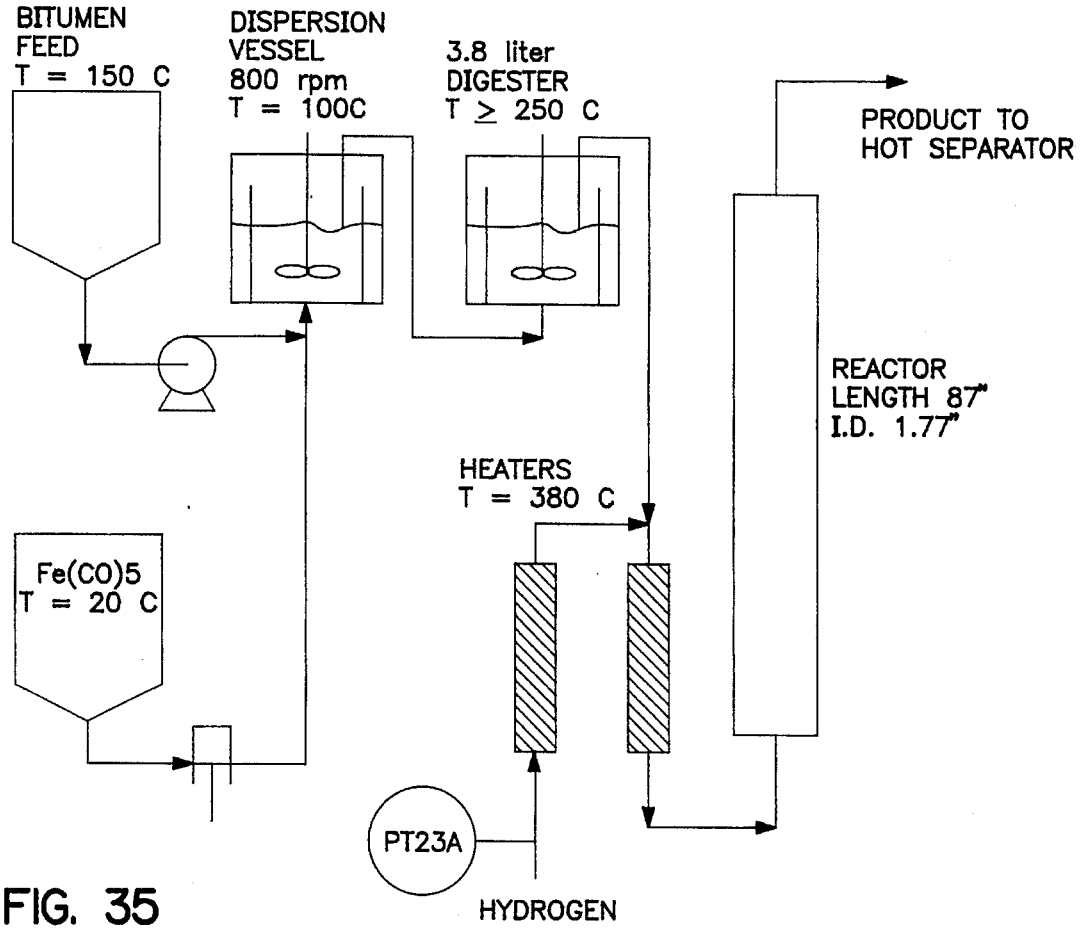
FIG. 35 is a simplified schematic of the pilot circuit used to carry out the experimental runs reported on in Example XII, with conditions shown thereon.
Figure 36:
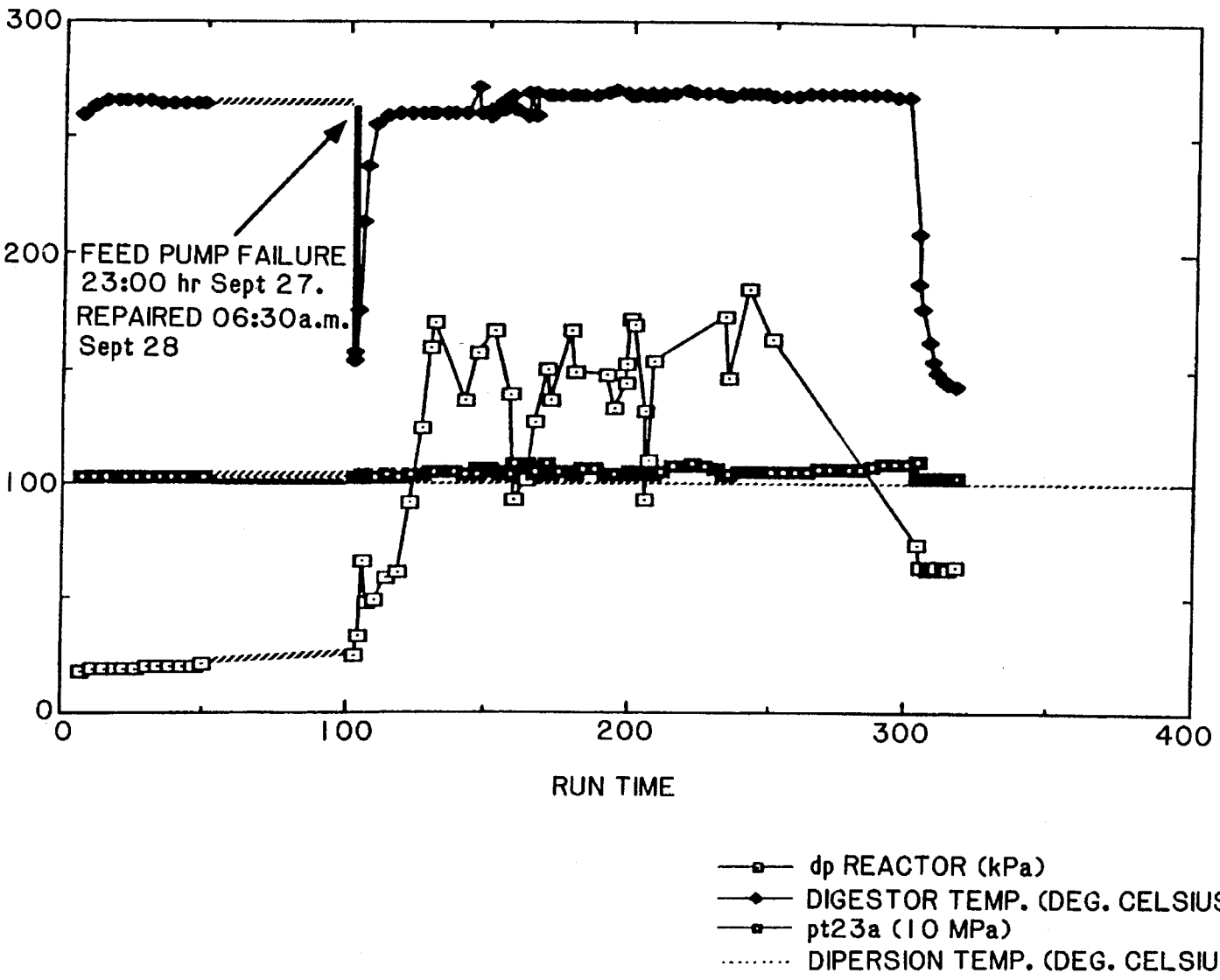
FIG. 36 is a plot of differential pressures across the reactor, pressures at the heater, and digester temperature of the circuit used for Example XII.

FIG. 35 shows the circuit and conditions used for this run. FIG. 36 shows various logs from the run.

In this test, bitumen and iron pentacarbonyl were mixed at a temperature of about 100° C. for about 30 minutes in an impellor-equipped first vessel, to disperse the additive, and then mixed at a temperature of about 250° C. for about one hour in an impellor-equipped second vessel to decompose the additive while keeping it dispersed.

The following Table 12 sets forth other conditions and the results of the run:

TABLE 12

Dispersion Vessel Temperature — 100° C.
Digester Temperature — 252° C.
Fe ppm of 525° C.$^+$ — 2500

| Hydrogen l/min. | Athabasca bitumen kg/hr | Reactor Temp °C. | $Fe(CO)_5$ LGO/hr | 525° C.$^+$ conversion | Days |
|---|---|---|---|---|---|
| 68.0 | 2.960 | 450 | 11 | 84 | 5 |
| 68.0 | 2.960 | 455 | 11 | 87 | 3 |
| 55.3 | 2.405 | 455 | 8.9 | 90 | 4 |
| 68 | 2.960 | 455 | 8.9 | 92 | 3 |

Smooth, plug-free operation was observed for the first 100 hours of operation. At that point the pump failed. Following repair, operation of the circuit was fairly smooth, although small fluctuations in pressure drop across the reactor were recorded. Pitch conversion increased slowly from 84% to 92% over a run duration of about 300 hours.

Examination showed the iron of the additive to be present in the pitch in the form of colloidal iron sulphide particles.

EXAMPLE XIII

This example provides data showing the extent of decomposition of molybdenum naphthanate ("Mo-naph") and molybdenum ethyl hexanoate ("Mo-HEX") at different temperatures.

More particularly, infrared spectra of samples of bitumen containing either Mo-naph or Mo-HEX were measured over time at temperatures of 130° C., 200° C. and 300° C. In the following table, the % decomposition of each of these catalyst precursors is expressed as a fraction (%) of the respective spectral components that had disappeared by a given time.

TABLE 13

| Temp., °C. | Sampling Time, Min. | Relative Disappearance of Mo-Carboxylates in Feed During Heating: Mo-Fraction, wt %[a] NAPH[c] | Mo-Fraction, wt %[a] HEX[d] | Precursor Disappearance, %[b] NAPH[c] | Precursor Disappearance, %[b] HEX[d] |
|---|---|---|---|---|---|
| 130 | 30[f] | 32.1 | 32.3 | 0.0 | 0.0 |
| | 150 | 35.4 | 36.7 | 0.0 | 9.8 |
| | 1110 | 29.9 | 35.9 | 10.4 | 32.2 |
| | 3030 | 31.3 | 37.5 | 13.9 | 42.4 |
| | 3990 | 33.2 | 37.5 | 15.1 | 42.6 |
| | 5820 | 33.2 | 38.0 | 20.9 | 43.8 |
| 200 | 5[f] | 30.6 | 33.1 | 0.0 | 0.0 |
| | 35 | 30.1 | 36.4 | 20.4 | 33.9 |
| | 60 | 32.4 | 37.0 | 22.3 | 44.8 |
| | 150 | 36.1 | — | 31.1 | — |
| | 240 | 36.6 | — | 34.5 | — |
| | 330 | 35.5 | — | 35.9 | — |
| | 960 | — | 15.7[e] | — | 65.3 |
| 300 | 0[f,g] | 32.3 | 33.8 | 0.0 | 0.0 |
| | 5[h] | 30.8 | 36.5 | 50.9 | 94.6 |
| | 10 | 33.8 | 33.1 | 77.2 | 97.8 |
| | 20 | 35.0 | — | 82.5 | — |
| | 30 | — | 34.8 | — | 96.9 |
| | 45 | 35.5 | 36.7 | 84.2 | 96.2 |
| | 70 | 36.1 | 38.4 | 83.5 | 96.4 |

[a]GPC, SX-4/$CHCl_3$; void vol. 100 ml; fr. vol. 25 ml
[b]DRIFTS — carboxylate region
[c]— 43000 ppm Mo/CLVB
[d]— 35000 ppm Mo/CLVB
[e]Product: 16.3% insolubles
[f]Reference sample
[g]Sampled at 100° C.
[h]Sampled at 260° C.

EXAMPLE XIV

This example supports the assertion that the catalytic particles produced by the process of the invention are colloidal in size.

A sample of pitch produced in run CFE-1 was examined by X-ray diffraction and Mossbauer spectroscopy.

The X-ray diffraction analysis revealed the presence of $FeS_2$.

Figure 24:
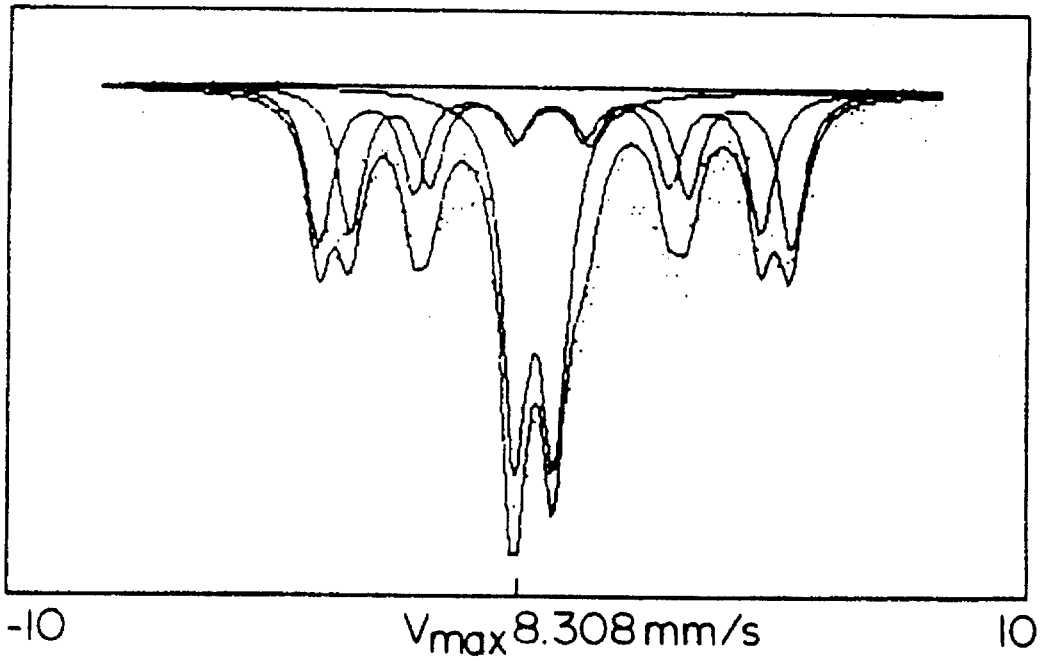
FIG. 24 is a plot derived from Mossbauer spectroscopy analysis of catalyst produced in accordance with the invention—see Example III (Table 4)

The spectrum from the Mossbauer analysis is shown in FIG. 24. The supporting data are set forth in Table 14 below. Notable in the spectrum is the breadth of each of the peaks. Such breadth is indicative of very fine, colloidal particles, typically less than 10 nanometers in dimension.

Prior to this test, microscopic examination of samples of pitch obtained from experiments done in accordance with the invention showed no evidence of iron sulphide particles, even though chemical analyses typically showed more than 20% by weight iron sulphide in the pitch. This evidence indicated that the catalyst particles were submicroscopic.

TABLE 14

Channel number: 512
Folding point: 257.5
Geom. Effect: 0
Results of Fit July 8, 1988 17:16:00
g046 CFE-1 deposited 5.0 × 0.1 24/6/88
Theory: 4
Number of Parameters: 26 Number of Iterations: 1
$Chi^2$: 1.9297

| Name | Initial | Final | Error | Check | |
|---|---|---|---|---|---|
| BASE-LINE | 4609769 | 4609769 | 25.2337 | 1.000 | 1.000 |

TABLE 14-continued

Channel number: 512
Folding point: 257.5
Geom. Effect: 0
Results of Fit July 8, 1988 17:16:00
g046 CFE-1 deposited 5.0 × 0.1 24/6/88
Theory: 4
Number of Parameters: 26 Number of Iterations: 1
$Chi^2$: 1.9297

| Name | Initial | Final | Error | Check | |
|---|---|---|---|---|---|
| Total Area | 0.0266 | 0.0266 | 0.0028 | 1.733 | 1.729 |
| Mag Field 1 | 24.9560 | 24.9560 | 0.0250 | 0.985 | 0.998 |
| Quad Mag 1 | 0.1166 | 0.1166 | 0.0061 | 0.986 | 0.996 |
| Shift Mag 1 | 0.5879 | 0.5879 | 0.0031 | 0.984 | 1.024 |
| Width Out 1 | 0.6000 | 0.6000 | FIXED | | |
| 3:2:1 corr | 1.0000 | 1.0000 | FIXED | | |
| WNat Mag 1 | 0.6000 | 0.6000 | FIXED | | |
| Mag Field 2 | 28.6603 | 28.6603 | 0.0050 | 2.034 | 2.045 |
| Quad Mag 2 | 0.0882 | 0.0882 | 0.0072 | 3.743 | 3.687 |
| Shift Mag 2 | 0.5985 | 0.5985 | 0.0220 | 0.695 | 0.888 |
| Width Out 2 | 0.6000 | 0.6000 | FIXED | | |
| 3:2:1 corr | 1.000 | 1.0000 | FIXED | | |
| Area Mag 2 | 0.3342 | 0.3342 | 0.0204 | 1.353 | 1.385 |
| WNat Mag 2 | 0.6000 | 0.60000 | FIXED | | |
| Mag Field 3 | 32.0000 | 32.0000 | FIXED | | |
| Quad Mag 3 | −0.2200 | −0.2200 | FIXED | | |
| Shift Mag 3 | 0.2600 | 0.26000 | FIXED | | |
| Width Out 3 | 0.7500 | 0.7500 | FIXED | | |
| 3:2:1 corr | 1.0000 | 1.0000 | FIXED | | |
| Area Mag 3 | 0.0000 | 0.0000 | FIXED | | |
| WNat Mag 3 | 0.2600 | 0.2600 | FIXED | | |
| Quad Split 1 | 0.7555 | 0.7555 | 0.0218 | 0.999 | 0.991 |
| Iso Shift 1 | 0.2700 | 0.2700 | 0.0126 | 0.748 | 0.755 |
| Width 1 | 0.6000 | 0.6000 | FIXED | | |
| Area 1 | 0.3624 | 0.3624 | 0.0121 | 1.946 | 1.964 |

EXAMPLES XV–XIX

These examples are based on experimentation using molybdenum naphthanate as the additive or catalyst precursor.

In the experiments, vacuum tower bottoms derived from bitumen were used as the feed. The characteristics and composition of the feed were as follows:

TABLE 15

| Distillation Wt. % | IBP–430° C. |
|---|---|
| IBP–525° C. | 24.0 |
| +525° C. | 76.0 |

TABLE 15-continued

| | IBP–430° C. |
|---|---|
| Elemental Composition Wt. % | |
| Carbon | 83.6 |
| Hydrogen | 9.7 |
| Nitrogen | 0.8 |
| Sulfur | 5.9 |
| Oxygen | — |
| H/C | 1.4 |
| TLC/FID Class Composition, Hydrocarbons | 75.0 |
| Asphaltene (includes Preasphaltene) | 25.0 |

The circuit used for the runs reported was that of FIG. 25. 300 ppm of molybdenum, as molybdenum naphthanate, was added to the feed tank. The feed was stirred and pumped around the loop at 200° C. for 3 hours before the experiment. The tests were 12 to 15 hours duration.

EXAMPLE XV

This example shows that high conversion of asphaltenes with minimal production of solid coke was achieved when the invention was practised with molybdenum naphthanate as the additive.

An asphaltene-rich feedstock of Cold Lake vacuum residuum, IBP greater than 430° C., was charged to a 0.01 $m^3$ surge tank. 300 ppm of molybdenum, as molybdenum naphthanate, was added to the tank which was equipped with a stirrer and recycle pump, and mixed therewith under a nitrogen blanket at 200° C. to form a homogeneous mixture. The mixture was then pumped through the process heater into the reactor. Its temperature was increased to 455° C. in the process heater. Hydrogen was admixed with the mixture at the entrance to the process heater. The hydrogen was supplied at a rate of 10,000–12,000 SCF/BBL and at a pressure of about 2,000 psig. The process heater consisted of a 2.9 mm I.D. 6100 mm long coil immersed in tin at about the hydrocracking temperature.

The volume of the hydrocracking reactor was 669 cc. It was a stainless steel cylinder 25 mm I.D. and 1370 mm high.

The following conditions applied to the reactor operation:

Volumetric flow of $H_2$/liquid=10,000 SCF/BBL

Liquid Peclet No.=about 0.25

Gas Peclet No.=about 6

(The Peclet Nos. were determined from tracer studies using $Xe^{133}$ and $I^{131}$.)

The LHSV was 0.4 to 1.0 $h^{-1}$. It usually required 10–12 hours for the reactor to reach steady state operating conditions. The hydrocracking took place at a temperature of 455° C. and pressure of 2000 psig. The reactor effluent comprising a mixture of gases and liquids was fed to a hot separator where gases and liquid were separated.

Table 16 provides typical results for the process.

TABLE 16

| | | |
|---|---|---|
| Reaction Temperature, °C. | 455 | 455 |
| LHSV, $h^{-1}$ | 0.41 | 1.03 |
| Pressure, psig | 2000 | 2000 |
| Product Yields, wt. % on feed | | |
| $H_2S$ | 4.41 | 3.88 |
| $C_1$–$C_3$ | 8.00 | 9.01 |
| $C_4$–195° C. | 20.30 | 6.88 |
| 195–350° C. | 46.00 | 39.73 |

TABLE 16-continued

| | | |
|---|---|---|
| 350–525° C. | 21.42 | 35.21 |
| +525° C. | 0.11 | 5.76 |
| Coke | 0.00 | 0.86 |
| $C_4$–525° C., vol. % | 108.42 | 96.44 |
| Pitch Conversion, wt. % | 99.2 | 91.2 |
| Asphaltene Conversion, wt. % | 100.0 | 84.4 |
| HDS, % | 82.8 | 72.7 |
| $H_2$ Cons., wt. % of feed | 2.5 | 1.9 |

The above hydrocracking tests were conducted on Cold Lake vacuum bottoms described in Table 15 and the precursor concentration was 300 ppm Mo on feed. After each test, all units of the experimental circuit were opened, examined and found to be free of coke or other fouling.

It will be noted that the Mo run was conducted successfully without solvent, even though VTB's were used as the feed.

EXAMPLE XVI

This example supports the assertion that the catalyst from Example XV was colloidal.

Hydrocracking residuum was dispersed in methylene chloride and the mixture was injected into a gel permeation column. The molybdenum containing component was found to have an apparent molecular weight range 400 to 3000 with respect to this particular gel permeation column calibrated with respect to polystyrene. This range corresponds to colloidal particles of diameter greater than 0.002 micron but less than 0.01 microns.

EXAMPLE XVII

This example shows the effect of preferential association of catalyst precursor with the asphaltenic fraction of bitumen residue feedstock.

Table 17 shows data from two tests, one with catalyst and one without catalyst. These tests demonstrated the differences on asphaltene conversion and coke yield, in particular. Although the pitch conversions for the two experiments were similar, the asphaltene conversions differed by a factor of 2; the catalyst selectively converted the asphaltene.

TABLE 17

| | No Catalyst | 300 ppm Mo |
|---|---|---|
| Reactor Temperature; °C. | 455 | 455 |
| LHSV; $h^{-h}$ | 3.63 | 3.65 |
| Pressure; psig | 2500 | 2500 |
| $H_2$ flow rate; scf/bbl | 7900 | 7800 |
| Product Yields, wt. % on feed | | |
| $H_2S$ | 1.94 | 2.40 |
| $C_1$–$C_3$ | 2.59 | 2.22 |
| $C_4$–195° C. | 5.16 | 3.55 |
| 195° C.–350° C. | 22.40 | 20.20 |
| 350°–525° C. | 31.78 | 35.82 |
| +525° C. | 36.25 | 36.09 |
| Coke | 6.5 | 0.79 |
| Pitch Conversion, % | 52.9 | 52.6 |
| Asphaltene Conversion, % | 23.1 | 58.5 |
| HDS, % | 31.8 | 39.3 |
| $H_2$ cons., wt. % of feed | 0.42 | 0.91 |

Additional evidence of the effect of catalyst precursor on selective asphaltene conversion and coke suppression is shown in Table 18 where the composition of two +525° C. hydrocracking residua (pitch) are compared.

TABLE 18

| Fraction | Pitch I Yield % | Pitch I Sulfur % | Pitch II Yield % | Pitch II Sulfur % |
|---|---|---|---|---|
| Maltenes | 63.2 | 3.9 | 41.5 | 4.7 |
| Asphaltenes | 36.6 | 5.8 | 33.4 | 6.3 |
| Preasphaltenes | | | 16.3 | 6.2 |
| Coke | 0.2 | — | 8.3 | 6.7 |

Pitch I was derived from a test containing molybdenum naphthanate catalyst precursor. Pitch II was derived from a test not containing molybdenum naphthanate catalyst precursor.

Figure 38:
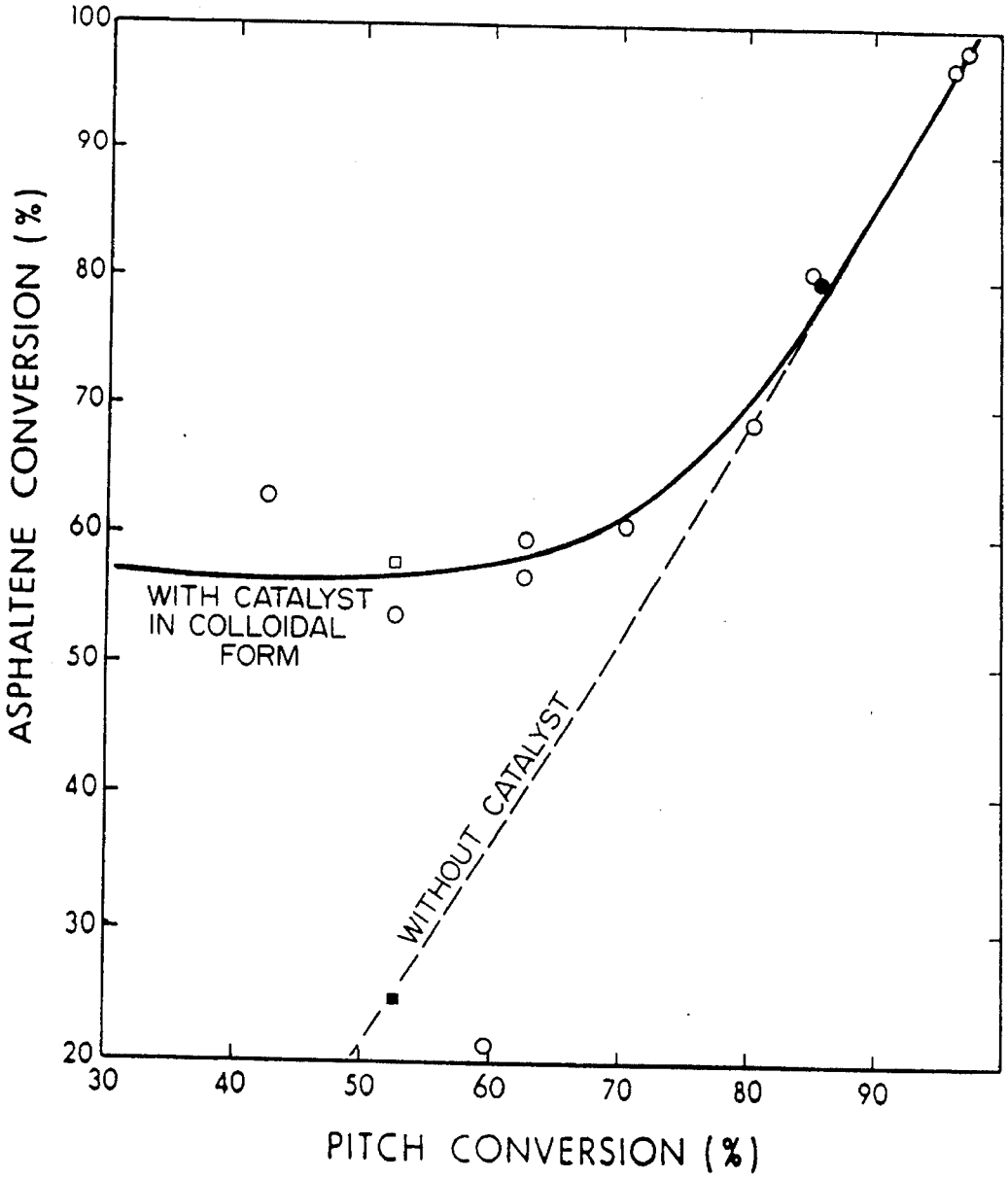
FIG. 38 shows asphaltene conversion versus pitch conversion for experiments providing pitch conversions between 42 and 99% for Example XVII.

FIG. 38 shows that asphaltene conversion was favoured by the presence of the catalyst for a broad range of pitch conversion, 42 to 99%. In the presence of catalyst the process units remained clean and free of coke. In the absence of catalyst, the process units became fouled by coke.

EXAMPLE XVIII

This example shows that the process operates successfully over a broad range of concentration of precursor in the bitumen residuum.

TABLE 19

| | 30 ppm Mo | 300 ppm Mo |
|---|---|---|
| Reaction Temperature | 455 | 455 |
| LHSV/$h^{-1}$ | 1.03 | 1.03 |
| Pressure; psig | 2000 | 2000 |
| $H_2$ flow rate; scf/bbl | 16,400 | 13,400 |
| Product Yields, wt. % on feed | | |
| $H_2S$ | 2.86 | 3.88 |
| $C_1$–$C_3$ | 8.43 | 9.01 |
| $C_4$–195° C. | 12.13 | 6.88 |
| 195°–350° C. | 36.92 | 39.73 |
| 350° C.–525° C. | 34.37 | 35.21 |
| +525° C. | 5.88 | 5.76 |
| Coke | 0.43 | 0.86 |
| $C_4$–525° C. | 83.42 | 81.82 |
| $C_4$–525° C.; vol. % | 100.52 | 96.44 |
| Pitch Conversion, % | 91.6 | 91.2 |
| Asphaltene Conversion, % | 87.4 | 84.4 |
| HDS, % | 53.6 | 72.7 |
| $H_2$ Cons., wt. % of feed | 1.66 | 1.90 |

EXAMPLE XIX

This example shows that the catalyst precursor, molybdenum naphthanate, decomposes at temperatures greater than about 300° C. in the absence or presence of bitumen residuum.

Figures 37A, 37B, 37C, 37D, 37E, 37F:
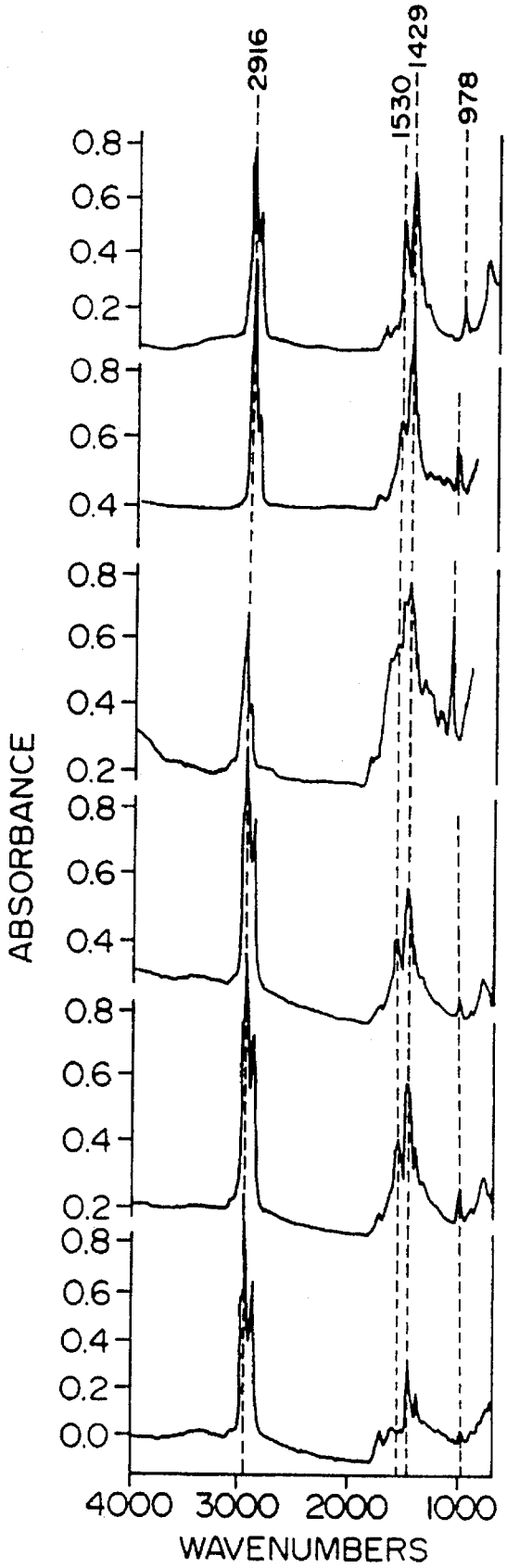
FIGS. 37(*a*) to 37(*f*) is a series of IR spectra demonstrating the effect of change in temperature in the mixing step for Example XIX.

FIGS. 37*a* and 37*b* show that the catalyst precursor is stable at temperatures less than 250° C. FIG. 37*c* shows that the catalyst precursor begins to decompose and polymerize slowly at a temperature of 300° C. At higher temperatures the decomposition was more rapid and coke was produced.

FIGS. 37*d* and 37*e* show that the catalyst precursor dissolved in bitumen residuum was stable at temperatures less than 250° C. FIG. 37*f* shows that the catalyst precursor dissolved in bitumen began to decompose slowly at temperature of 300° C.

Injection of the catalyst precursor into bitumen residuum at 350° C. produced coke containing molybdenum.

EXAMPLE XX

In accordance with a preferred embodiment of the invention, the heavy distillate and pitch mixture leaving the hot separator (which treats the reactor product) is subjected to distillation, to produce pitch. Part of this pitch is recycled to the reactor. In so doing the following things are accomplished:

(1) a greater rate of stripping of light ends is obtained without increase of hydrogen flux, the light ends having been removed from the recycle stream. This reduces coke formation and consumption of catalyst;

(2) the active catalyst being in its colloidal form in the recycle stream accumulates in the reactor, to provide a higher steady-state concentration therein than would be obtained without recycle. This reduces catalyst consumption by typically 50% from that obtained without recycle; and (3) residence time of pitch is selectively increased thereby increasing overall liquid yield and improved stability of operation.

In addition, a small amount of fresh feed is added to this recycle stream, thereby accelerating the mixing of the stream and cooling it before it is mixed with the additive-containing feedstock.

This example demonstrates the advantages of practising these preferred features.

Figure 39:
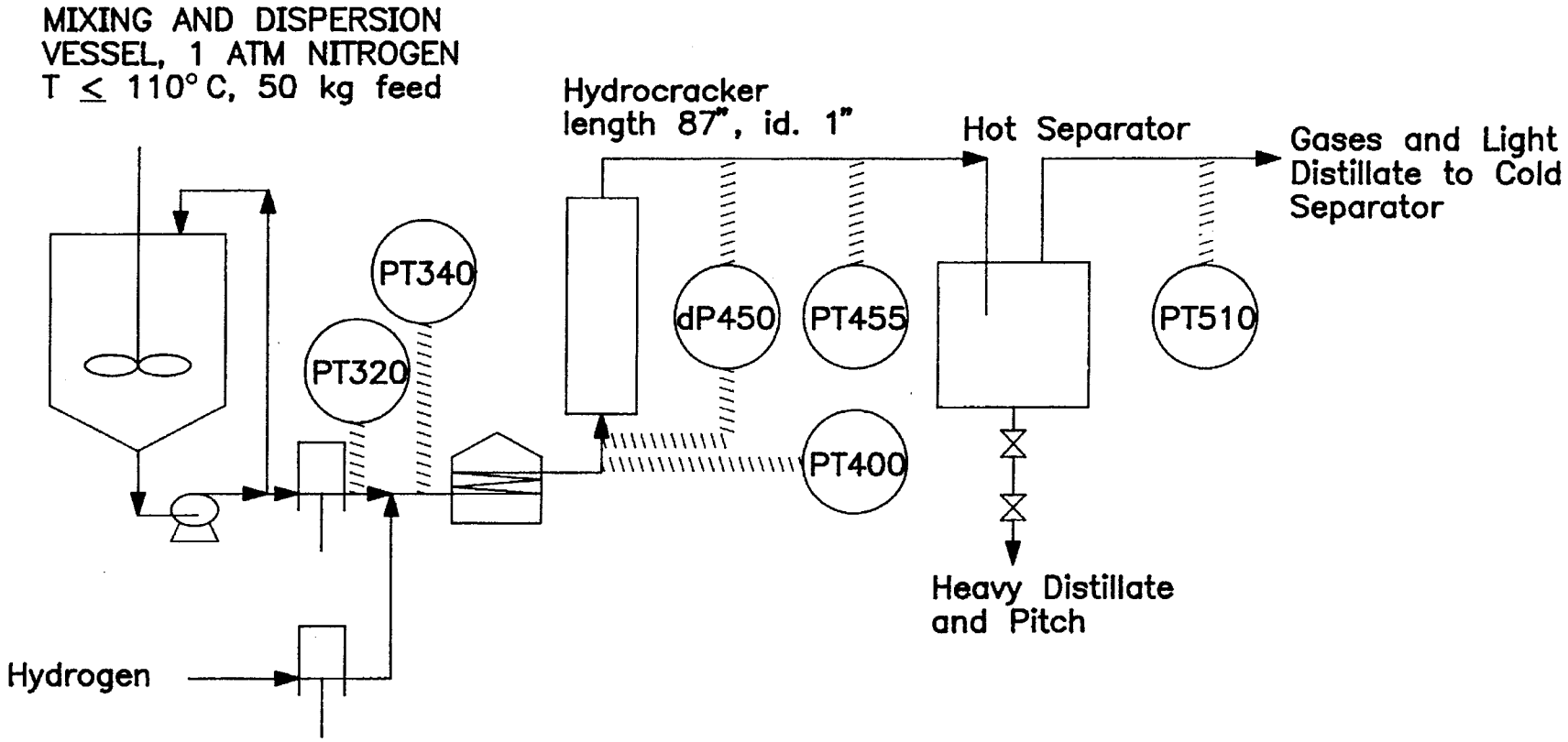
FIG. 39 is a simplified schematic of the once-through pilot circuit used in the first stage of run R 2-1, described in Example XX, with conditions shown thereon; note that the feed and catalyst precursor (molybdenum ethyl hexanoate solution) were mixed and circulated at temperature <110° C. for 24 hours before the start of any test.
Figure 40:
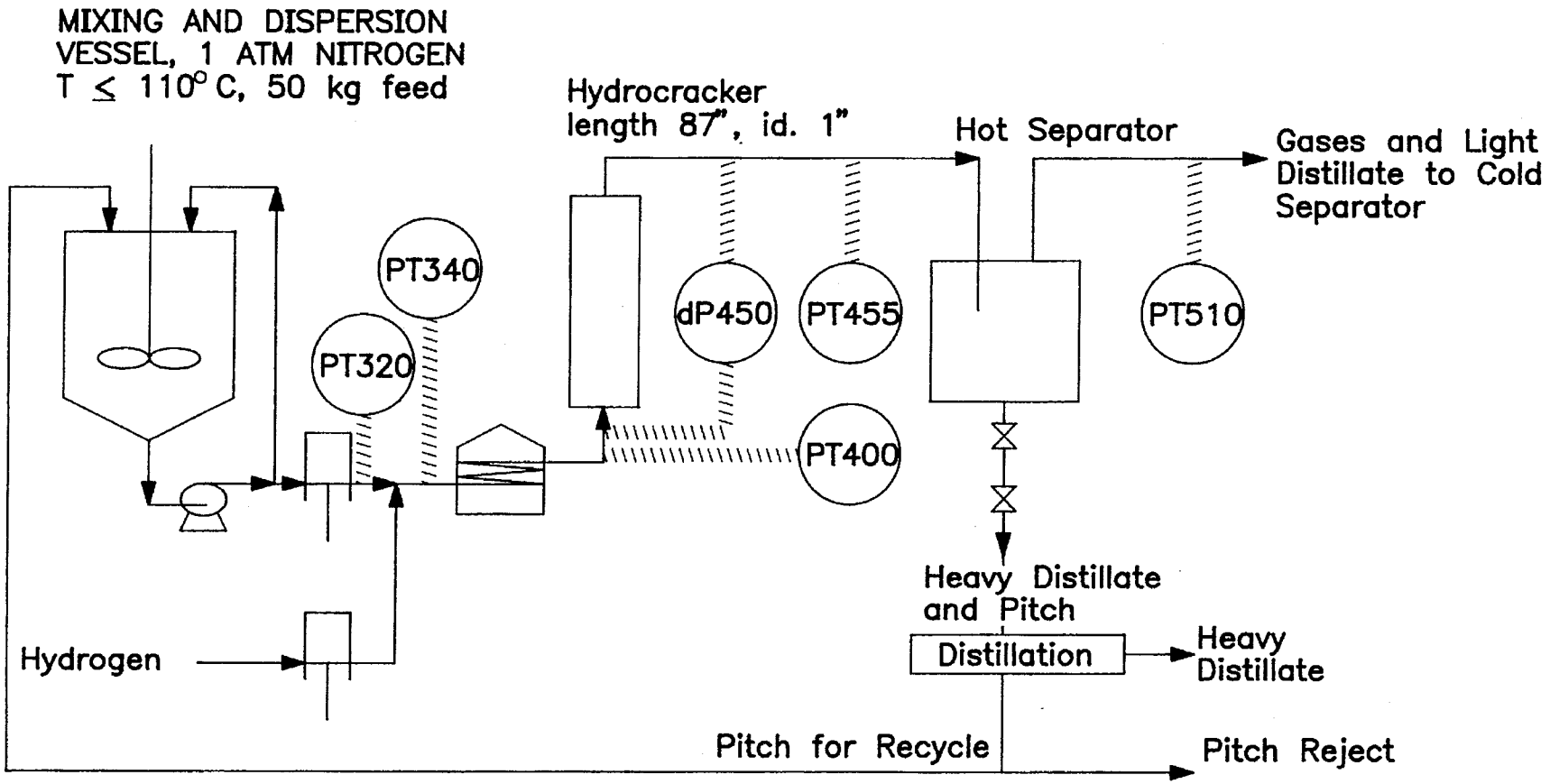
FIG. 40 is a simplified schematic of a modified form of the pilot circuit of FIG. 39, indicating the recycle of pitch which was practised in the second stage of run R 2-1; note that the feed and catalyst precursor (molybdenum ethyl hexanoate solution) were mixed and circulated at temperature <110° C. for 24 hours before the start of any test.
Figure 4I:
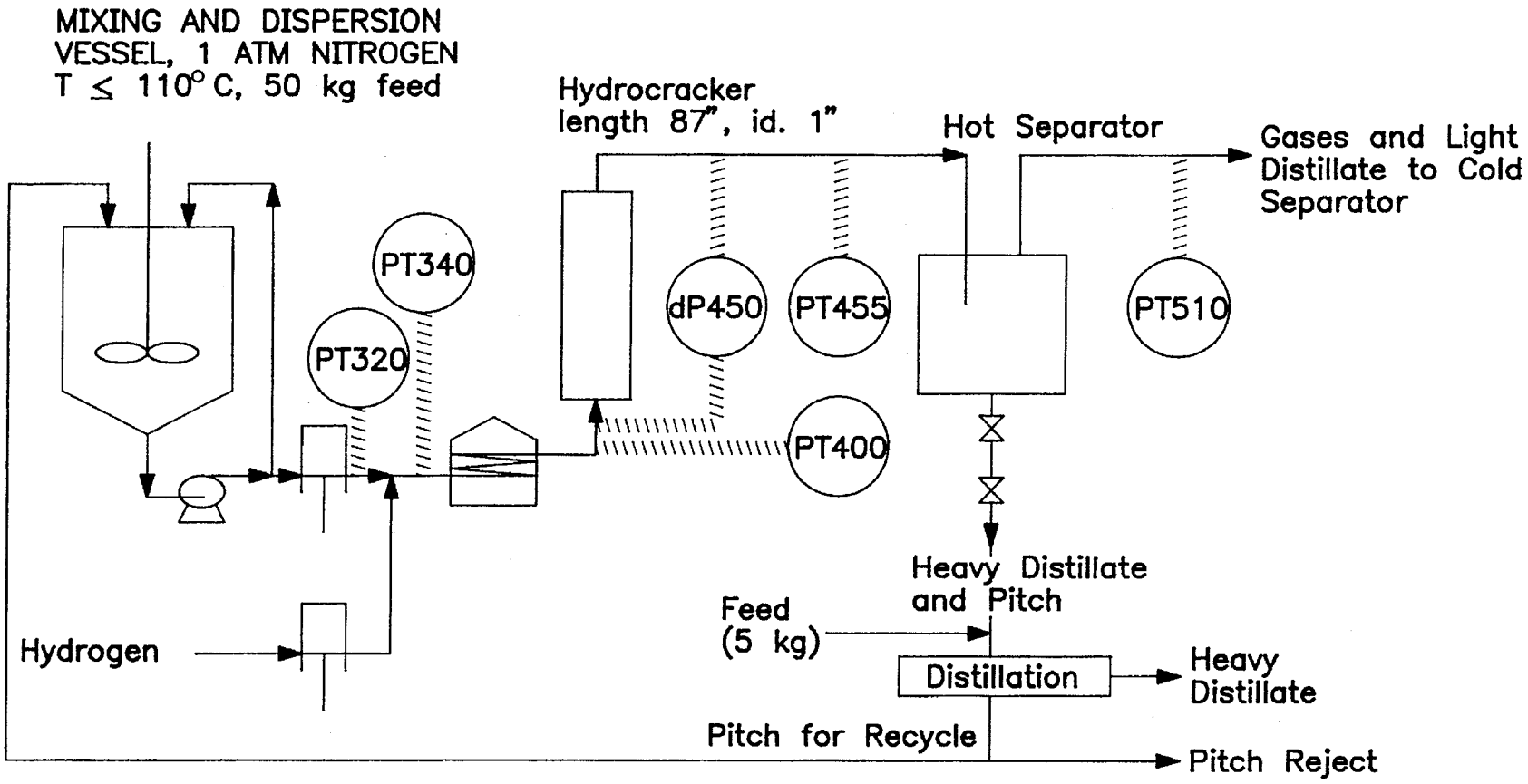

More particularly, FIGS. 39–41 show the circuits and conditions used in a 3-stage test run (R 2-1) which is now described. The run lasted a total length of 490 hours.

Common conditions of run R 2-1 were as follows:

Feed: Cold Lake vacuum bottoms containing 150 ppm molybdenum ethyl hexanoate dispersed in 200°–360° C. gas-oil;

Mixing: circulation and mixing for at least 24 hours at 105° C. under an atmosphere nitrogen blanket was practised, before the feed was processed;

Hydrocracking conditions:
pressure—13.6 MPa
temperature—about 450° C.
$H_2$ flow—about 15,000 scf/barrels Distillation:
conducted in accordance with ASTM D-1160 distillation.

During the first stage, consisting of 96 hours of operation, the test was conducted on a "once through" basis, i.e. without pitch recycle, as shown in FIG. 39. In the second stage, unconverted pitch was recycled back to the reactor to contribute 15% by weight of the feed. This second stage process is shown in FIG. 40 and lasted for 390 hours. Recycling of unconverted pitch improved fresh feed pitch conversion from 90% (in the first stage) to 98% (in the second stage).

Figure 42:
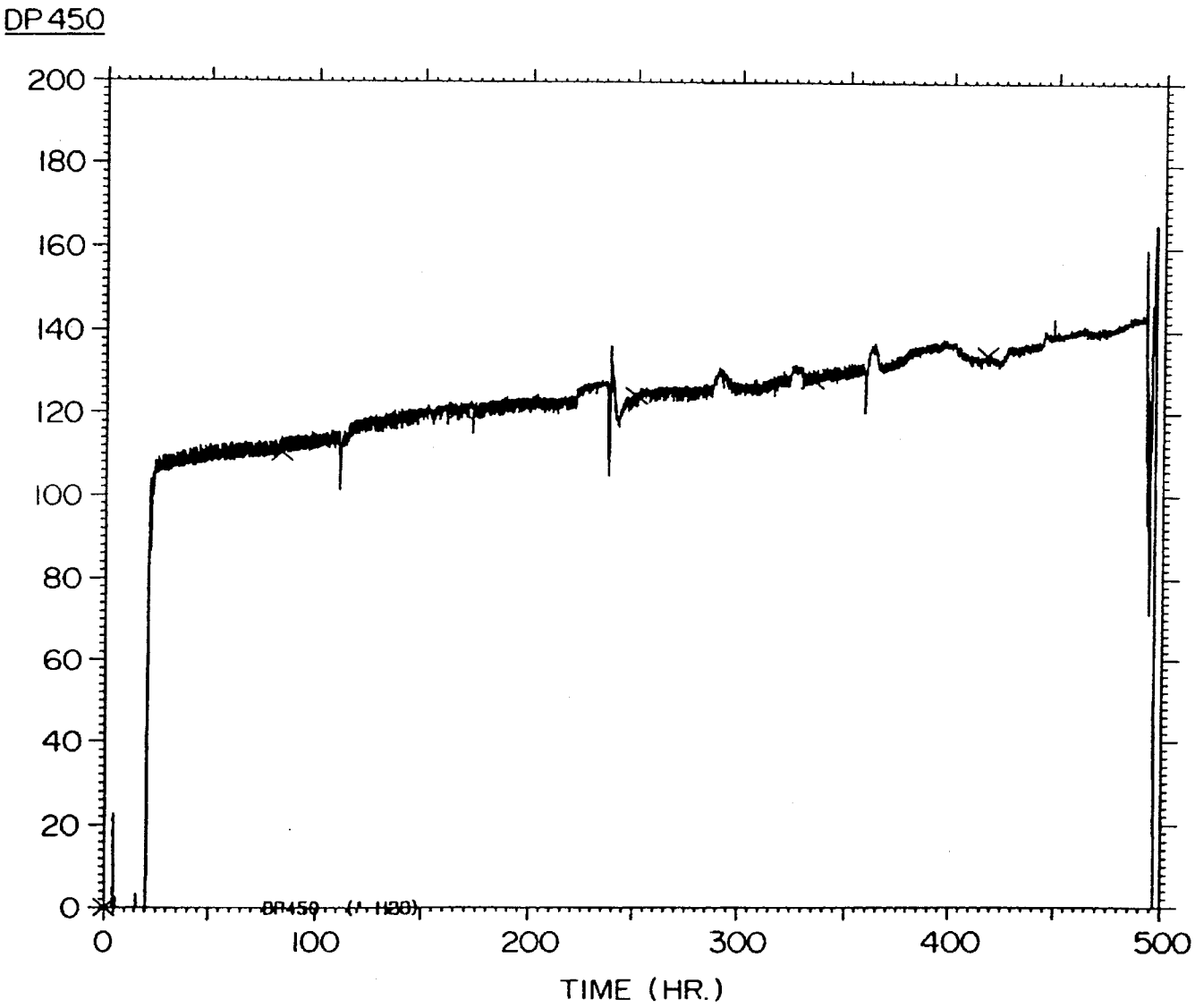
FIG. 42 is a plot of differential pressure across the reactor during run R 2-1.
Figure 43:
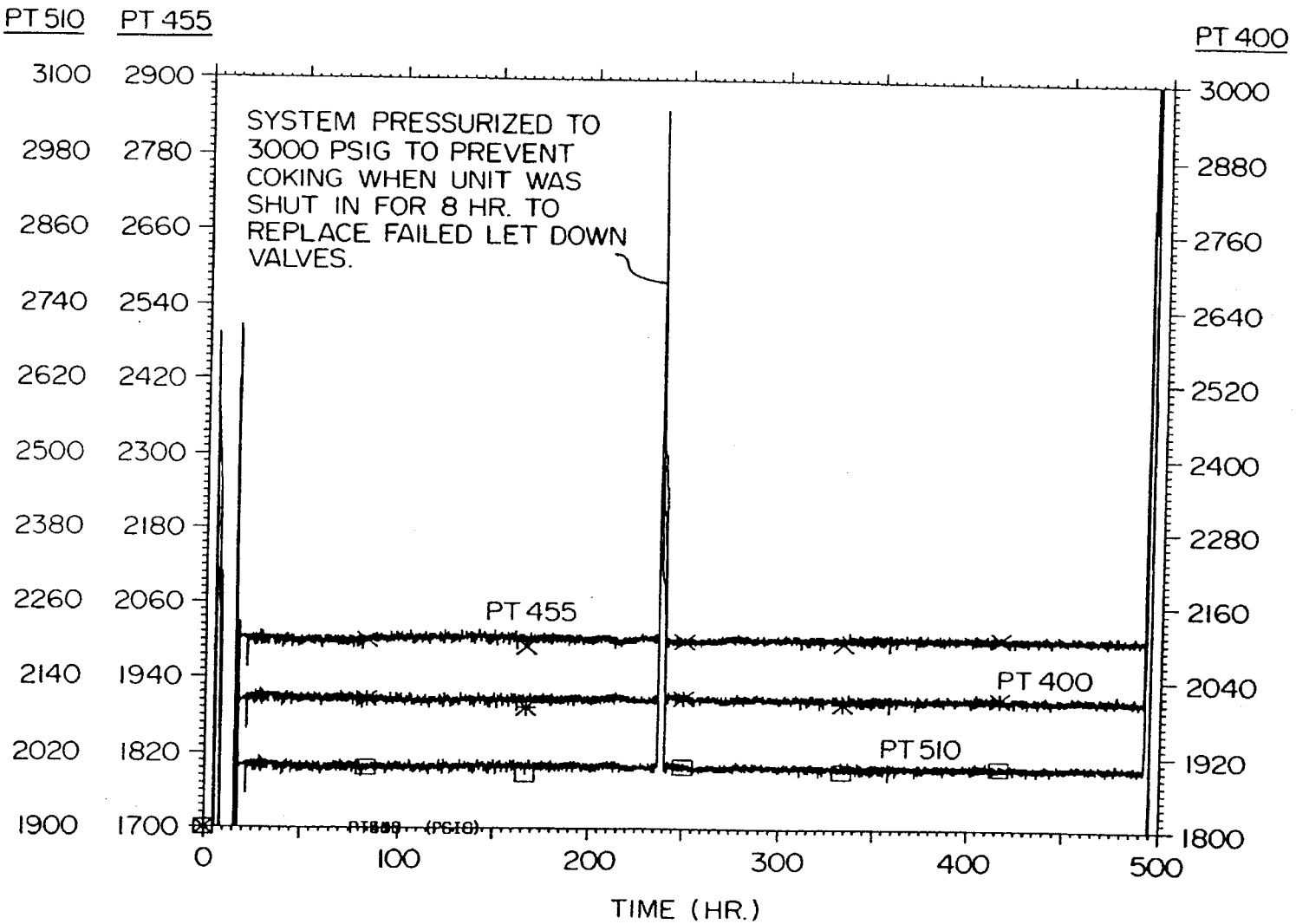
FIG. 43 is a plot of pressures taken at different indicated points along the circuit during run R 2-1.

Compared to run B 3-1 (Example IX), run R 2-1 never experienced any significant plugging or pressure pulses. This is indicated by the pressure logs set forth in FIGS. 42 and 43.

However, during the distillation of the hot separator product to recover unconverted pitch for recycling, it was noted that significant lumping of pitch (similar to agglomeration) occurred in the distillation pot. These lumps were hard to break up and they adhered strongly to the distillation vessel.

The lumps were determined to comprise unconverted asphaltene and molybdenum sulfide formed by the additive.

In the third stage of the test, involving the last 150 hours of the run, a portion of fresh feed was added to the hot separator product, prior to introducing it to the distillation vessel. This arrangement is shown in FIG. 41. Also, in this third stage the molybdenum hexanoate concentration was 150 ppm (metal).

It was determined that, in the second stage, 3164 grams of hot separator product produced 89.4 grams of lumpy solids and 28.7 grams of residue adhered strongly to the distillation pot. This was equivalent to 4.1% of the charge.

In the third stage, 3200.1 grams of hot separator product plus 601.5 grams of fresh Cold Lake vacuum bottoms produced no lumps and only 6.3 grams of residue adhered to the distillation pot. This was equivalent to 0.2% of the hot separator product.

In conclusion then, the test showed:

That the conditions of the process yielded 490 hours of operation free of plugging and fouling;

That pitch conversion increased significantly with recycling of unconverted pitch; and That adding a portion of fresh feed into the distillation unit for pitch separation resulted in reduction of asphaltene separation in the distillation step. In other words, the addition of some fresh feed to the hot recycle pitch accelerated its dispersion in the feed stream to the reactor.

Figure 44:
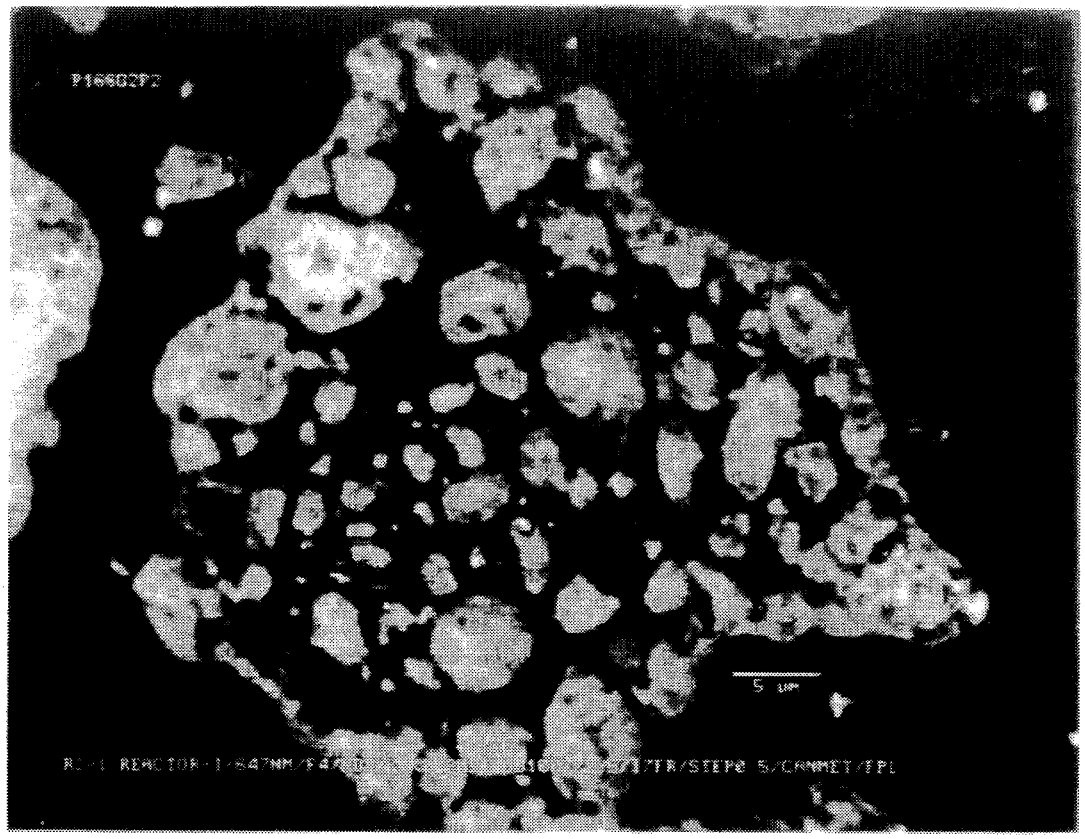
FIG. 44 is a confocal micrograph depicting a particle from run R 2-1 in a stage of fusion or coalescence of the outer components trapping several particles in the central area. Sub-micron size inorganic components of high reflectance are clearly distinguished in several areas of the particle (Reflected mode, 647 nm, oil immersion, 2500×).

At the completion of the test, the reactor and hot separator were opened and all unit surfaces were observed to be clean and free of fouling. Liquid collected from the reactor was filtered. The solid material so obtained was a fine dust consisting of microscopic agglomerates. The solid material so obtained is shown in FIG. 44.

The embodiments of the invention in which an exclusive property or privilege is claimed are defined as follows:

1. A process for preparing a heavy hydrocarbon feedstock for hydrocracking, said feedstock containing asphaltenes and sulfur moieties, comprising:

combining the feedstock and an oil-soluble metal compound additive and temporarily retaining the product in a mixer and mixing it at a temperature that is in the range 50° C. to 300° C. and which is less than the decomposition temperature of the additive, to produce a product mixture;

said additive being selected from the group consisting of molybdenum, iron, nickel and cobalt compound additives, said additives being operative, when heated to hydrocracking temperature, to decompose and react with sulfur moieties in the feedstock to form metal sulfide particles that are catalytic for hydrocracking;

said mixing being conducted for sufficient time to cause the additive to be sufficiently dispersed so that the metal sulfide particles formed upon hydrocracking are colloidal in size.

2. The process as set forth in claim 1 wherein:

mixing is conducted at a temperature in the range of 80° C. to 190° C.

3. The process as set forth in claim 2 comprising:

further mixing the product mixture at a temperature greater than the decomposition temperature of the additive and less than hydrocracking temperature for sufficient time to decompose the additive while maintaining it dispersed.

4. The process as set forth in claim 2 wherein:

the additive is provided in an amount between 0.002% and 5% by weight based on the feedstock.

5. The process as set forth in claim 4 wherein:

the additive is an iron compound.

6. The process as set forth in claim 4 wherein:

the additive is a molybdenum compound.

7. The process as set forth in claim 2 comprising:

mixing a hydrocarbon solvent for asphaltenes with the feedstock and additive during the mixing step.

8. The process as set forth in claim 7 wherein:

the solvent/feedstock weight ratio is in the range 1:10 to 3:1.

9. The process as set forth in claim 3 comprising:

mixing a hydrocarbon solvent for asphaltenes with the feedstock and additive during the mixing step.

10. The process as set forth in claim 9 wherein:

the solvent/feedstock weight ratio is in the range 1:10 to 3:1.

11. The process as set forth in claim 10 wherein:

the additive is provided in amount of between 0.002% and 5% by weight based on the feedstock.

12. A process for hydrocracking a heavy hydrocarbon feedstock containing asphaltenes and sulfur moieties, comprising:

combining the feedstock and an oil-soluble metal compound additive and temporarily retaining the product in a mixer and mixing it at a temperature that is in the range 50° C. to 300° C. and which is less than the decomposition temperature of the additive, to produce a product mixture;

said additive being selected from the group consisting of molybdenum, iron, nickel and cobalt compound additives, said additives being operative, when heated to hydrocracking temperature, to decompose and react with sulfur moieties in the feedstock to form metal sulfide particles that are catalytic for hydrocracking;

said mixing being conducted for sufficient time to cause the additive to be sufficiently dispersed so that the metal sulfide particles formed upon hydrocracking are colloidal in size;

then further heating the product mixture to hydrocracking temperature;

introducing the heated product mixture into the chamber of a hydrocracking reactor;

temporarily retaining the heated product mixture in the chamber, continuously passing sufficient hydrogen through substantially the breadth and length of the chamber contents to maintain mixing of the chamber contents and stripping of light ends, and removing unreacted hydrogen and entrained light ends from the chamber and producing a pitch containing product comprising colloidal metal sulfide.

13. The process as set forth in claim 12 wherein:

mixing is conducted at a temperature in the range of 80° C. to 190° C.

14. The process as set forth in claim 13 comprising:

before heating to hydrocracking temperature, further mixing the product mixture at a temperature greater than the decomposition temperature of the additive and less than hydrocracking temperature for sufficient time to decompose the additive while maintaining it dispersed.

15. The process as set forth in claim 13 wherein:

the additive is provided in amount of between 0.002% and 5% by weight based on the feedstock.

16. The process as set forth in claim 15 wherein:

the additive is an iron compound.

17. The process as set forth in claim 15 wherein:

the additive is a molybdenum compound.

18. The process as set forth in claim 13 comprising:

mixing a hydrocarbon solvent for asphaltenes with the feedstock and additive during the mixing step.

19. The process as set forth in claim 18 wherein:

the solvent/feedstock weight ratio is in the range 1:10 to 3:1.

20. The process as set forth in claim 14 comprising:

mixing a hydrocarbon solvent for asphaltenes with the feedstock and additive during the mixing step.

21. The process as set forth in claim 20 wherein:

the solvent/feedstock weight ratio is in the range 1:10 to 3:1.

22. The process as set forth in claim 13 wherein:

sufficient hydrogen is passed through the reactor chamber to maintain the axial Peclet No. for liquid at less than 2.0 and for gas at more than 2.0.

23. The process as set forth in claim 14 wherein:

sufficient hydrogen is passed through the reactor chamber to maintain the axial Peclet No. for liquid at less than 2.0 and for gas at more than 2.0.

24. The process as set forth in claim 15 wherein:

sufficient hydrogen is passed through the reactor chamber to maintain the axial Peclet No. for liquid at less than 2.0 and for gas at more than 2.0.

25. The process as set forth in claim 19 wherein:

sufficient hydrogen is passed through the reactor chamber to maintain the axial Peclet No. for liquid at less than 2.0 and for gas at more than 2.0.

26. The process as set forth in claim 21 wherein:

sufficient hydrogen is passed through the reactor chamber to maintain the axial Peclet No. for liquid at less than 2.0 and for gas at more than 2.0.

27. The process as set forth in claim 22 wherein:

sufficient hydrogen is passed through the reactor chamber to maintain the axial Peclet No. for liquid at less than 2.0 and for gas at more than 2.0.

28. The process as set forth in claim 22 wherein:

the additive is provided in amount of between 0.002% and 5% by weight based on the feedstock.

29. The process as set forth in claim 23 wherein:

the additive is provided in amount of between 0.002% and 5% by weight based on the feedstock.

30. The process as set forth in claim 26 wherein:

the additive is provided in amount of between 0.002% and 5% by weight based on the feedstock.

31. The process as set forth in claim 24 wherein:

the additive is selected from the group consisting of iron and molybdenum compounds.

32. The process as set forth in claim 23 wherein:

the additive is selected from the group consisting of iron and molybdenum compounds.

33. The process as set forth in claim 26 wherein:

the additive is selected from the group consisting of iron and molybdenum compounds.

34. The process as set forth in claim 19 wherein:

the additive is selected from the group consisting of iron and molybdenum compounds.

35. The process as set forth in claim 11 wherein:

the additive is selected from the group consisting of iron and molybdenum compounds.

36. The process as set forth in claim 12 comprising:

recycling part of the produced reactor pitch back to the reactor.

37. The process as set forth in claim 12 comprising:

separating the pitch-containing product to produce a heavy distillate and pitch containing separator product;

distilling the separator product to produce pitch; and recycling part of the distilled pitch back to the reactor.

38. The process as set forth in claim 37 comprising:

adding new feedstock to the separator product prior to distillation.

39. The process as set forth in claim 38 wherein:

mixing is conducted at a temperature in the range of 80° C. to 190° C.

40. The process as set forth in claim 39 wherein:

the additive is provided in amount of between 0.002% and 5% by weight based on the feedstock.

41. The process as set forth in claim 39 comprising:

mixing a hydrocarbon solvent for asphaltenes with the feedstock and additive during the mixing step.

42. The process as set forth in claim 41 wherein:

the solvent/feedstock weight ratio is in the range 1:10 to 3:1.

43. The process as set forth in claim 42 wherein:

sufficient hydrogen is passed through the reactor chamber to maintain the axial Peclet No. for liquid at less than 2.0 and for gas at more than 2.0.

* * * * *